US012660929B2

(12) United States Patent
Chen et al.

(10) Patent No.: US 12,660,929 B2
(45) Date of Patent: Jun. 23, 2026

(54) MODULAR UNIT COUPLING SYSTEM AND METHOD

(71) Applicant: Edith-Min International Inc., Oakville (CA)

(72) Inventors: Hualian Chen, Beamsville (CA); Shreyash Jagdishbhai Upadhyay, Milton (CA); Austin Van Rossum, Milton (CA)

(73) Assignee: EDITH-MIN INTERNATIONAL INC., Oakville (CA)

( * ) Notice: Subject to any disclaimer, the term of this patent is extended or adjusted under 35 U.S.C. 154(b) by 438 days.

(21) Appl. No.: 18/314,519

(22) Filed: May 9, 2023

(65) Prior Publication Data

US 2024/0377020 A1 Nov. 14, 2024

(51) Int. Cl.

| | |
|---|---|
| ***A47C 13/00*** | (2006.01) |
| ***A47C 1/02*** | (2006.01) |
| ***A47C 1/124*** | (2006.01) |
| ***A47C 4/02*** | (2006.01) |
| *A47C 7/54* | (2006.01) |

(52) U.S. Cl.

CPC ..... *A47C 13/005* (2013.01); *A47C 1/124* (2013.01); *A47C 4/028* (2013.01); *A47C 7/546* (2013.01)

(58) Field of Classification Search

CPC ..... A47C 13/005; A47C 1/124; A47C 4/028; A47C 7/546

USPC ..... 248/188.1; 297/233

See application file for complete search history.

(56) References Cited

U.S. PATENT DOCUMENTS

| | | | | | |
|---|---|---|---|---|---|
| 3,774,966 | A * | 11/1973 | Faulkner | A47C 4/02 | 297/440.23 |
| 4,003,535 | A * | 1/1977 | Tianchon | A47B 13/04 | 248/188 |
| 4,456,299 | A * | 6/1984 | Steinmetz | A47C 4/02 | 403/231 |
| 5,234,253 | A * | 8/1993 | LaPointe | A47C 13/005 | 248/501 |
| 5,352,017 | A * | 10/1994 | Berning | A47C 13/005 | 297/440.1 |
| 5,423,596 | A * | 6/1995 | Laughlin | A47C 13/005 | 297/440.1 |

(Continued)

FOREIGN PATENT DOCUMENTS

| | | | | |
|---|---|---|---|---|
| DE | 20219614 U1 * | 2/2003 | ..... | A47C 1/124 |
| EP | 0596176 A1 * | 5/1994 | ..... | A47C 4/028 |

(Continued)

*Primary Examiner* — Taylor Morris

(74) *Attorney, Agent, or Firm* — Smart & Biggar LP

(57) ABSTRACT

A bracket system securable to modular units for releasably coupling the modular units together. In an example, the bracket system comprises a set of main brackets comprising front and rear frame extension brackets securable to base structural members of a first main unit. Each of the front and rear frame extension brackets comprises a beam comprising a post end and an opposed hook end. Each of the front and rear frame extension brackets also includes a rigid post secured proximate to the post end, a hook secured to the hook end of the beam, and a main bracket aperture positioned at each of the post end and the hook end. The hooks and the rigid posts are configured to releasably engage with corresponding rigid posts and corresponding hooks secured to adjacent modular units.

14 Claims, 53 Drawing Sheets

(56) References Cited

U.S. PATENT DOCUMENTS 5,520,437 A * 5/1996 LaPointe ..... A47C 15/002 297/248
5,529,427 A * 6/1996 Bost ..... A47C 1/124 280/250.1
5,544,938 A * 8/1996 Saul ..... A47C 13/005 297/248
5,630,644 A * 5/1997 LaPointe ..... A47C 13/005 297/411.32
5,931,529 A * 8/1999 LaPointe ..... A47C 13/005 403/319
5,996,145 A * 12/1999 Taylor ..... A47C 19/045 5/310
6,397,413 B2 * 6/2002 Epstein ..... A47C 19/025 5/310
6,932,428 B2 * 8/2005 Murphy ..... A47C 13/005 403/322.3
7,575,283 B2 * 8/2009 Crowe ..... A47C 13/005 297/440.16
7,690,058 B1 * 4/2010 Dwyer ..... A47C 19/024 5/310
8,210,488 B2 * 7/2012 Small ..... F16M 5/00 248/676
2002/0017814 A1 * 2/2002 Niederman ..... A47C 4/028 297/440.16
2003/0011231 A1 * 1/2003 Guillot ..... A47C 13/005 297/440.1
2006/0290180 A1 * 12/2006 Belair ..... B60N 2/68 297/232
2008/0309134 A1 * 12/2008 Brandtner ..... A47C 4/02 297/232
2012/0251233 A1 * 10/2012 Lange ..... F16B 12/10 403/345
2015/0320221 A1 * 11/2015 Williams ..... A47C 7/62 248/188.5
2021/0169229 A1 * 6/2021 Niemela ..... F16B 12/34
2021/0267377 A1 * 9/2021 Vang ..... A47C 4/028
2022/0000266 A1 * 1/2022 Nelson ..... A47C 4/028
2023/0083746 A1 * 3/2023 Brown ..... A47C 17/86 248/248
2023/0270252 A1 * 8/2023 Shih ..... A47C 17/02 297/440.11
2024/0341486 A1 * 10/2024 Aubé ..... A47C 13/005
2025/0057318 A1 * 2/2025 Riviere ..... A47C 4/028

FOREIGN PATENT DOCUMENTS

EP 4523570 A1 * 3/2025 ..... A47C 11/005
GB 1279618 A * 6/1972 ..... A47C 1/124
JP H0593287 U * 12/1993 ..... A47C 1/124
KR 20100108153 A * 10/2010 ..... A47C 1/124
KR 20110058956 A * 6/2011 ..... A47C 11/005
KR 102154696 B1 * 9/2020 ..... A47C 1/124
KR 102662923 B1 * 5/2024 ..... A47C 7/40

* cited by examiner

Figure 26
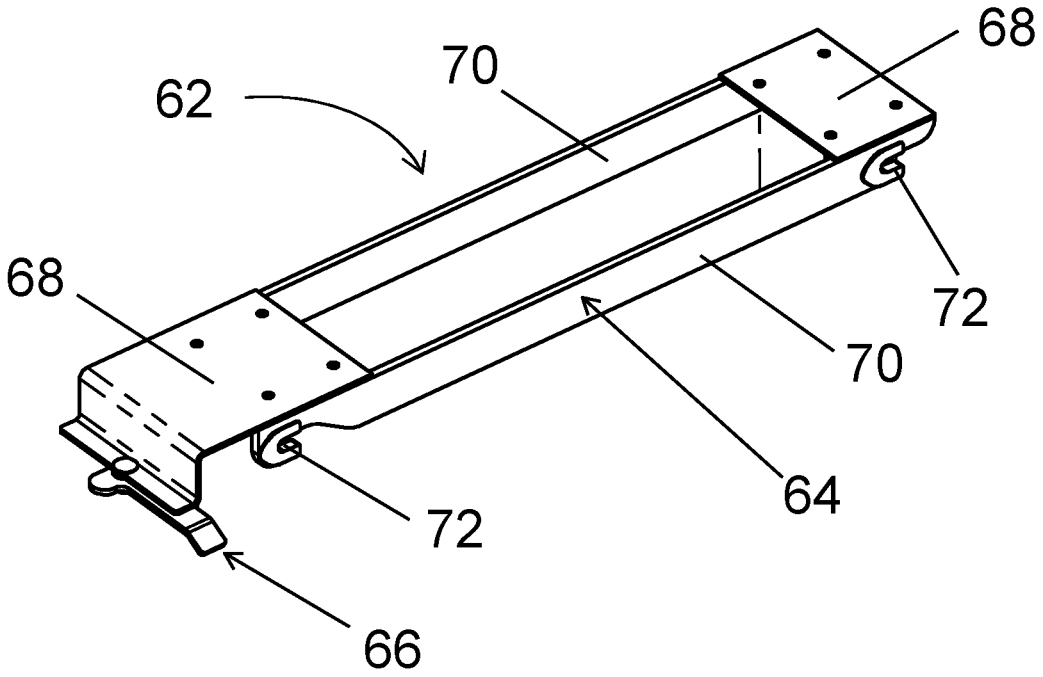
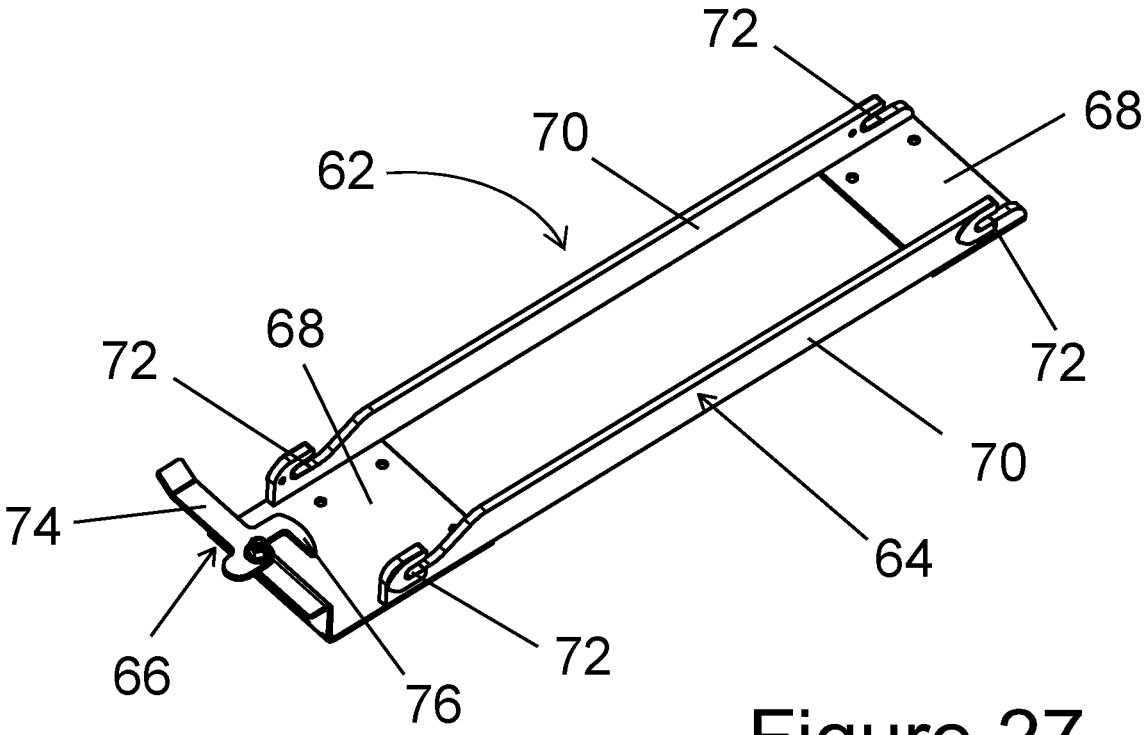
Figure 27

MODULAR UNIT COUPLING SYSTEM AND METHOD

TECHNICAL FIELD

Example embodiments relate to systems and methods for releasably coupling large modular units, such as furniture, together.

BACKGROUND

When purchasing, transporting, assembling and installing large units, such as furniture, including couches and sectionals, each component is typically rigidly fastened together in the factory into a large single unit. The large single unit is then delivered and installed after purchase. In other cases, even if the furniture units are transported in components, there is often the need for professional installers to put the chair and/or armrests together on site to ensure proper assembly. Given the unwieldy nature and difficulty of transportation and installation of large furniture, their specific configuration and placement in a space tends to be fairly permanent, since modifying or moving large furniture is often challenging and/or requires professional assistance.

Additional difficulties of assembling conventional large furniture components may be appreciated in view of the Detailed Description, herein below.

SUMMARY

Example embodiments relate to a bracket system bracket that is securable to modular units for releasably coupling the modular units together and methods thereof.

An example bracket system comprises: a first set of main brackets comprising: a front frame extension bracket securable to base structural members along a front of a first main unit, and a rear frame extension bracket securable to the base structural members along a rear of the first main unit, each of the front and rear frame extension brackets comprising: a beam comprising a post end and an opposed hook end; a rigid post secured proximate to the post end of the beam, the rigid post extending away from the beam; a hook secured to the hook end of the beam, the hook dimensioned to receive the rigid post therein; and a main bracket aperture positioned at each of the post end and the hook end of the beam, each main bracket aperture dimensioned to receive a fastener therethrough; wherein the hooks and the rigid posts of each of the front and rear frame extensions brackets are configured to releasably engage, respectively, with corresponding rigid posts and corresponding hooks secured to adjacent modular units.

In another example embodiment, the beam of each of the front and rear frame extension brackets is an L-shaped beam comprising a vertical leg and a horizontal leg extending between the post end and the hook end of each of the front and rear frame extension brackets.

In another example embodiment, the bracket system is securable only to the base structural members and is configured to releasably couple the modular units together bare handed.

In another example embodiment, the L-shaped beam of each of the front and rear frame extension brackets is dimensioned to extend from one side of the first main unit to an opposed side of the first main unit, the rigid post of each of the front and rear frame extension brackets being positioned at the one side of the first main unit, and the hook of each of the front and rear frame extension brackets being positioned to extend past the opposed side of the first main unit.

In another example embodiment, the rigid post of each of the front and rear frame extension brackets is secured to one of the vertical and horizontal legs proximate the post end of the L-shaped beam; the hook of each of the front and rear frame extension brackets extends from the one of the vertical and first horizontal legs; and the main bracket aperture of each of the front and rear frame extension brackets being positioned on the other one of the vertical and horizontal legs.

In another example embodiment, the rigid post of each of the front and rear frame extension brackets is secured to the respective horizontal leg extending away from the corresponding vertical leg; the hook of each of the front and rear frame extension brackets extends from the respective horizontal leg, the hook of the front frame extension bracket facing away from the corresponding vertical leg, and the hook of the rear frame extension bracket facing the corresponding vertical leg; and the main bracket apertures being positioned on the vertical legs at each of the post ends and the hook ends of each of the L-shaped beams.

In another example embodiment, the modular units are modular furniture units and the first main unit is a first main furniture unit.

In another example embodiment, the first main furniture unit is a theatre seat, and the first set of main brackets is secured to the first main furniture unit.

In another example embodiment, the bracket system further comprises a second set of main brackets securable to base structural members of a second main unit, wherein the hooks of the first set of main brackets releasably engage with the corresponding rigid posts of the second set of main brackets; a brace piece with a brace aperture, the brace piece dimensioned to extend over a portion of both of the vertical legs of the front frame extension brackets or the rear frame extension brackets when the first and second sets of main brackets are coupled together; and a brace fastener configured to extend through the brace aperture and one of the main bracket apertures positioned on the vertical legs of each of the L-shaped beams; wherein the brace piece holds the rear frame extension brackets together when the brace piece is positioned over an outer surface of the vertical legs of the rear frame extension brackets and the brace fastener extends through the brace aperture and the main bracket aperture at the hook end of the rear frame extension bracket of the first set of main brackets; or wherein the brace piece holds the front frame extension brackets together when the brace piece is positioned over an outer surface of the vertical legs of the front frame extension brackets and the brace fastener extends through the brace aperture and the main bracket aperture at the post end of the front frame extension bracket of the second set of main brackets.

In another example embodiment, the brace fastener is a thumbscrew.

In another example embodiment, the modular units are modular furniture units, the first main unit is a first main furniture unit, and the second main unit is a second main furniture unit.

In another example embodiment, the first and second main furniture units are each a theatre seat, the first set of main brackets is secured to the first main furniture unit, and the second set of main brackets is secured to the second main furniture unit.

In another example embodiment, each of the front and rear frame extension brackets further comprises: a pair of rigid pegs positioned on the vertical leg extending away from the corresponding horizontal leg, each rigid peg being positioned proximate to and equidistant from one of the main bracket apertures.

In another example embodiment, each of the rigid posts and the rigid pegs extends to a head that is wider than the respective rigid post or rigid peg.

In another example embodiment, the bracket system further comprises a first base linkage bracket comprising: a base frame dimensioned to correspond with base structural members of a first supplemental unit, the base frame comprising opposed ends and first and second base frame sides extending between the opposed ends; a pair of extensions extending from the opposed ends of the base frame, the pair of extensions extending in parallel to each other from the first base frame side, each extension comprising: a base slot at a distal end of the extension, each base slot dimensioned and orientated to receive therein one of the rigid pegs on the front or rear frame extension bracket; and a base fastener positioned between the base frame and the base slot, the base fastener positioned to align and operatively engage with the respective main bracket aperture on the front or rear frame extension bracket when the base slot engages with one of the rigid pegs; a pair of base latches, each pivotably coupled proximate to one of the opposed ends of the base frame, each base latch configured to pivotably extend from the second base frame side and operatively engage with one of the rigid posts of the front or rear frame extension bracket; a base post extending from the first base frame side positioned proximate one of the opposed ends of the base frame, and another base post extending from the second base frame side positioned proximate the other one of the opposed ends; and a stop secured to one of the opposed ends of the base frame, the stop extending past a horizontal plane of the base frame.

In another example embodiment, the bracket system further comprises another stop secured to the other one of the opposed ends of the base frame, the other stop extending past the horizontal plane of the base frame.

In another example embodiment, each base fastener is a thumbscrew.

In another example embodiment, the first base linkage bracket is releasably securable to either side of the first set of main brackets by: the rigid pegs on the front and rear frame extension brackets proximate the first base linkage bracket being received within the base slots on the pair of extensions of the first base linkage bracket, and the corresponding base fasteners operatively engage with the corresponding main bracket apertures on the front and rear frame extension brackets, or the pair of base latches pivot and operatively engage with the rigid posts of the front and rear frame extension brackets.

In another example embodiment, the bracket system further comprises a first mounting bracket comprising: a mounting frame dimensioned to correspond and cover the base frame of the first base linkage bracket, the mounting frame comprising: mounting plates securable to the base structural members of the first supplemental unit; at least two mounting slots, each positioned and orientated to correspondingly receive therein the base post or the other base post extending from the first and second base frame sides of the first base linkage bracket; a mounting latch pivotably coupled to an end of the mounting frame, the mounting latch positioned to correspond and operatively engage with one of the stops of the first base linkage bracket; wherein engaging the mounting latch around one of the stops of the first base linkage bracket when the base post and the other base post of the first base linkage bracket are positioned within the at least two mounting slots, releasably couples the first base linkage bracket with the first mounting bracket.

In another example embodiment, the mounting plates are positioned at opposed ends of the mounting frame and the mounting frame further comprises mounting frame sides extending between the mounting plates, wherein the at least two mounting slots are secured to the mounting frame sides.

In another example embodiment, the modular units are modular furniture units; the first main unit is a first main furniture unit, the first main furniture unit is a theatre seat, and the first set of main brackets is secured to the first main furniture unit; and the first supplemental unit is a first supplemental furniture unit, the first supplemental furniture unit is an armrest, and the first mounting bracket is secured to the first supplemental furniture unit.

In another example embodiment, the bracket system further comprises a second set of main brackets securable to base structural members of a second main unit, wherein the pair of extensions of the first base linkage bracket releasably engages with corresponding rigid pegs and main bracket apertures on one side of the front and rear frame extension brackets of the first set of main brackets, and wherein the pair of base latches of the first base linkage bracket releasably engages with corresponding rigid posts on one side of the front and rear frame extension brackets of the second set of main brackets.

In another example embodiment, the modular units are modular furniture units; the first main unit is a first main furniture unit, the second main unit is a second main furniture unit, the first and second main furniture units are each a theatre seat, the first set of main brackets being secured to the first main furniture unit, and the second set of main brackets being secured to the second main furniture unit; and the first supplemental unit is a first supplemental furniture unit, the first supplemental furniture unit is an armrest, and the first mounting bracket is secured to the first supplemental furniture unit.

In another example embodiment, the bracket system further comprises a second base linkage bracket; and a second mounting bracket securable to base structural members of a second supplemental unit; wherein the pair of extensions of the first base linkage bracket releasably engages with the rigid pegs and the main bracket apertures on one side of the front and rear frame extension brackets of the first set of main brackets, and wherein the pair of extensions of the second base linkage bracket releasably engages with the rigid pegs and the main bracket apertures on another side of the front and rear frame extension brackets of the first set of main brackets.

In another example embodiment, the modular units are modular furniture units; the first main unit is a first main furniture unit, the first main furniture unit is a theatre seat, and the first set of main brackets is secured to the first main furniture unit; the first supplemental unit is a first supplemental furniture unit, and the second supplemental unit is a second supplemental furniture unit, the first supplemental furniture unit and the second supplemental furniture unit are each an armrest, the first mounting bracket is secured to the first supplemental furniture unit, and the second mounting bracket is secured to the second supplemental furniture unit.

Another example embodiment is a method for releasably coupling modular units together using a bracket system, such as that described above, where the bracket system comprises a first set of main brackets and one or more adjacent brackets. In one example embodiment, the method comprises: securing the first set of main brackets, comprising a front frame extension bracket and a rear frame extension bracket, to a first main unit by: securing the front frame extension bracket to base structural members along a front of the first main unit, and securing the rear frame extension bracket to base structural members along a rear of the first main unit; and releasably coupling the first main unit to an adjacent modular unit, by releasably engaging the first set of main brackets to the one or more adjacent brackets secured the adjacent modular unit In another example embodiment, the one or more adjacent brackets comprises a second set of main brackets and the adjacent modular unit is a second main unit, the method further comprising: securing the second set of main brackets to the second main unit by: securing a front frame extension bracket of the second set of main brackets to base structural members along a front of the second main unit, and securing a rear frame extension bracket of the second set of main brackets to base structural members along a rear of the second main unit; wherein releasably coupling the first main unit to the second main unit comprises releasably engaging the first set of main brackets to the second set of main brackets.

In another example embodiment, the method further comprises separating the first main unit from the second main unit by disengaging first set of main brackets from the second set of main brackets.

In another example embodiment, the one or more adjacent brackets comprises a base linkage bracket and a mounting bracket and the adjacent modular unit is a supplementary unit. The method further comprises securing the mounting bracket to base structural members of the supplemental unit; wherein releasably coupling the first main unit to the supplementary unit comprises: releasably engaging the base linkage bracket to the first set of main brackets; and releasably engaging the mounting bracket to the base linkage bracket.

In another example embodiment, the method further comprises separating the first main unit from the supplemental unit by disengaging the mounting bracket from the base linkage bracket, and disengaging the base linkage bracket from the first set of main brackets.

In another example embodiment, the first main unit is a theatre seat, and the supplemental unit is an armrest.

BRIEF DESCRIPTION OF THE DRAWINGS

Reference will now be made, by way of example, to the accompanying drawings which show example embodiments, and in which:

FIG. 26 is a top perspective view of a mounting bracket in isolation according to an example embodiment;

FIG. 27 is a bottom perspective view of the mounting bracket of FIG. 26;

Similar reference numerals may have been used in different figures to denote similar components.

DETAILED DESCRIPTION

As noted above, large items tend to be unwieldy and difficult to assemble, so their specific configuration and placement in a space tends to be fairly permanent following installation.

The present bracket system, in use with large item (such as large modular furniture components), creates a simpler system and process for installing and attaching modular furniture units together in a manner that can be easily performed by lay users without the need for tools or professional assistance. The following describe example embodiments relating to such a bracket system.

Figure 1:
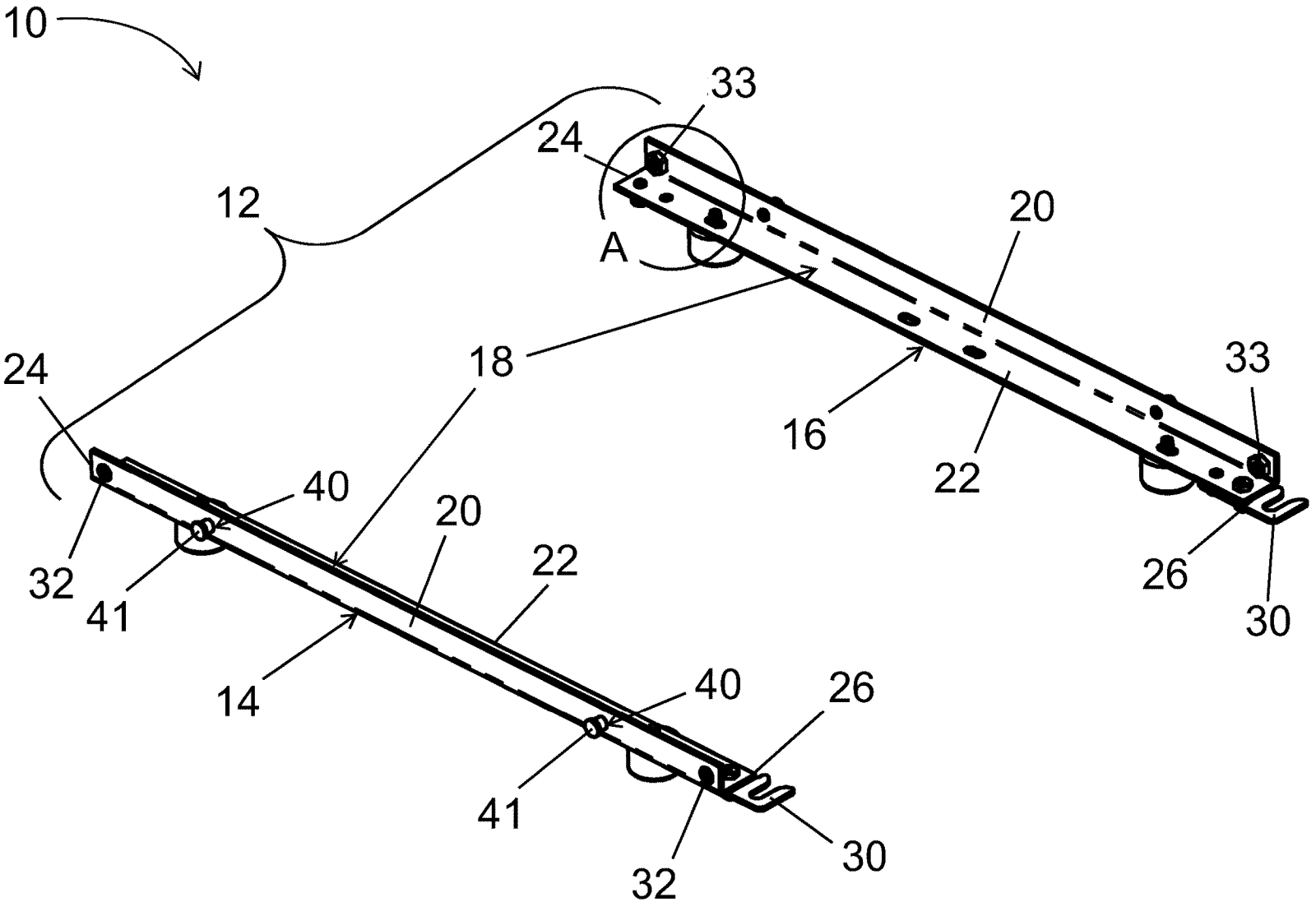
FIG. 1 is a top perspective view of a set of main brackets in isolation according to an example embodiment.
Figure 1A:
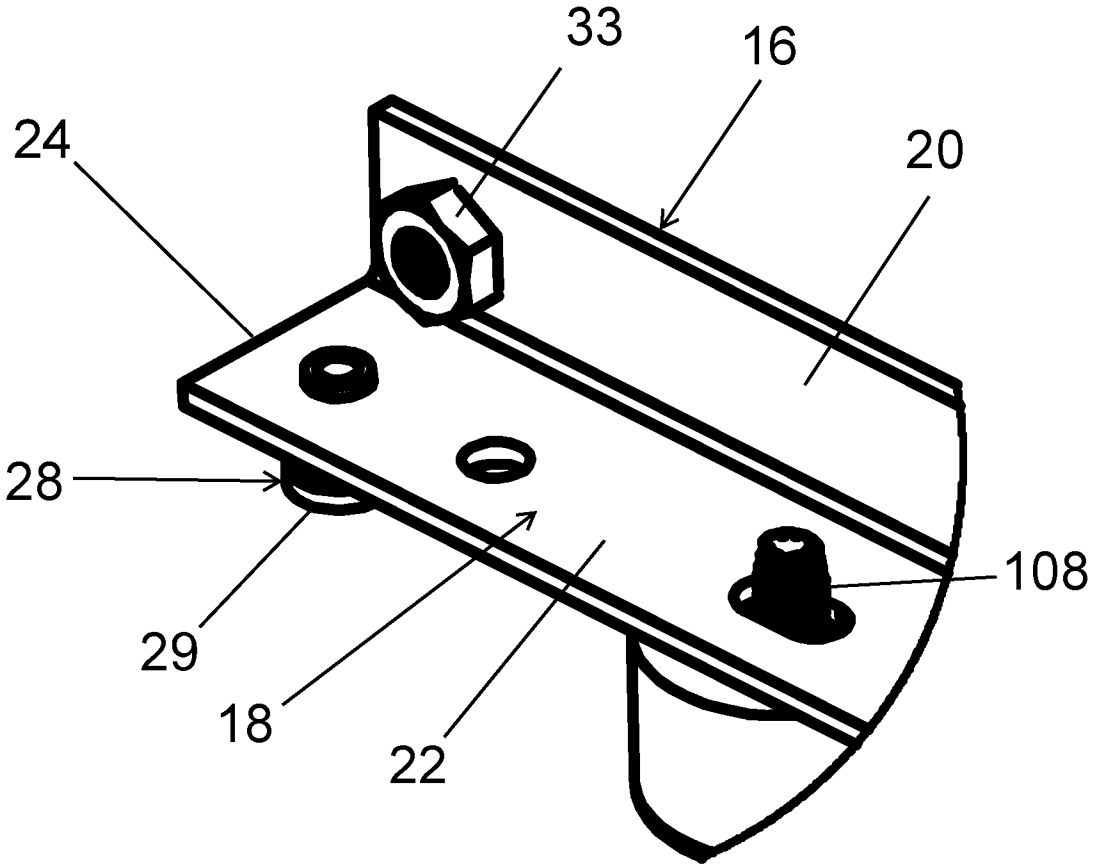
FIG. 1A is an enlarged view of section A of FIG. 1.
Figure 2:
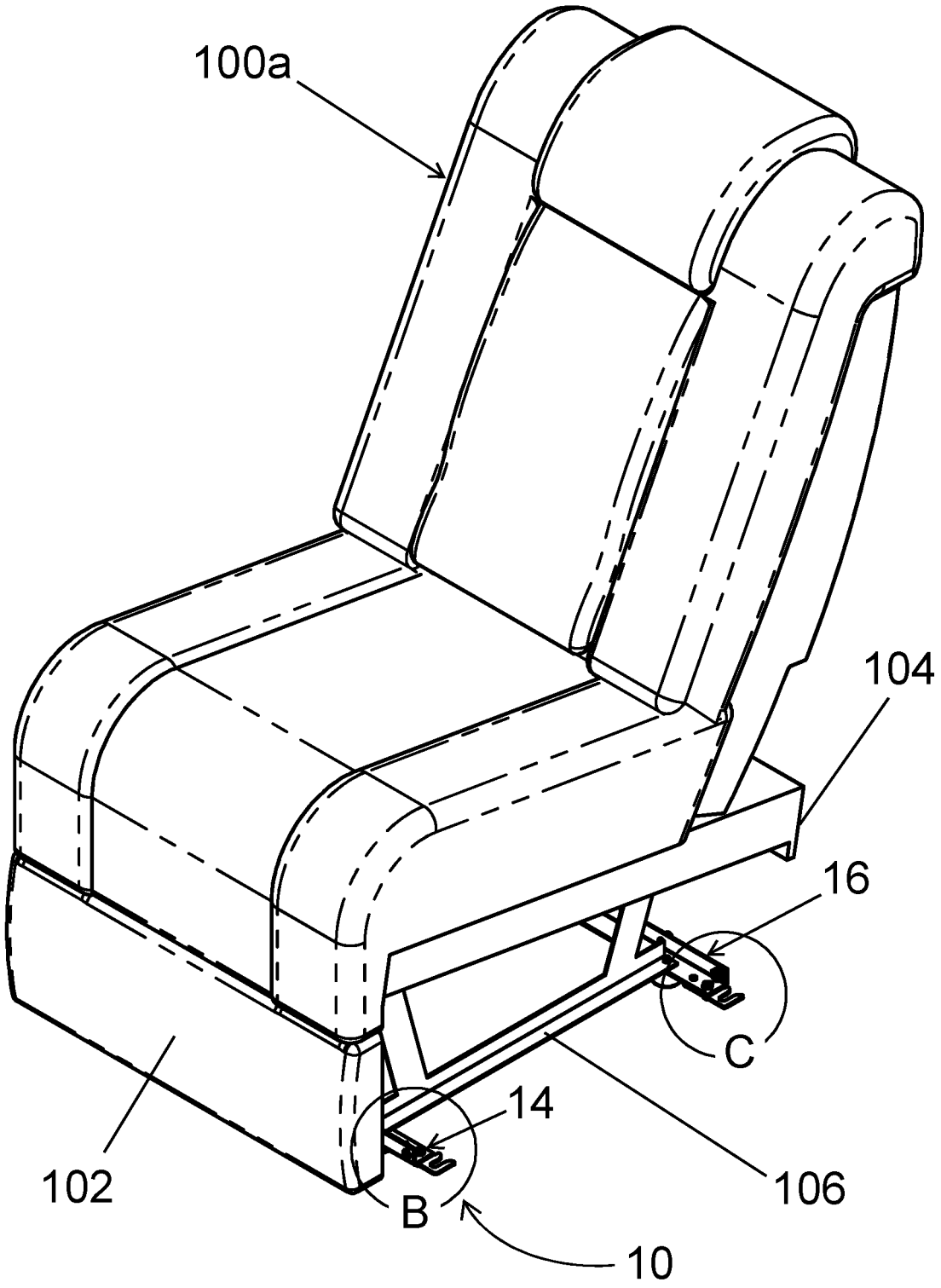
FIG. 2 is a left perspective view of the set of main brackets of FIG. 1 secured to a main furniture unit.
Figure 2B:
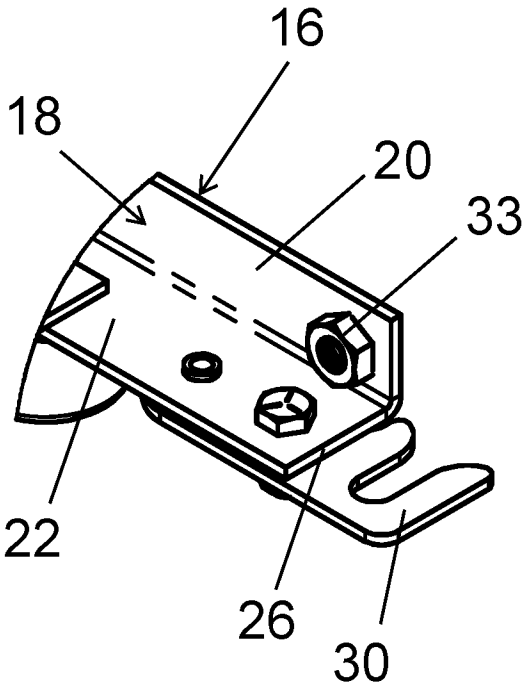
FIG. 2B is an enlarged view of section C of FIG. 2.
Figure 2A:
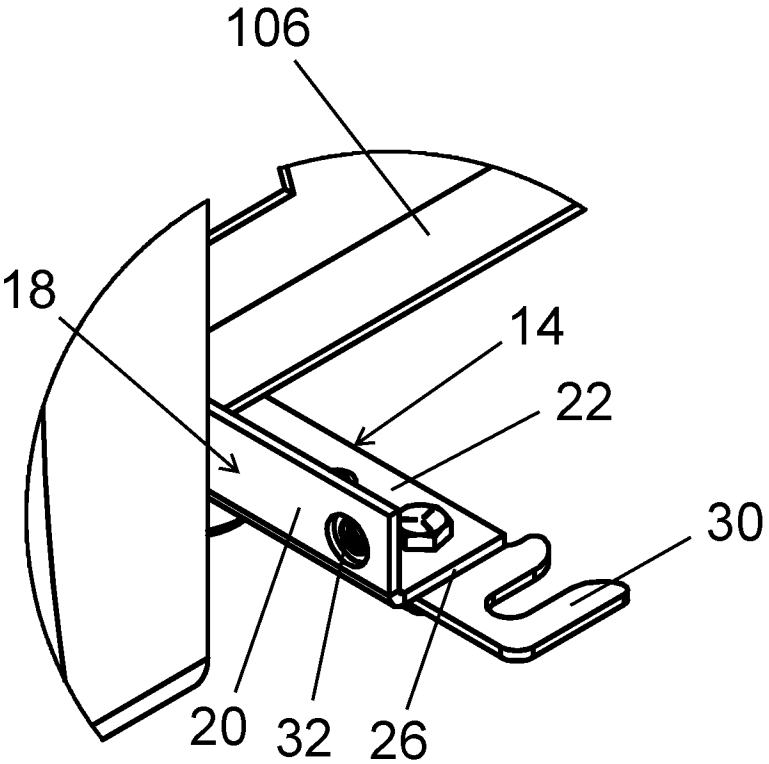
FIG. 2A is an enlarged view of section B of FIG. 2.
Figure 3:
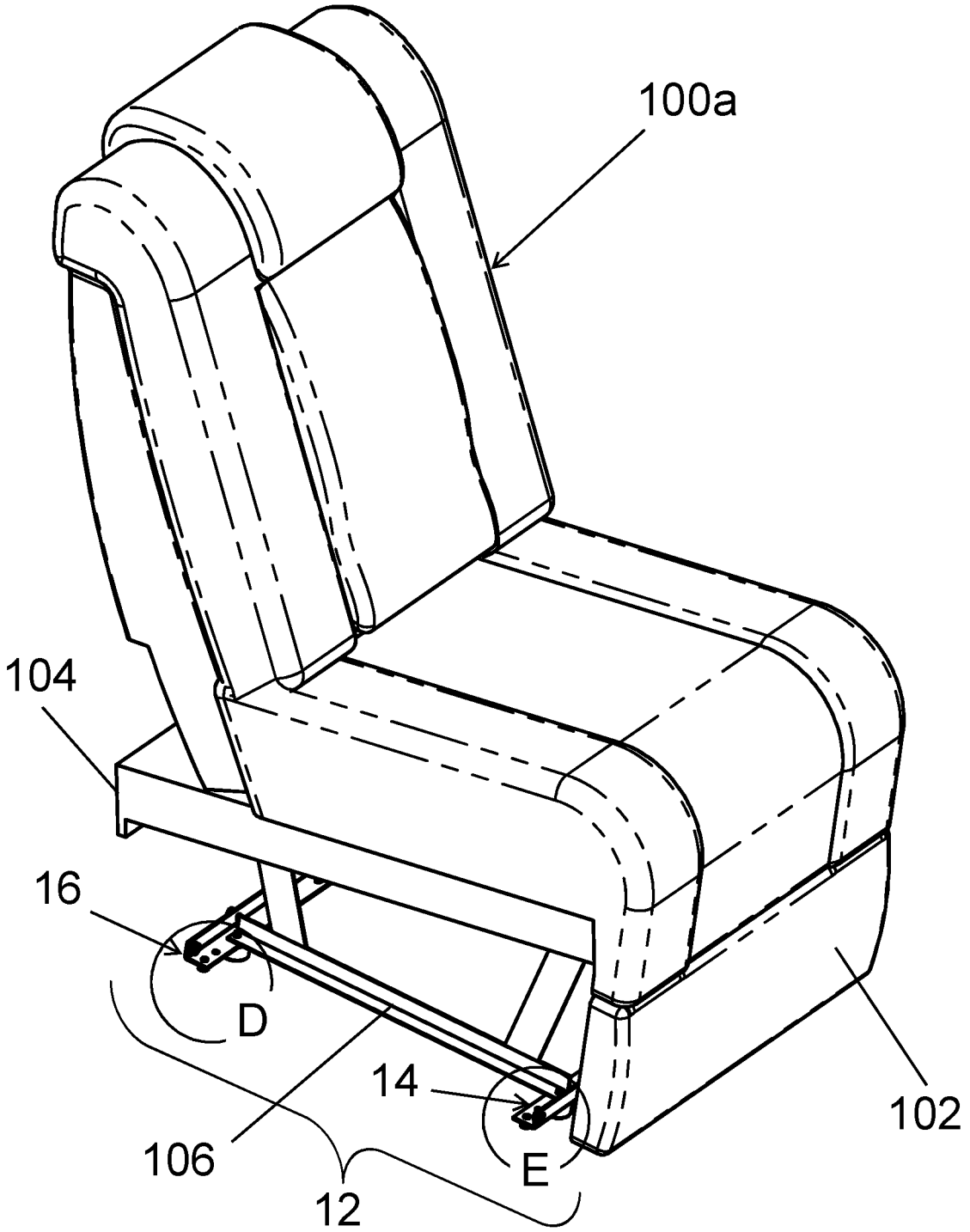
FIG. 3 is a right perspective view of the set of main brackets and the main furniture unit of FIG. 2.
Figure 3B:
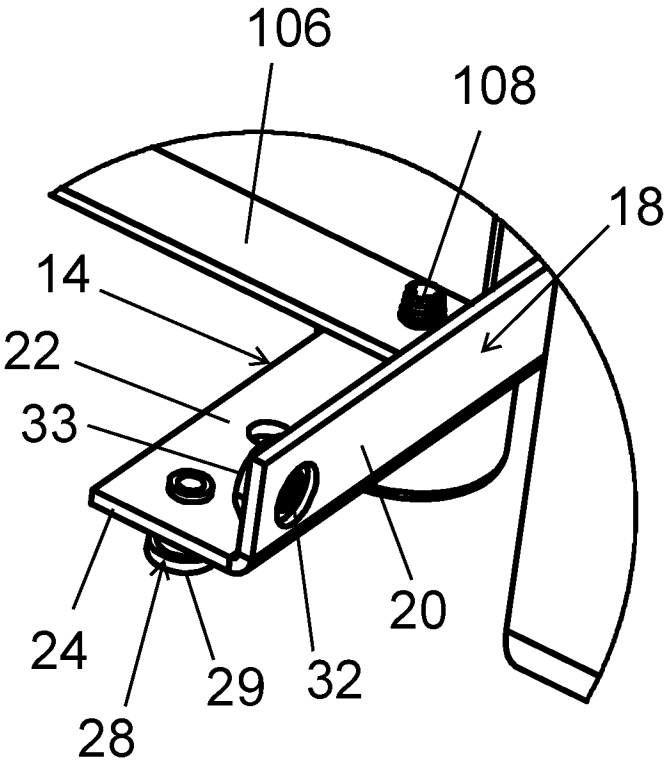
FIG. 3B is an enlarged view of section E of FIG. 3.
Figure 3A:
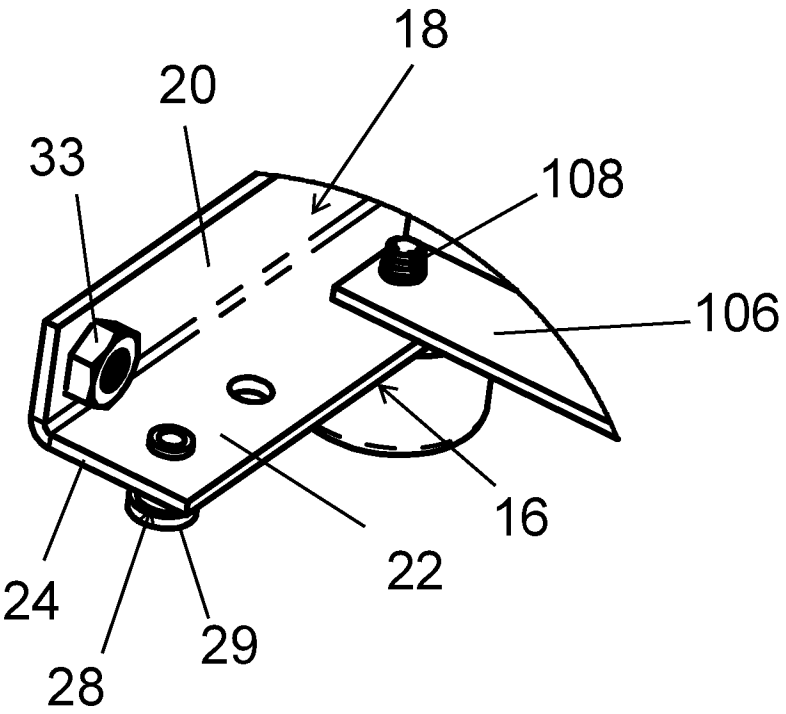
FIG. 3A is an enlarged view of section D of FIG. 3.
Figure 4:
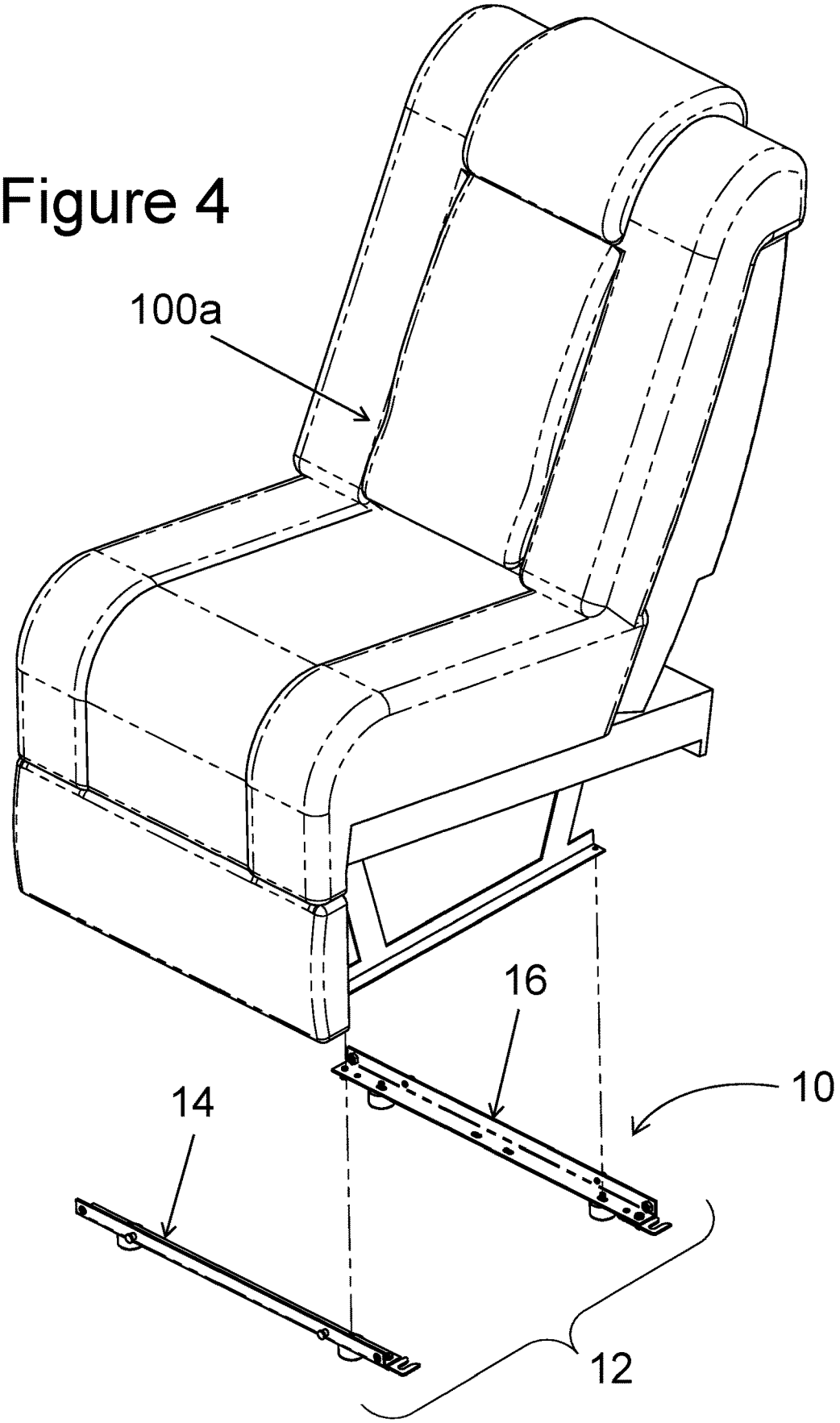
FIG. 4 is an exploded view of FIG. 2.
Figure 5:
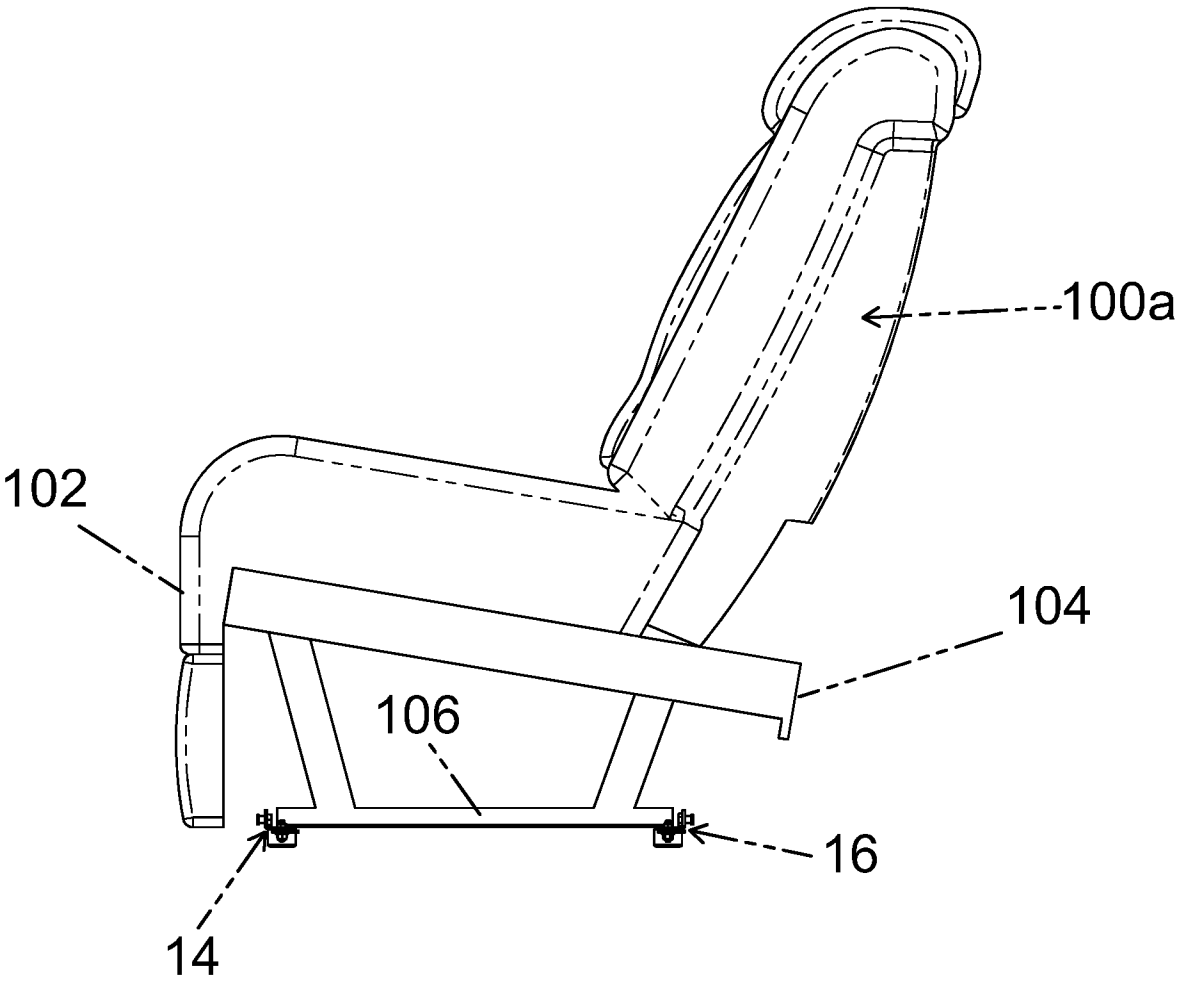
FIG. 5 is a left side view of FIG. 2.
Figure 6:
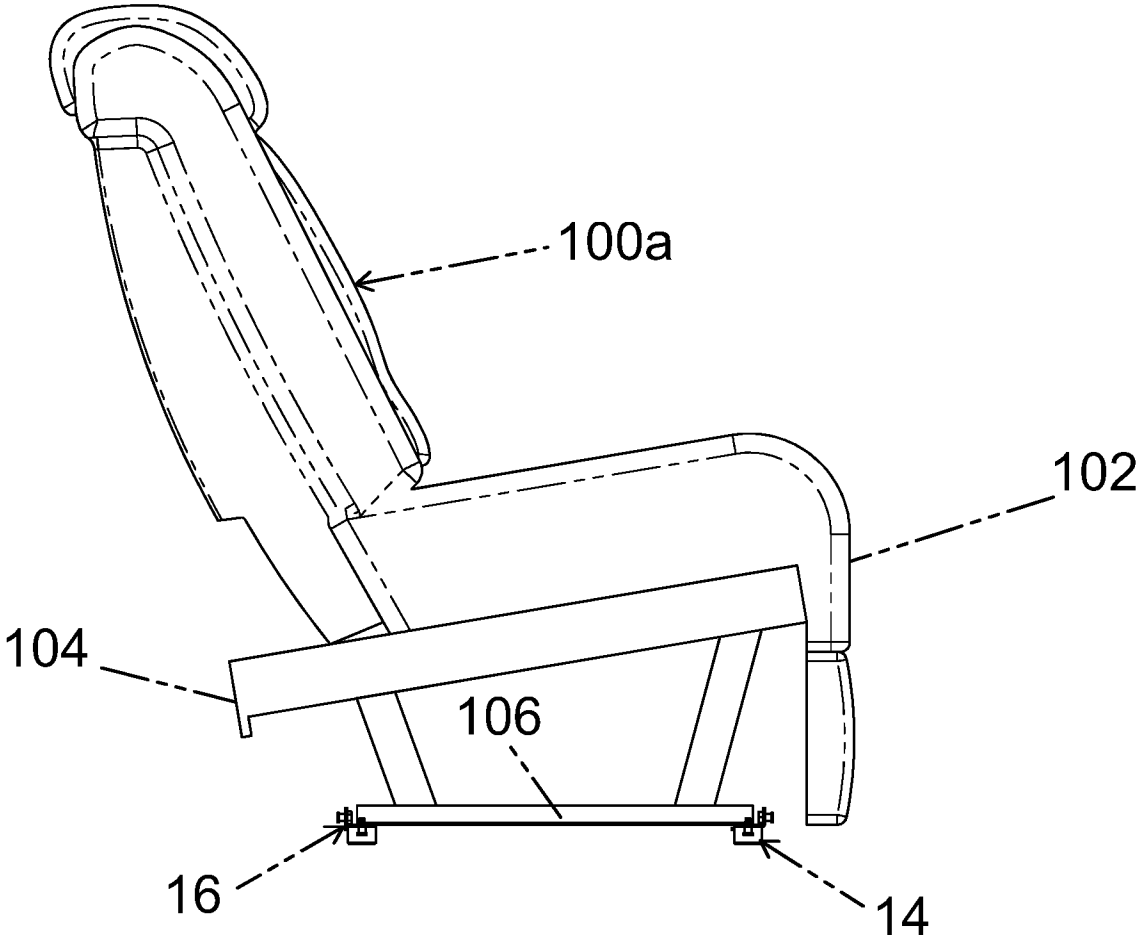
FIG. 6 is a right side view of FIG. 2.
Figure 7:
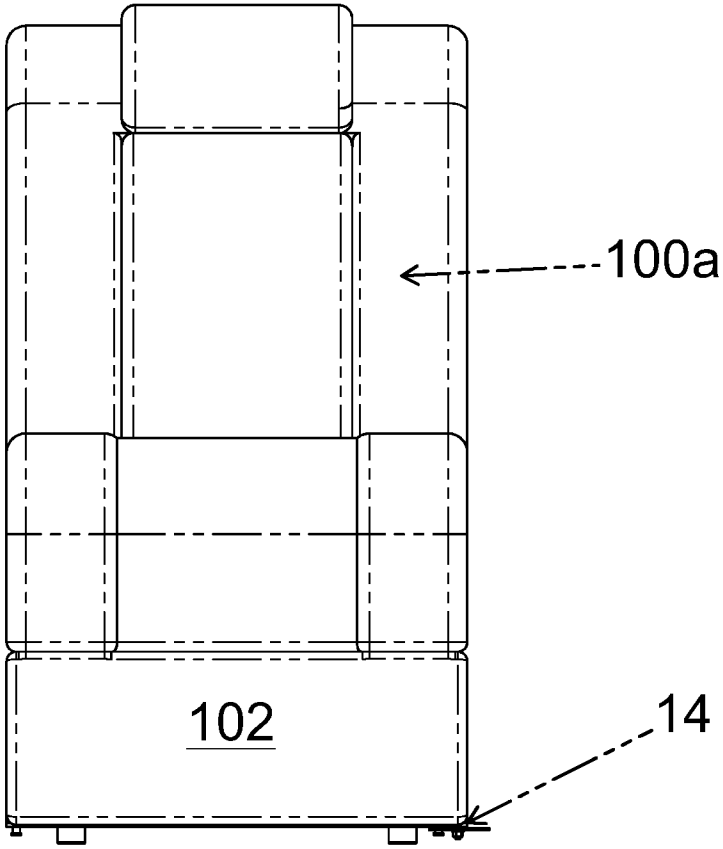
FIG. 7 is a front view of FIG. 2.
Figure 8:
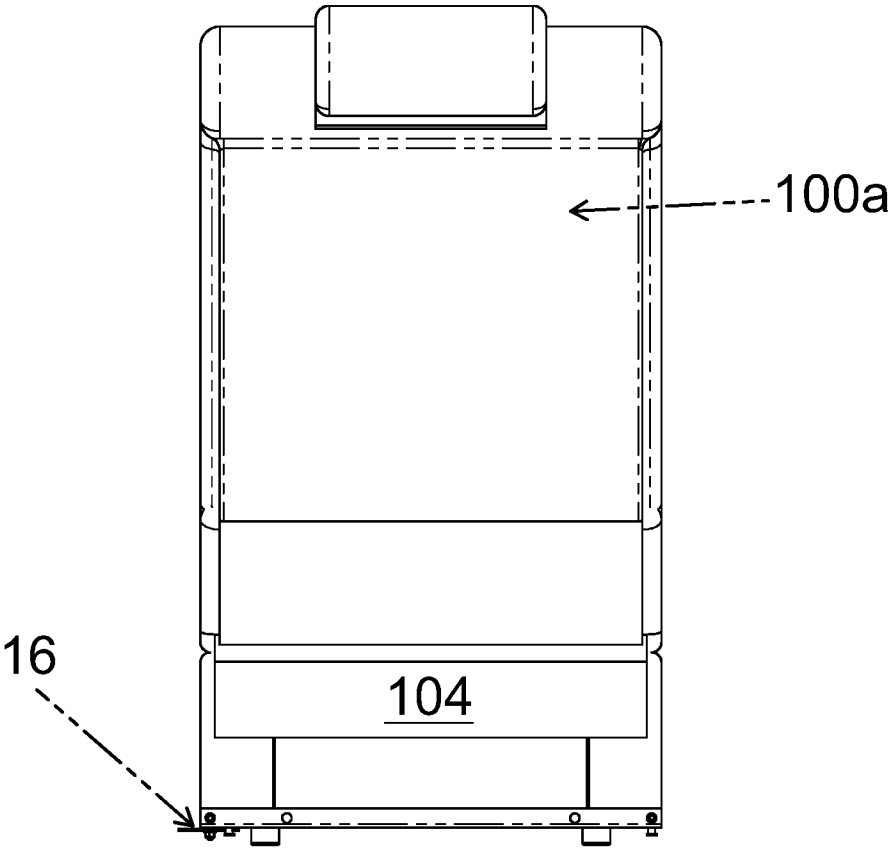
FIG. 8 is a rear view of FIG. 2.
Figure 9:
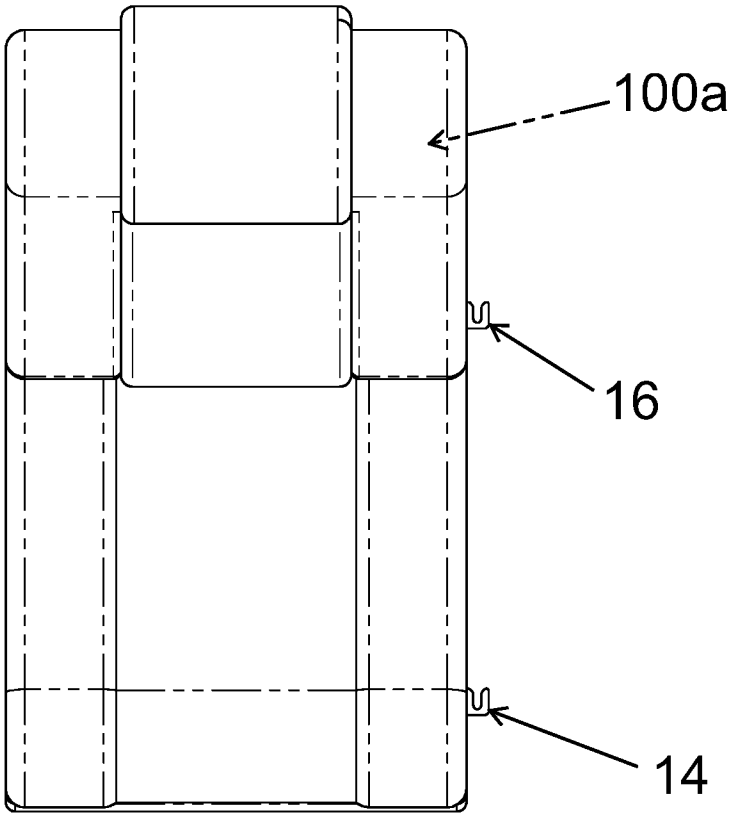
FIG. 9 is a top view of FIG. 2.
Figure 10:
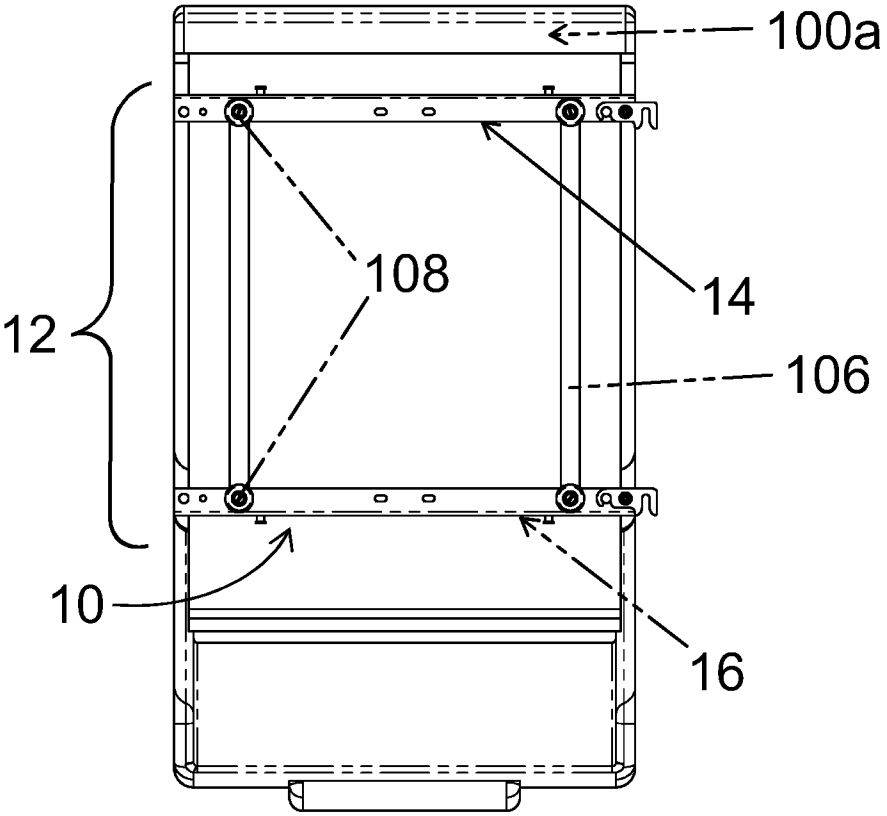
FIG. 10 is a bottom view of FIG. 2.

Referring first to FIGS. 1 and 1A, there is shown a bracket system 10 that is securable to modular units for releasably coupling the modular units together according to an example embodiment. In the depicted embodiment, the bracket system 10 includes a set of main brackets 12. The set of main brackets 12 includes a front frame extension bracket 14 and a rear frame extension bracket 16. The front frame extension bracket 14 is securable to base structural members along a front of a first main unit, and the rear frame extension bracket 16 is securable to the base structural members along a rear of the first main unit.

To that end, each of the front and rear frame extension brackets 14, 16 comprises a beam with a post end 24 at one end and a hook end 26 at an opposed end. In some applications, each beam may be an L-shaped beam 18 with a vertical leg 20 and a horizontal leg 22 extending between the post end 24 and the hook end 26 of each of the front and rear frame extension brackets 14, 16. In the depicted embodiment of FIGS. 1 and 1A, the vertical leg 20 and the horizontal leg 22 are shown to meet at approximately 90 degrees or perpendicular to one another. In other applications, the vertical leg 20 and the horizontal leg 22 may meet at angles greater or less than perpendicular to one another.

Each of the front and rear frame extension brackets 14, 16 comprises a rigid post 28 that is positioned proximate to the post end 24 of the respective beam. The rigid post 28 is orientated to extend away from the beam. Each of the front and rear frame extension brackets 14, 16 also comprises a hook 30 secured to, and/or that extends from, the opposed hook end 26 of the beam. The hook 30 is orientated and dimensioned to receive a rigid post 28 of another extension bracket therein. In that manner, the hooks 30 and the rigid posts 28 of each of the front and rear frame extensions brackets 14, 16 are configured to releasably engage, respectively, with corresponding rigid posts and corresponding hooks secured to adjacent modular units (as will be discussed further below).

Each of the front and rear frame extension brackets 14, 16 further comprises a main bracket aperture 32 positioned at each of the post end 24 and the hook end 26 of the beam, i.e. one main bracket aperture 32 being positioned at the post end 24 and another main bracket aperture 32 being positioned at the hook end 26. Each main bracket aperture 32 is dimensioned to receive a fastener therethrough.

In some applications, a washer, a nut, or an anchor may be secured around each main bracket aperture 32, where each washer, nut, or anchor is also dimensioned to receive the fastener therethrough. The washer, nut, or anchor may be separate or secured directly to each of the beams to help hold the fastener in place when received therethrough. In the embodiment illustrated in FIGS. 1 and 1A, each of the washers, nuts, or anchors is a weld nut 33 that is welded to each of the beams.

In applications when the beams are the L-shaped beams 18, the rigid post 28 of each of the front and rear frame extension brackets 14, 16 may be secured to one or both of the vertical and horizontal legs 20, 22 proximate the post end 24 of the respective L-shaped beam 18. For example, the rigid post 28 of each of the front and rear frame extension brackets 14, 16 may be secured to the vertical leg 20 proximate the post end 24 of the respective L-shaped beam 18, or may be secured to the horizontal leg 22 proximate the post end 24 of the respective L-shaped beam 18. In some applications, each of the rigid posts 28 may extend to a head 29 that is wider than the respective rigid post 28.

In some applications, the hook 30 of each of the front and rear frame extension brackets 14, 16 may be secured to one or both of the vertical and horizontal legs 20, 22 proximate the hook end 26 of the respective L-shaped beam 18. For example, the hook 30 of each of the front and rear frame extension brackets 14, 16 may be secured to the vertical leg 20 proximate the hook end 26 of the respective L-shaped beam 18, or may be secured to the horizontal leg 22 proximate the hook end 26 of the respective L-shaped beam 18.

In certain embodiments, the rigid post 28 and the hook 30 for each of the front and rear frame extension brackets 14, 16 may be secured to the same leg. For example, if the rigid post 28 of each of the front and rear frame extension brackets 14, 16 is secured to the vertical leg 20, the hook 30 of each of the front and rear frame extension brackets 14, 16 may also be secured to the same vertical leg 20. In another example, if the rigid post 28 of each of the front and rear frame extension brackets 14, 16 is secured to the horizontal leg 22, the hook 30 of each of the front and rear frame extension brackets 14, 16 may also be secured to the same horizontal leg 22.

In such applications, the main bracket apertures 32 of each of the front and rear frame extension brackets 14, 16 may be positioned on the other one of the vertical and horizontal legs 20, 22. For example, if the rigid post 28 and hook 30 of each of the front and rear frame extension brackets 14, 16 are secured to the vertical leg 20, the main bracket apertures 32 (and the weld nuts 33) may be positioned on the corresponding horizontal leg 22. In another example, if the rigid post 28 and hook 30 of each of the front and rear frame extension brackets 14, 16 are secured to the horizontal leg 22, the main bracket apertures 32 (and the weld nuts 33) may be positioned on the corresponding vertical leg 20.

In the embodiment depicted in FIGS. 1 and 1A, the rigid post 28 of each of the front and rear frame extension brackets 14, 16 is secured to the respective horizontal leg 22 and extends away from, and generally parallel to, the corresponding vertical leg 20. The hook 30 of each of the front and rear frame extension brackets 14, 16 also extends from/is secured to the respective horizontal leg 22 and extends outward generally parallel to the horizontal leg 22. In particular, the hook 30 of the front frame extension bracket 14 in the embodiment depicted in FIGS. 1 and 1A is shown facing away from the corresponding vertical leg 20 (of the front frame extension bracket 14), and the hook 30 of the rear frame extension bracket 16 is shown facing the corresponding vertical leg 20 (of the rear frame extension bracket 16). The main bracket apertures 32 (and the weld nuts 33) are correspondingly positioned on the vertical legs 20 at each of the post ends 24 and the hook ends 26 of each of the L-shaped beams 18.

As noted above, the bracket system 10 is securable to modular units. The modular units may be any large items with rigid frames that are difficult for the layman to transport, assemble, move, and/or modify etc. without assistance. For example, the modular units may be large appliances or furniture items. In example embodiments, the modular units may be modular appliance units or modular furniture units. In cases of modular furniture units, the first main unit may be a first main furniture unit, such as a shelf, sofa, or table etc. In some applications, the first main furniture unit may be a slipper chair, an ottoman, a couch sectional, or a theatre seat.

In the embodiment shown in FIGS. 2 to 10, the bracket system 10 is secured to a first main furniture unit 100*a* via seat fasteners 108, where the first main furniture unit 100*a* is a theatre seat. The first main furniture unit 100*a* has a front 102, a rear 104, and base structural members 106. As shown, the front frame extension bracket 14 is secured to the base structural members 106 with seat fasteners 108 along the front 102 of the first main furniture unit 100*a*. The rear frame extension bracket 16 is also secured to the base structural members 106 with seat fasteners 108 along the rear 104 of the first main furniture unit 100*a*. In this manner, the bracket system 10 is shown in a "single seat" configuration with the first main furniture unit 100*a*.

As best seen in FIGS. 2 to 4 and 10, the L-shaped beam 18 of each of the front and rear frame extension brackets 14, 16 may be dimensioned to extend from one side of the first main unit to an opposed side of the first main unit, i.e. the first main furniture unit 100*a* in the depicted embodiment. Thus, the rigid post 28 of each of the front and rear frame extension brackets 14, 16 may be positioned at one side of the first main furniture unit 100*a*, while the hook 30 of each of the front and rear frame extension brackets 14, 16 may be positioned to extend past the opposite side of the first main furniture unit 100*a*. In this manner, the bracket system 10 is securable only to the base structural members 106 of the first main furniture unit 100*a*, but is also configured to releasably couple modular units together bare handed, i.e. without additional tools or professional assistance.

Figure 11:
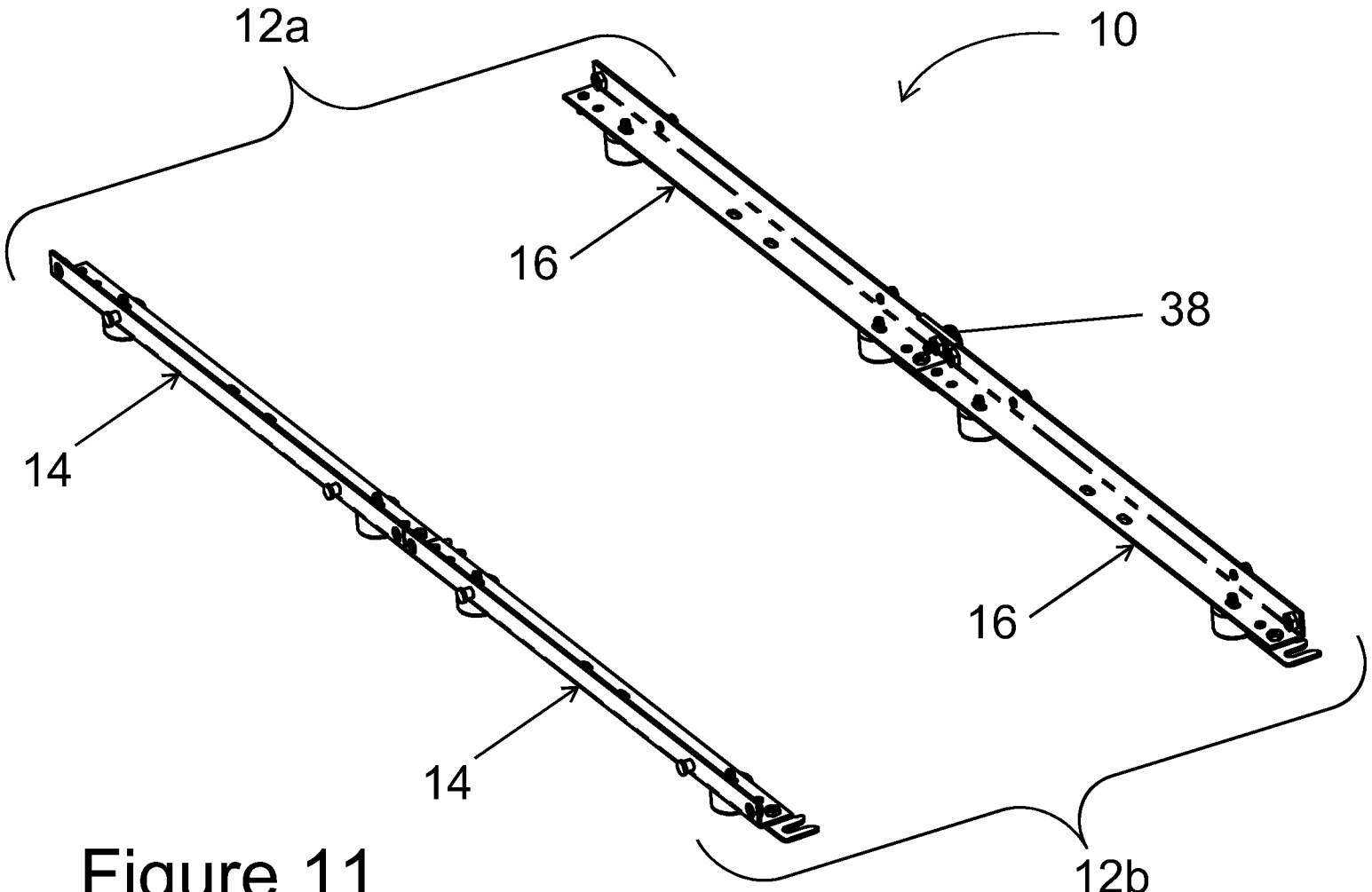
FIG. 11 is a top perspective view of two sets of main brackets of FIG. 1 coupled together in isolation according to an example embodiment.
Figure 12:
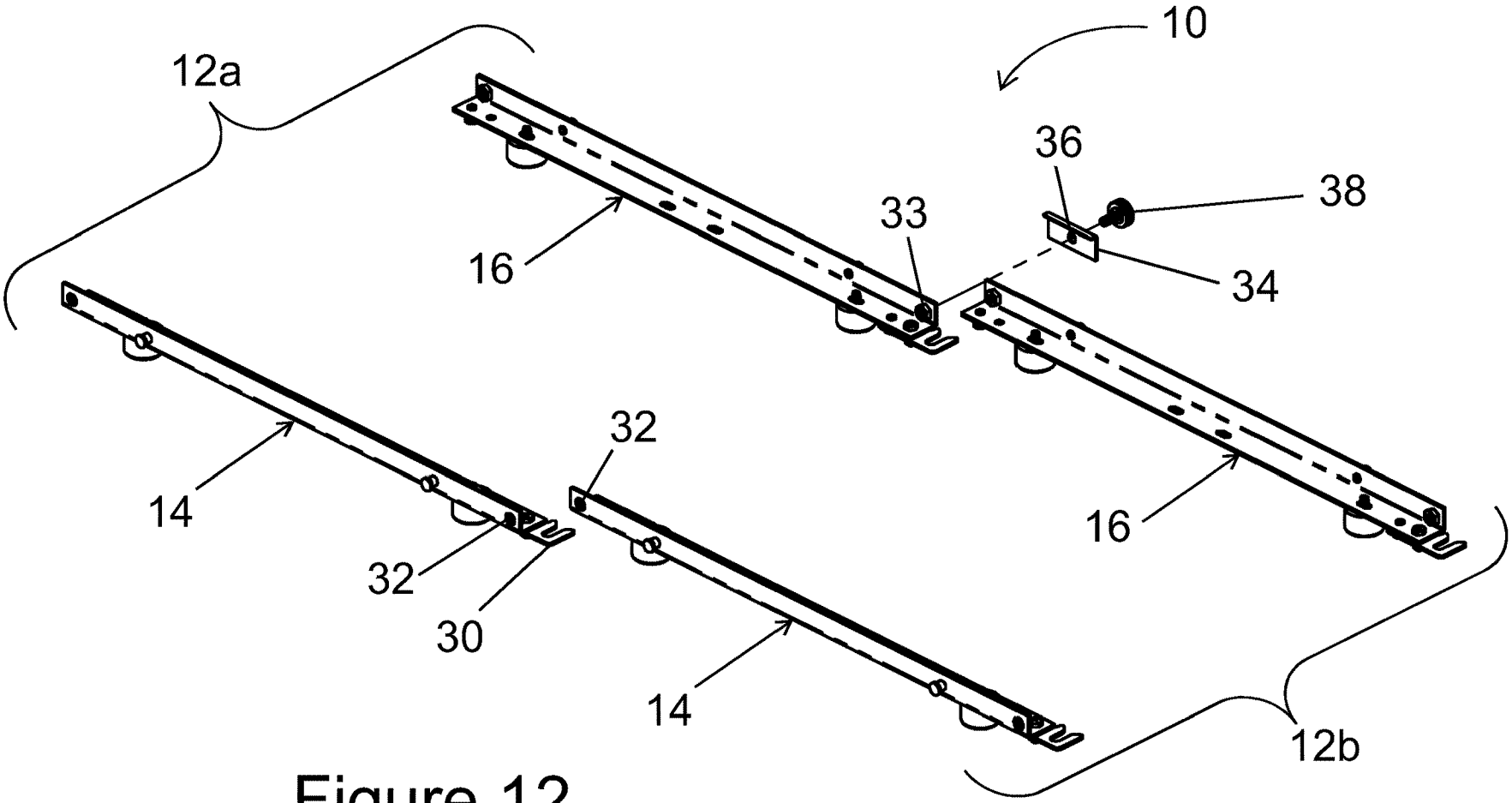
FIG. 12 is an exploded view of FIG. 11.
Figure 13:
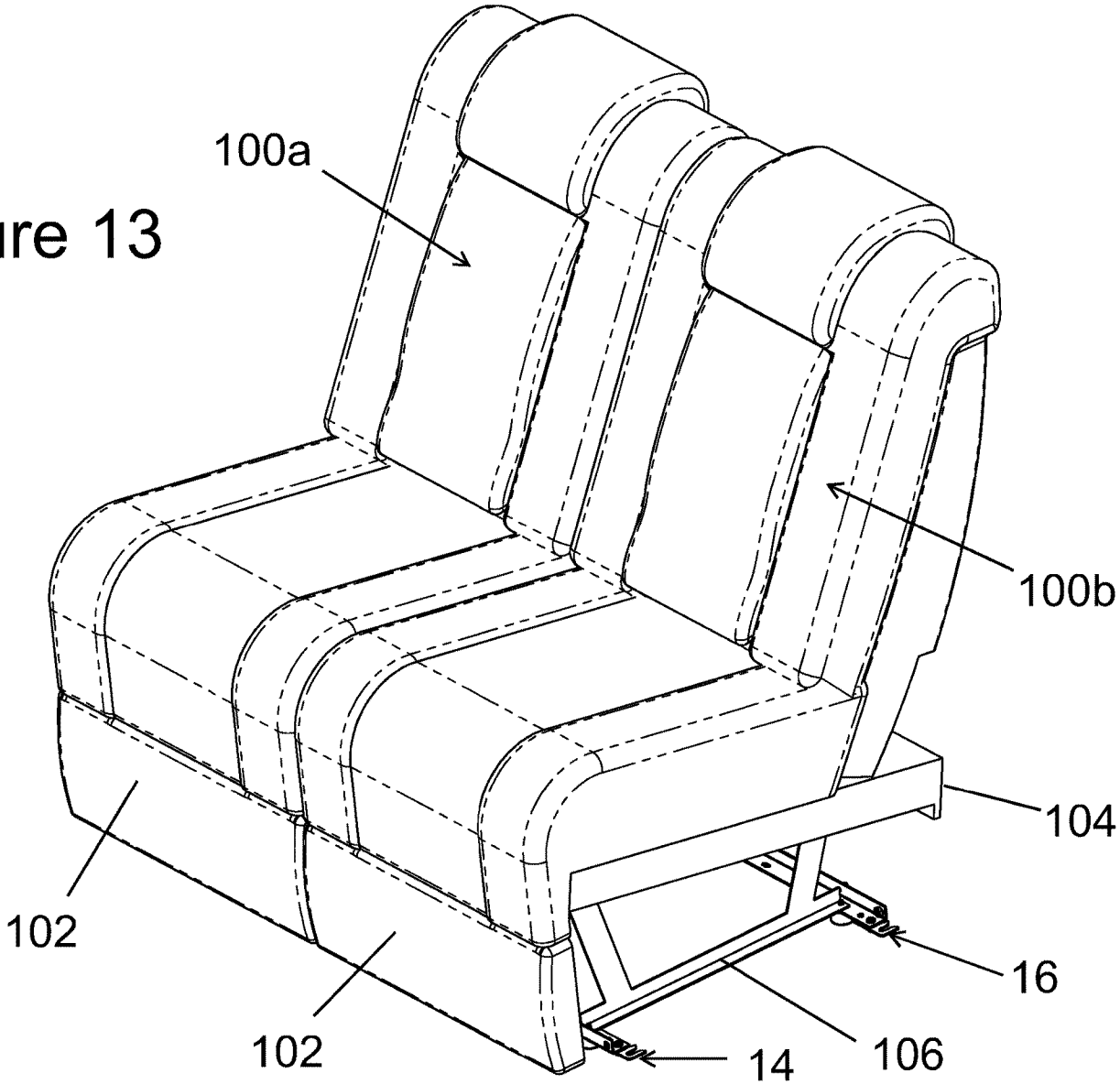
FIG. 13 is a left perspective view of the two sets of main brackets of FIG. 11 secured to two main furniture units.
Figure 14:
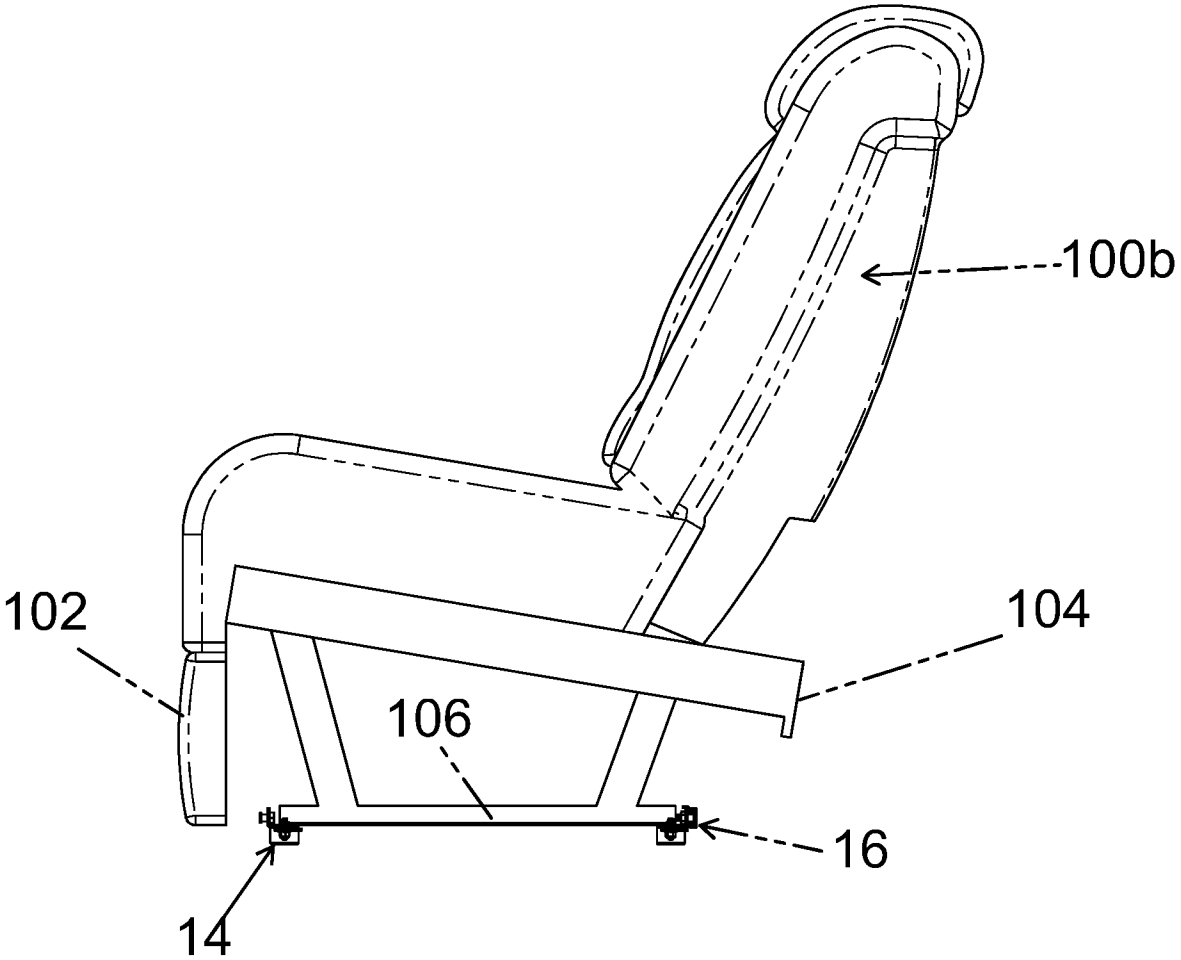
FIG. 14 is a left side view of FIG. 13.
Figure 15:
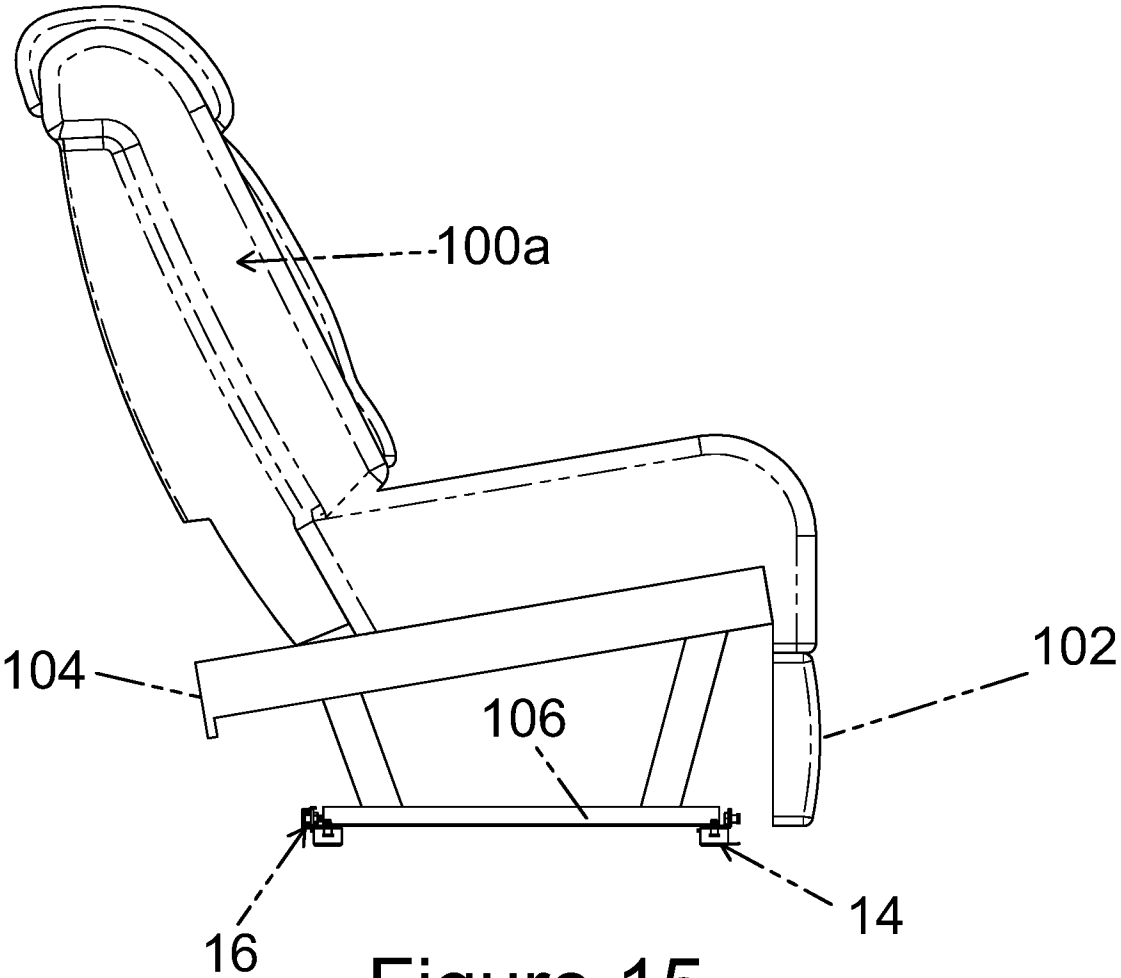
FIG. 15 is a right side view of FIG. 13.
Figure 16:
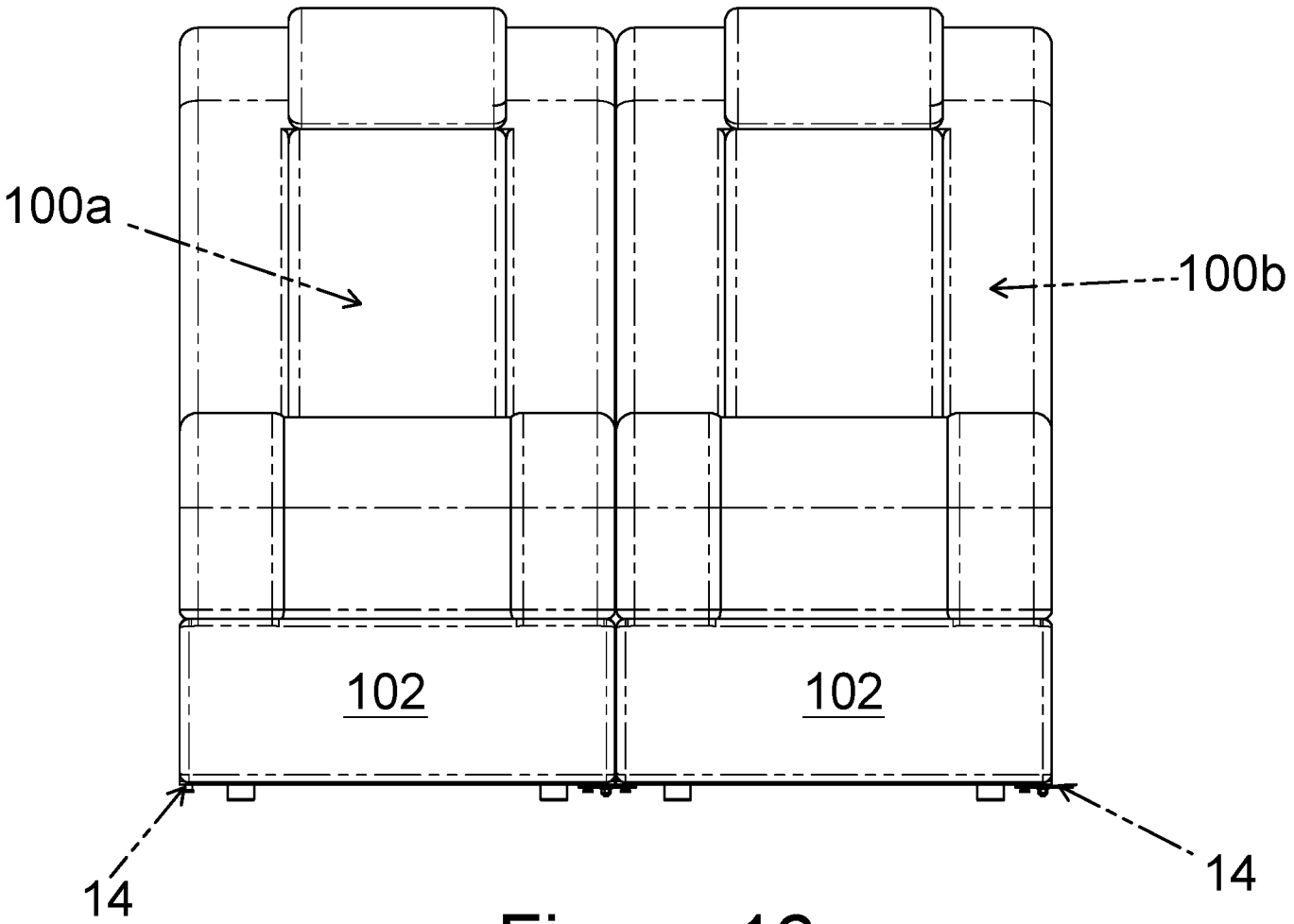
FIG. 16 is a front view of FIG. 13.
Figure 17:
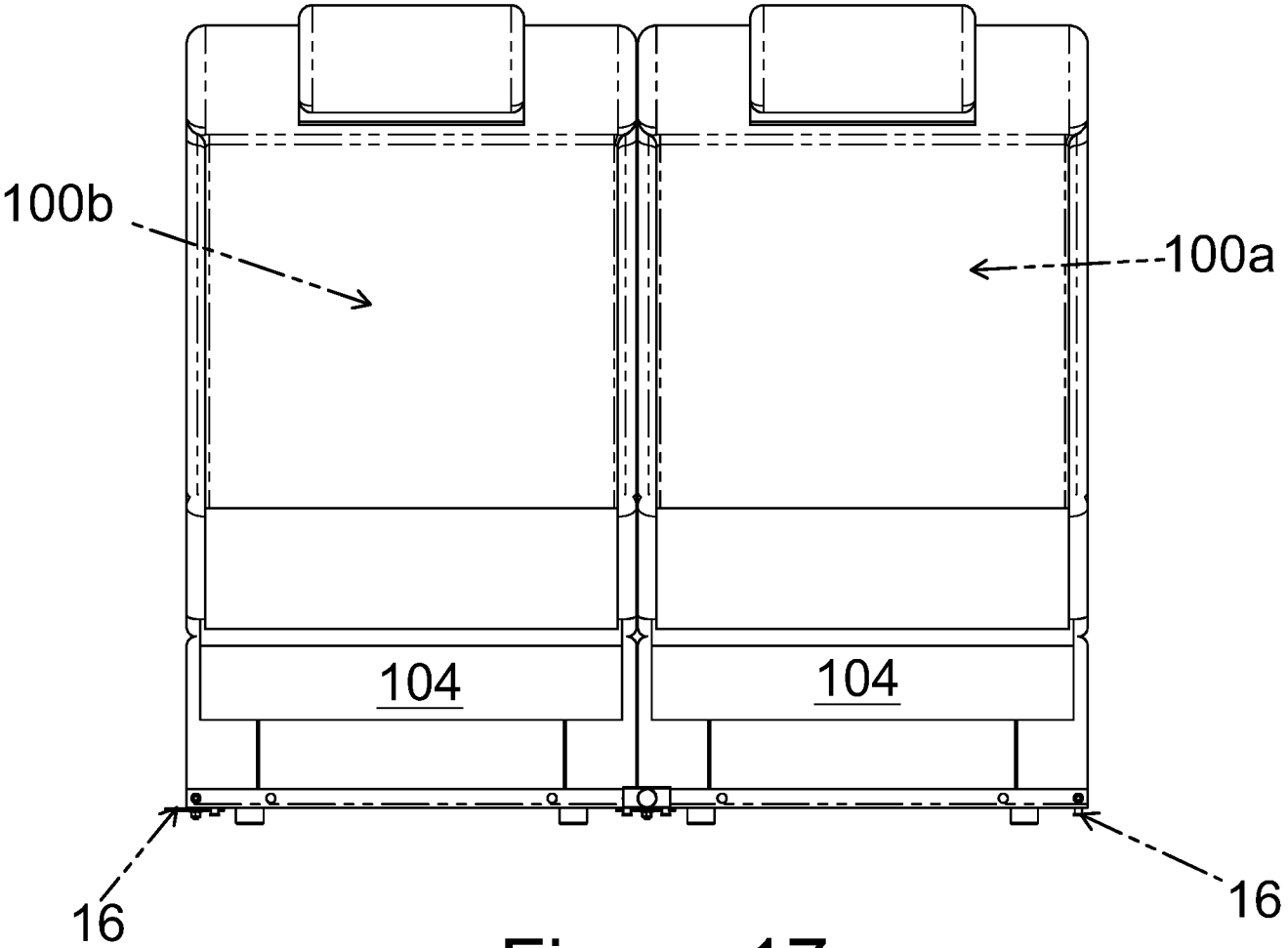
FIG. 17 is a rear view of FIG. 13.
Figure 18:
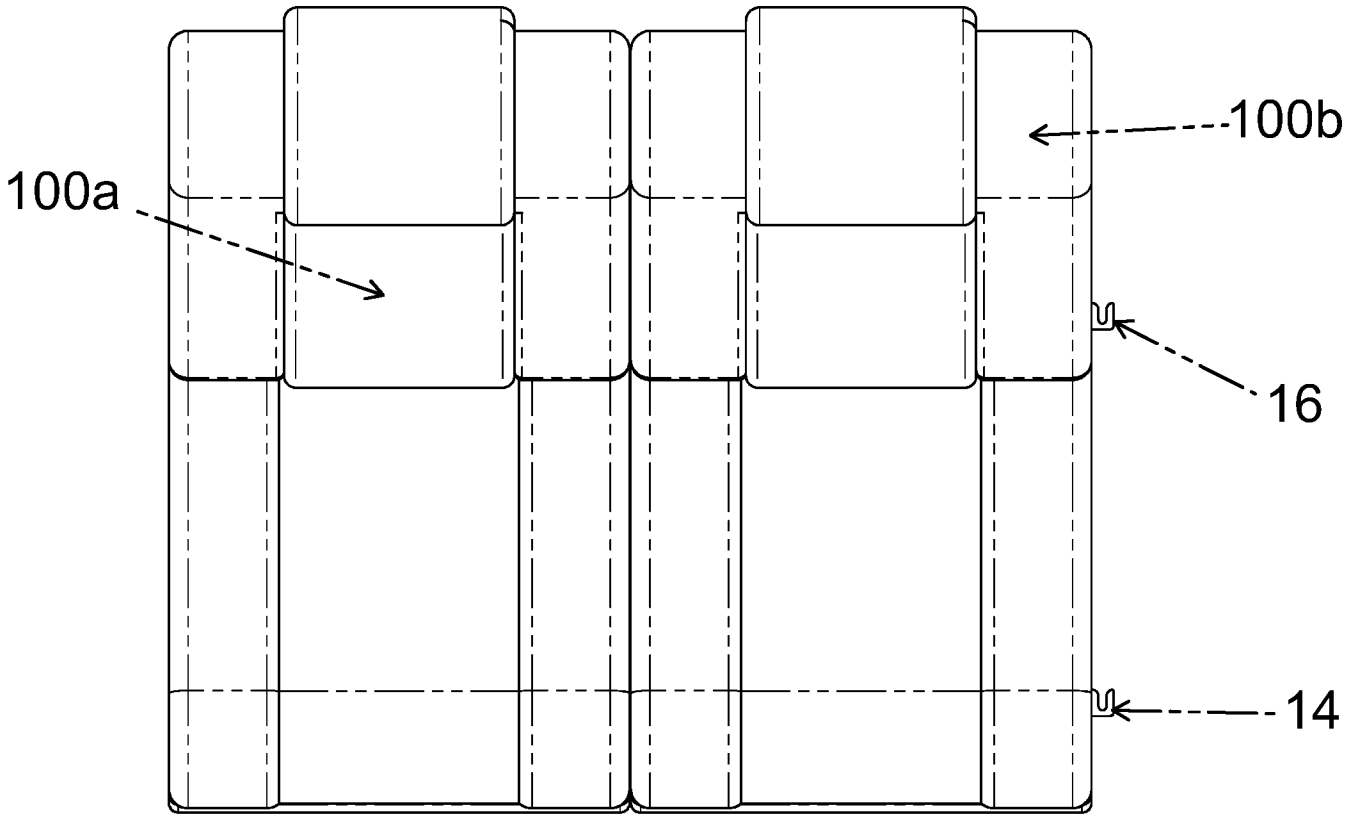
FIG. 18 is a top view of FIG. 13.
Figure 19:
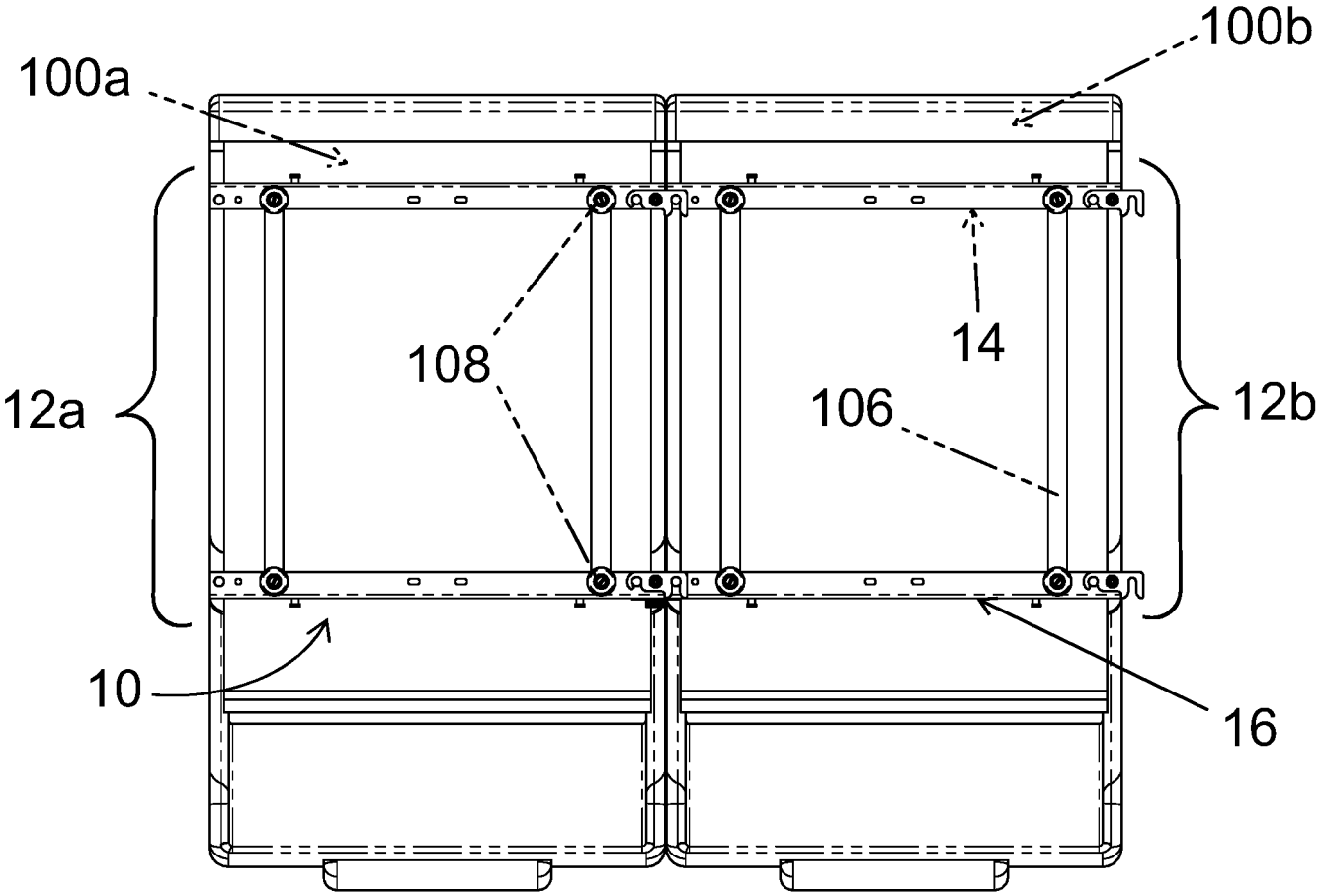
FIG. 19 is a bottom view of FIG. 13.

This feature of being able to releasably couple modular units together bare handed is illustrated, for example, in FIGS. 11 to 19. FIGS. 11 and 12 show the bracket system 10, which includes a first set of main brackets 12*a* and a second set of main brackets 12*b* that are securable to the base structural members 106 of a second main unit. The hooks 30 of the first set of main brackets 12*a* may releasably engage with the corresponding rigid posts 28 of the second set of main brackets 12*b*. In the depicted embodiment of FIGS. 11 and 12, since the rigid posts 28 of the second set of main brackets 12*b* and the hooks 30 of the first set of main brackets 12*a* are positioned on their respective horizontal legs 22, the rigid posts 28 of the second set of main brackets 12*b* may simply slide laterally into the corresponding hooks 30 of the first set of main brackets 12*a*. If the rigid posts 28 extend to a head 29 that is wider than the respective rigid post 28, the presence of the head 29 may help to prevent the hook 30 from sliding along the rigid post 28 and to help hold the hook 30 in place.

In order to more firmly assist in holding the first and second sets of main brackets 12*a*, 12*b* together, the bracket system 10 may include a brace piece 34 with a brace aperture 36 and a brace fastener 38. The brace piece 34 may be shaped and/or dimensioned to extend over a portion of both of the vertical legs 20 of the front frame extension brackets 14, or over a portion of both of the vertical legs 20 of the rear frame extension brackets 16, when the first and second sets of main brackets 12*a*, 12*b* are coupled together. In use, the brace piece 34 is positioned such that the brace aperture 36 is aligned with one of the main bracket apertures 32 (on front frame extension brackets 14 or on the rear frame extension brackets 16) that are proximate to the rigid posts 28 and the hooks 30 that are coupled together. The brace fastener 38 is configured to extend through the brace aperture 36 and the one of the main bracket apertures 32 (and the corresponding weld nut 33) positioned on the vertical legs 20 of each of the L-shaped beams 18 to hold the components together.

In the example shown in FIGS. 11 and 12, the brace piece 34 holds the rear frame extension brackets 16 together. In such a case, the brace piece 34 is positioned over an outside or outer surface of the vertical legs 20 of the rear frame extension brackets 16, and the brace fastener 38 extends through the brace aperture 36 and the main bracket aperture 32 (and the corresponding weld nut 33) at the hook end 26 of the rear frame extension bracket 16 of the first set of main brackets 12*a*. When coupled together in this manner, the brace piece 34 also extends over a portion of the rear frame extension bracket 16 of the second set of main brackets 12*b*. Thus, the brace piece 34 physically prevents the rigid posts 28 (of the second set of main brackets 12*b*) from sliding out of the hooks 30 (of the first set of main brackets 12*a*).

Alternatively (or additionally with a second brace piece 34), the brace piece 34 may be used to hold the front frame extension brackets 14 together (not shown). In such an application, the brace piece 34 may be positioned over an outer surface of the vertical legs 20 of the front frame extension brackets 14 and the brace fastener 38 extends through the brace aperture 36 and the main bracket aperture 32 (and the corresponding weld nut 33) at the post end 24 of the front frame extension bracket 14 of the second set of main brackets 12*b*. When coupled together in this manner, the brace piece 34 also extends over a portion of the front frame extension bracket 14 of the first set of main brackets 12*a*. Thus, the brace piece 34 physically prevents the rigid posts 28 (of the second set of main brackets 12*b*) from sliding out of the hooks 30 (of the first set of main brackets 12*a*).

In some applications, the brace fastener 38 may be a thumbscrew, or another type of fastener that can be used without the need for additional tools. As described above, the bracket system 10 helps to allow a user to couple the components together without tools.

With the bracket system 10 comprising the first and second sets of main brackets 12*a*, 12*b*, each of the first and second sets of main brackets 12*a*, 12*b* may be secured to a modular unit, such as the first main furniture unit 100*a* and a second main furniture unit 100*b*. In that manner, the first set of main brackets 12*a* may be secured to the first main furniture unit 100*a*, and the second set of main brackets 12*b* may be secured to the second main furniture unit 100*b*. The second main furniture unit 100*b* may be the same or different from the first main furniture unit. In some applications, the second main furniture unit 100*b* may be a slipper chair, an ottoman, a couch sectional, or a theatre seat among other options.

In order to couple the first and second main furniture units 100*a*, 100*b* together, the rigid posts 28 of the second set of main brackets 12*b* (secured to the second main furniture unit 100*b*) may simply be slid laterally into the corresponding hooks 30 of the first set of main brackets 12*a* (secured to the first main furniture unit 100*a*) by manually sliding the second main furniture unit 100*b*, or vice versa (by manually sliding the first main furniture unit 100*a* so that the hooks 30 are slid around the rigid posts 28).

The brace piece 34 may then be positioned over the outer surface of the vertical legs 20 of the rear frame extension brackets 16, and the brace fastener 38 be inserted and screwed into place through the brace aperture 36 and the main bracket aperture 32 (and the corresponding weld nut 33) at the hook end 26 of the rear frame extension bracket 16 of the first set of main brackets 12*a*. Alternatively or additionally, the brace piece 34 may be positioned over the outer surface of the vertical legs 20 of the front frame extension brackets 14, and the brace fastener 38 be inserted and screwed into place through the brace aperture 36 and the main bracket aperture 32 (and the corresponding weld nut 33) at the post end 24 of the front frame extension bracket 14 of the second set of main brackets 12*b*. When the first and second sets of main brackets 12*a*, 12*b* (respectively secured to the first and second main furniture units 100*a*, 100*b*) are releasably engaged as described above, the first and second main furniture units 100*a*, 100*b* may be, thus, releasably coupled together.

In the embodiment shown in FIGS. 13 to 21, the bracket system 10 shown in FIG. 11 is secured to the first and second main furniture units 100*a*, 100*b*, where the first and second main furniture units 100*a*, 100*b* are releasably coupled together. The first and second main furniture units 100*a*, 100*b* are both shown as theatre seats with the front 102, the rear 104, and the base structural members 106. The front frame extension brackets 14 are secured to the base structural members 106 along the fronts 102 of the first and second main furniture units 100*a*, and the rear frame extension brackets 16 are secured to the base structural members 106 along the rears 104 of the first and second main furniture units 100*a*, 100*b*.

In this manner, the bracket system 10 allows for two main furniture units 100*a*, 100*b* to be releasably coupled together in a "seat-seat" configuration. If desired, the first and second main furniture units 100*a*, 100*b* may be separated from one another, also bare handed, by applying the reverse of the process described above to assemble the seat-seat configuration. In other words, the first main furniture unit 100*a* may be separated from the second main furniture unit 100*b* by manually disengaging the first set of main brackets 12*a* from the second set of main brackets 12*b*.

In other applications, rather than be releasably coupled with another main unit, it may be desired to couple the first main unit (such as the first main furniture unit 100*a*) with a, perhaps smaller, supplemental unit.

To that end, each of the front and rear frame extension brackets 14, 16 may further comprise a pair of rigid pegs 40 that may be positioned on the respective vertical leg 20. In the embodiments shown in FIGS. 1, 11, and 12, each of the rigid pegs 40 may extend away from the corresponding horizontal leg 22 and may be positioned proximate to, and/or equidistant from, one of each of the main bracket apertures 32. Moreover, each of the rigid pegs 40 may extend to a head 41 that is wider than the respective rigid peg 40.

Figure 20:
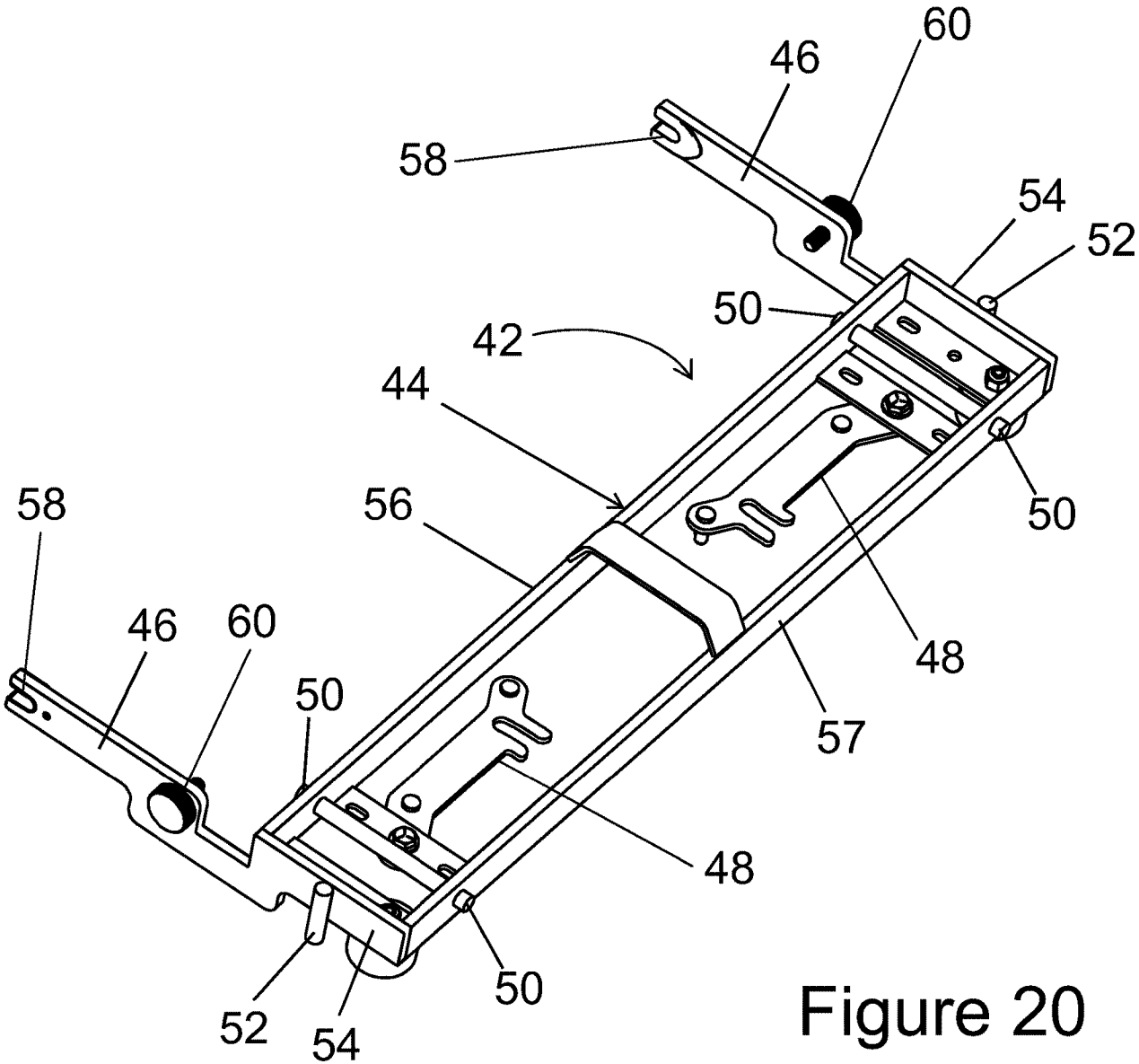
FIG. 20 is a top perspective view of a base linkage bracket in isolation in a first configuration according to an example embodiment.
Figure 21:
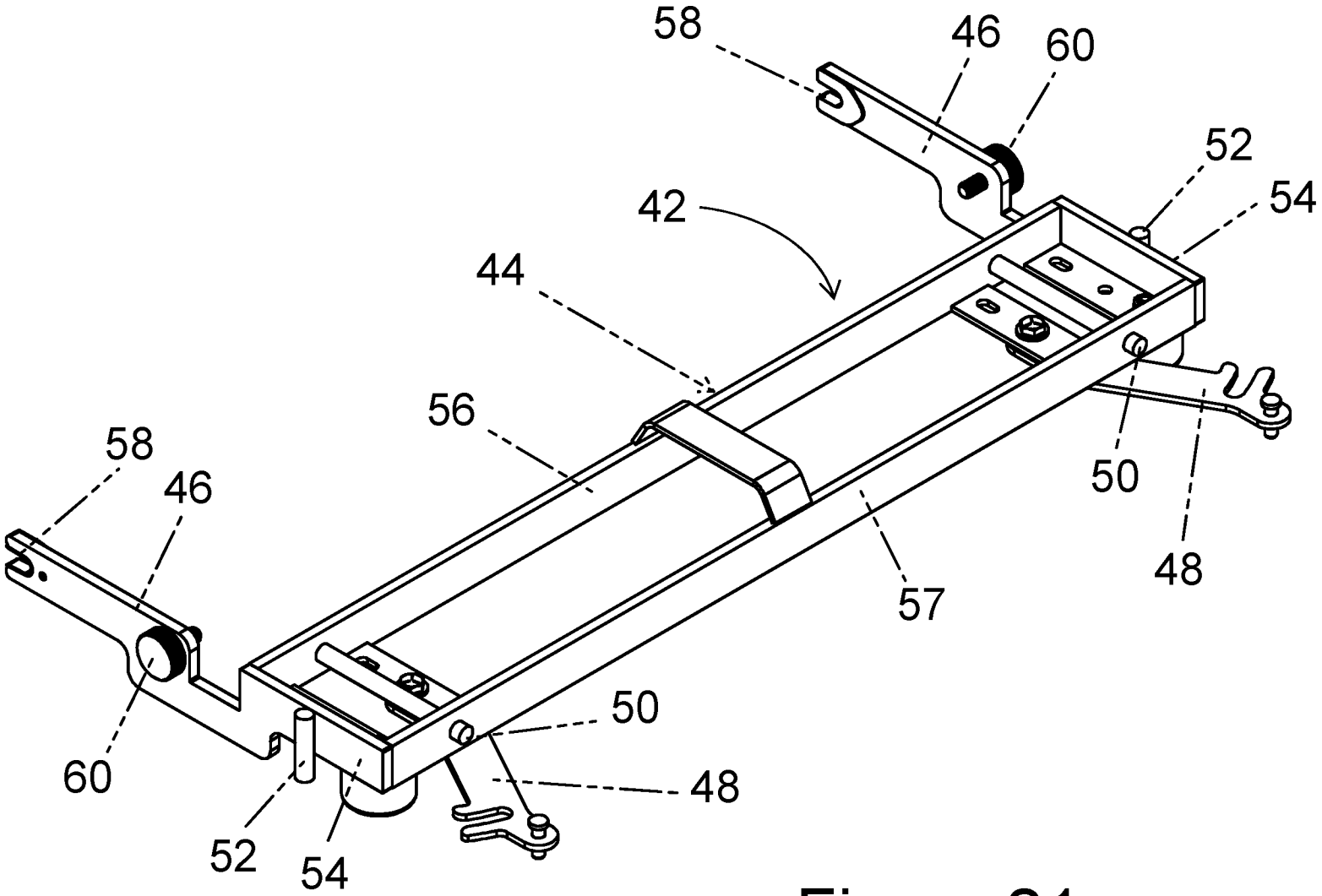
FIG. 21 is a view of the base linkage bracket of FIG. 20 in a second configuration.
Figure 22:
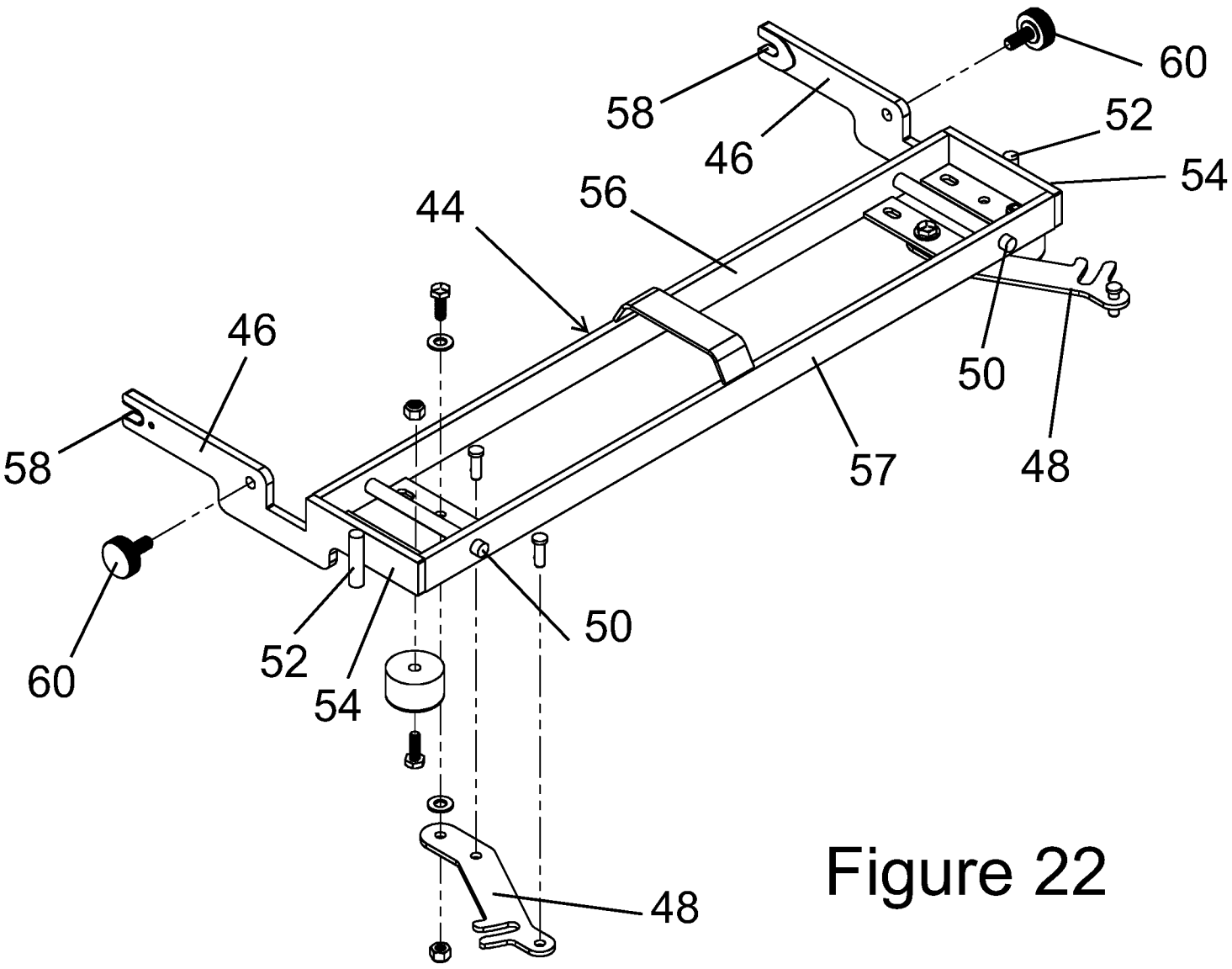
FIG. 22 is an exploded view of the base linkage bracket of FIG. 21.

In order to couple the first main unit (such as the first main furniture unit 100*a*) with a supplemental unit, the bracket system 10 may further include a base linkage bracket 42 and a mounting bracket 62. An example of the base linkage bracket 42 is shown in FIGS. 20 to 22. An example of the mounting bracket 62 is shown in FIGS. 26 to 27.

As illustrated in FIGS. 20 to 22, the first base linkage bracket 42 generally includes a base frame 44, a pair of extensions 46, a pair of base latches 48, a pair of base posts 50, and a stop 52.

The base frame 44 may be dimensioned to correspond with base structural members of a first supplemental unit, where the base frame 44 comprises opposed ends 54 and first and second base frame sides 56, 57 extending between the opposed ends 54.

The pair of extensions 46 may extend from the opposed ends 54 of the base frame 44. In the depicted embodiment of FIGS. 20 to 22, for example, the pair of extensions 46 extend in parallel to each other from the first base frame side 56. Each extension 46 is shown to include a base slot 58 at a distal end of each extension 46. Each base slot 58 may be dimensioned and orientated to receive therein one of the rigid pegs 40 on the front or rear frame extension bracket 14, 16. Each extension 46 may further include a base fastener 60 that may be positioned between the base frame 44 and the base slot 58. The base fastener 60 may be positioned to align, and operatively engage, with the respective main bracket aperture 32 on the front or rear frame extension bracket 14, 16 when the base slot 58 engages with one of the rigid pegs 40. In some applications, in order to allow a user to couple the components together without tools, the base fastener 60 may be a thumbscrew, or another type of fastener that can be used without the need for additional tools.

The pair of base latches 48 may each be pivotably coupled proximate to one of the opposed ends 54 of the base frame 44. Each base latch 48 may be configured to pivotably extend from the second base frame side 57 and to operatively engage with one of the rigid posts 28 of the front or rear frame extension bracket 14, 16.

The base linkage bracket 42 may further include the pair of base posts 50. One of the pair of base posts 50 may extend from the first base frame side 56 and may be positioned proximate one of the opposed ends 54 of the base frame 44. Another one of the pair of base posts 50 may extend from the second base frame side 56 positioned proximate the other one of the opposed ends 54. Having at least one base post 50 extending from each of the base frame side 56, in use, may help to balance the coupling with the mounting bracket 62.

In some applications, the base linkage bracket 42 may have more than the two base posts 50. In the embodiment illustrated in FIGS. 20 to 22, the base linkage bracket 42 has four base posts 50. Two base posts 50 extend from the first base frame side 56 and two base posts 50 extend from the second base frame side 57.

The base linkage bracket 42 may also include the stop 52. The stop 52 may be secured to one of the opposed ends 54 of the base frame 44, where the stop 52 extends past a horizontal plane of the base frame 44. In the embodiment depicted in FIGS. 20 to 22, the base linkage bracket 42 further includes another stop 52. This other stop 52 may be secured to the other one of the opposed ends 54 of the base frame 44, where the other stop 52 also extends past the horizontal plane of the base frame 44. Having stops 52 positioned at both of the opposed ends 54 allows the base linkage bracket 42 to be used in more than one configuration with the set of main brackets 12. As will be discussed further below, the base linkage bracket 42 may be releasably engageable with either side of the set of main brackets 12.

Figure 23:
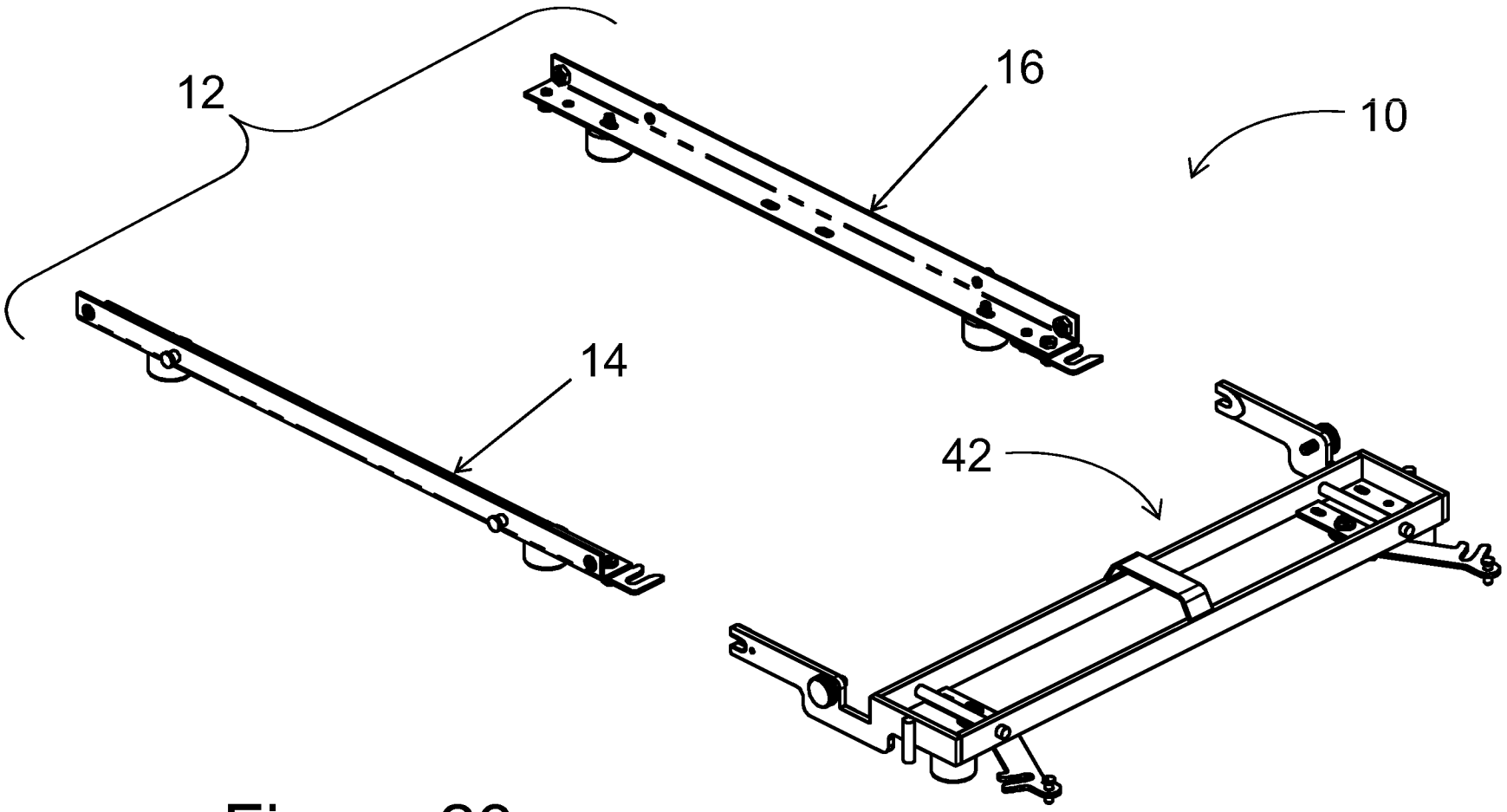
FIG. 23 is a perspective view of the base linkage bracket of FIG. 21 prior to coupling with the set of main brackets of FIG. 1.
Figure 24:
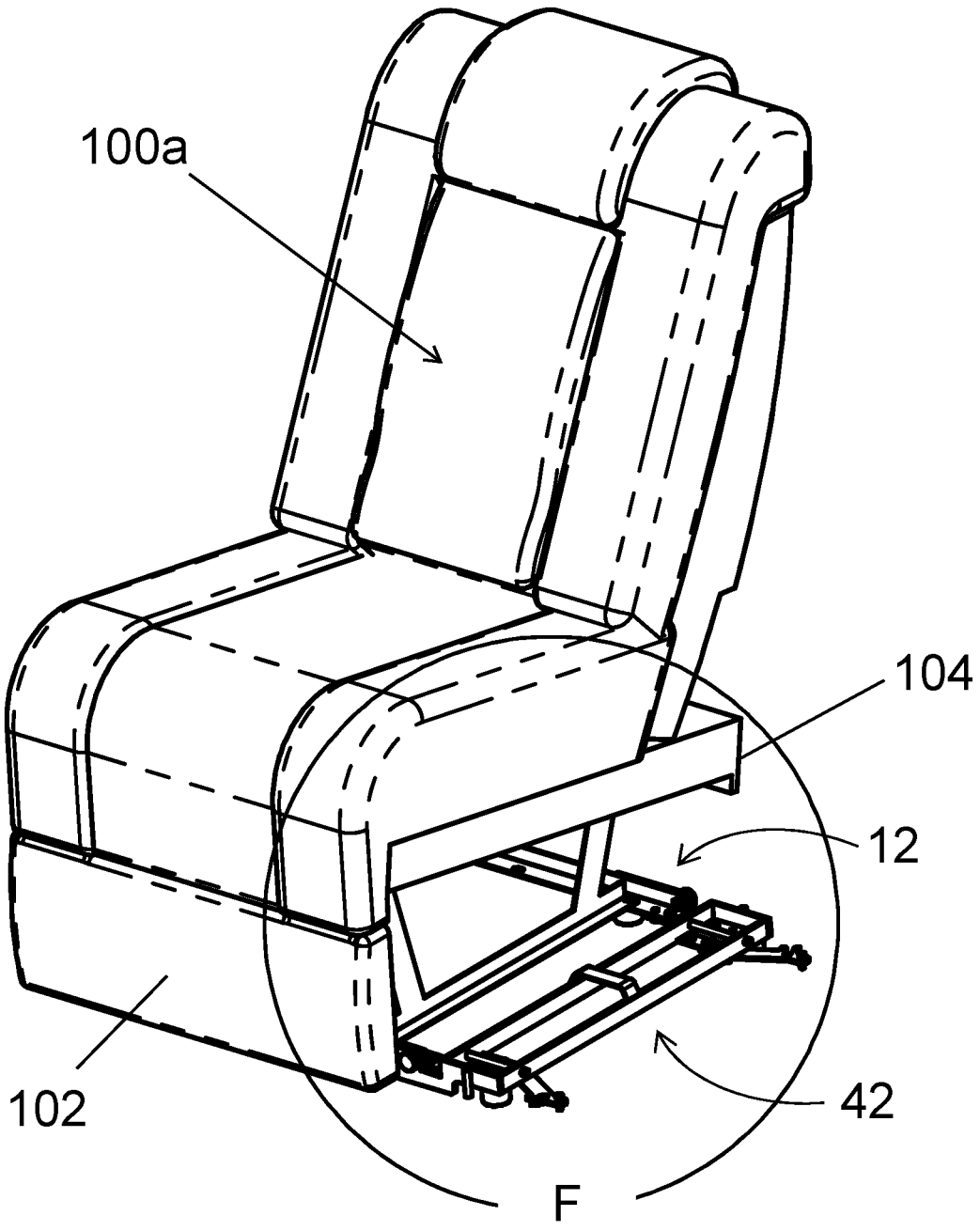
FIG. 24 is a left perspective view of the base linkage bracket of FIG. 21 coupled with the set of main brackets secured to the main furniture unit of FIG. 2.
Figure 25:
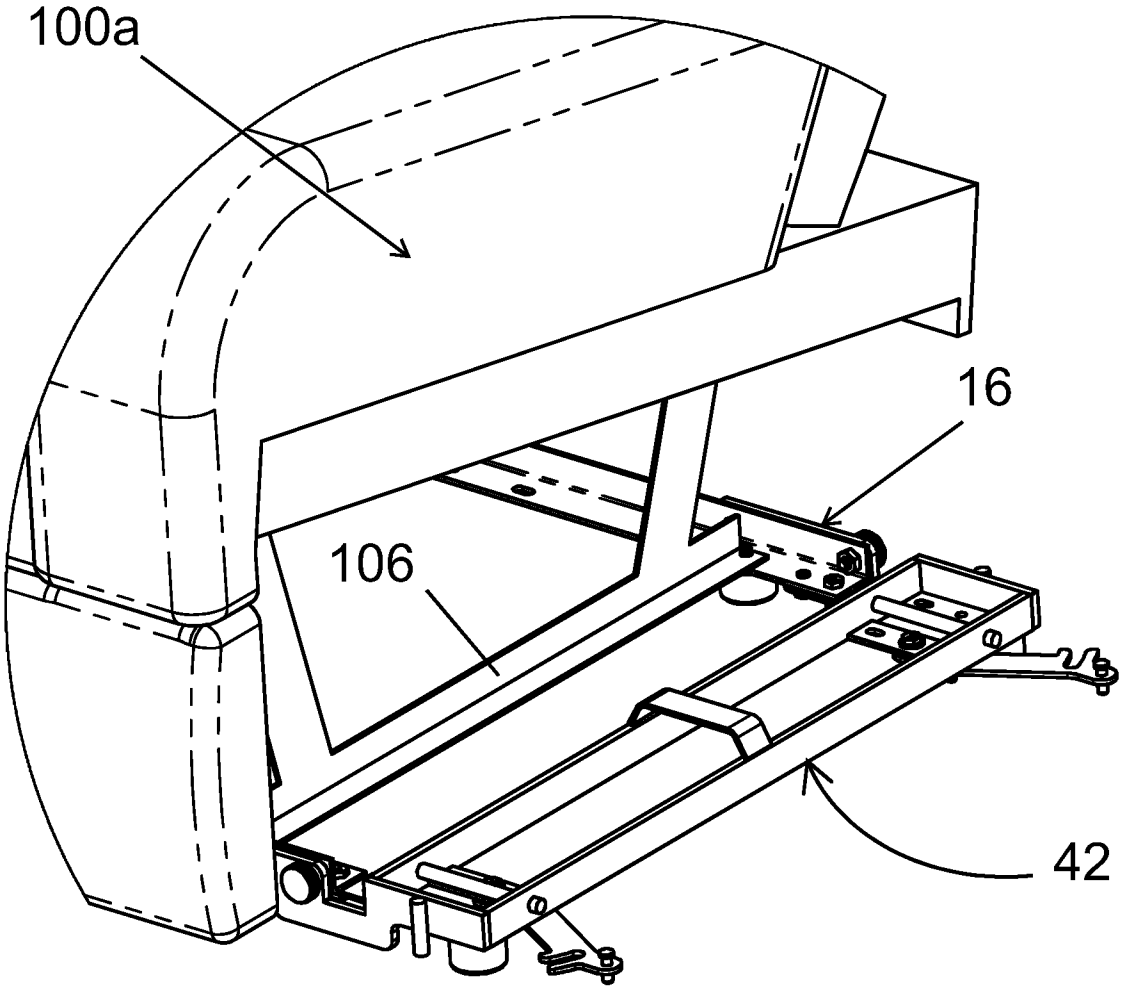
FIG. 25 is an enlarged view of portion F of FIG. 24.
Figure 28:
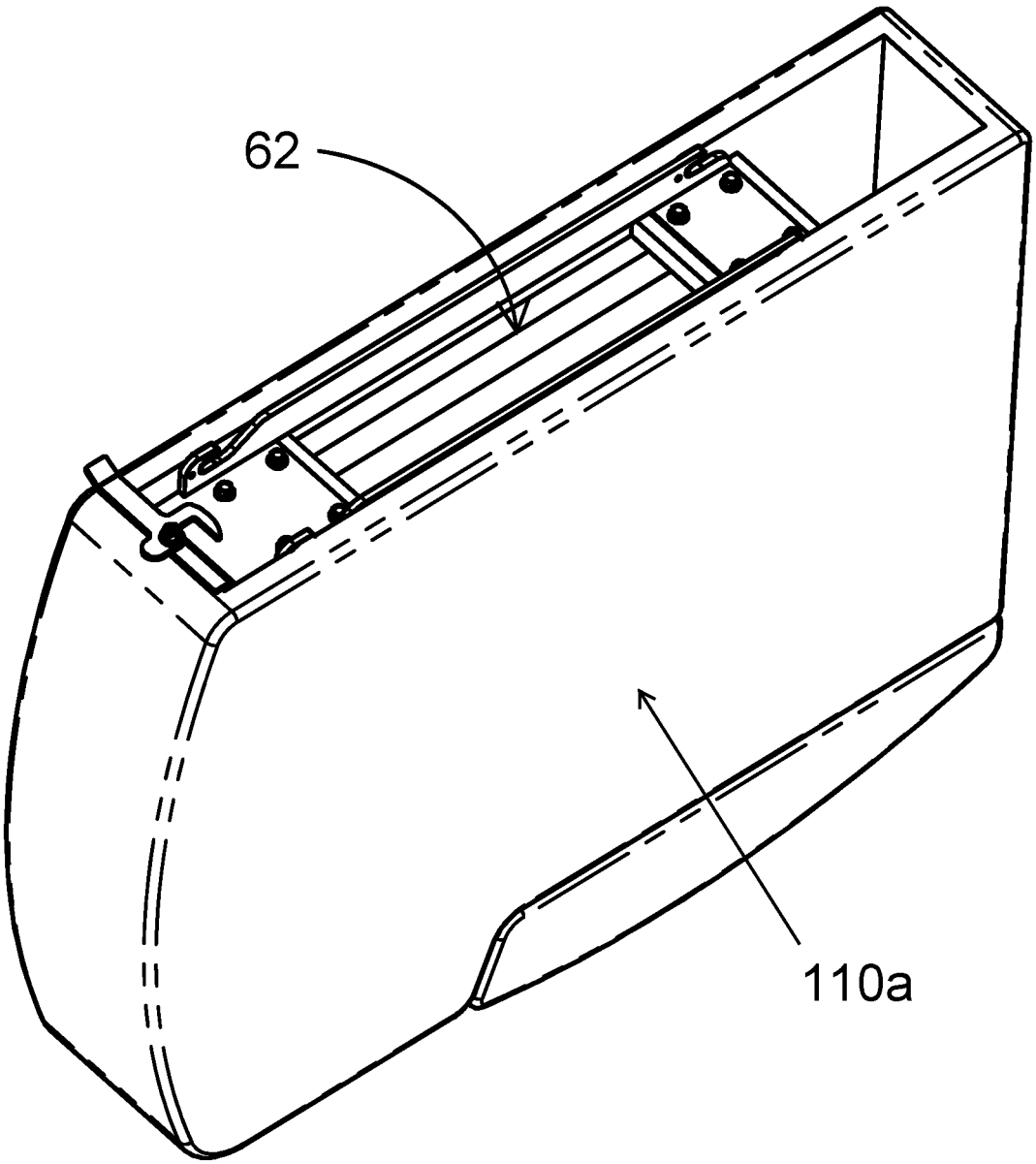
FIG. 28 is a bottom perspective view of the mounting bracket of FIG. 27 secured to a supplemental furniture unit.
Figure 29:
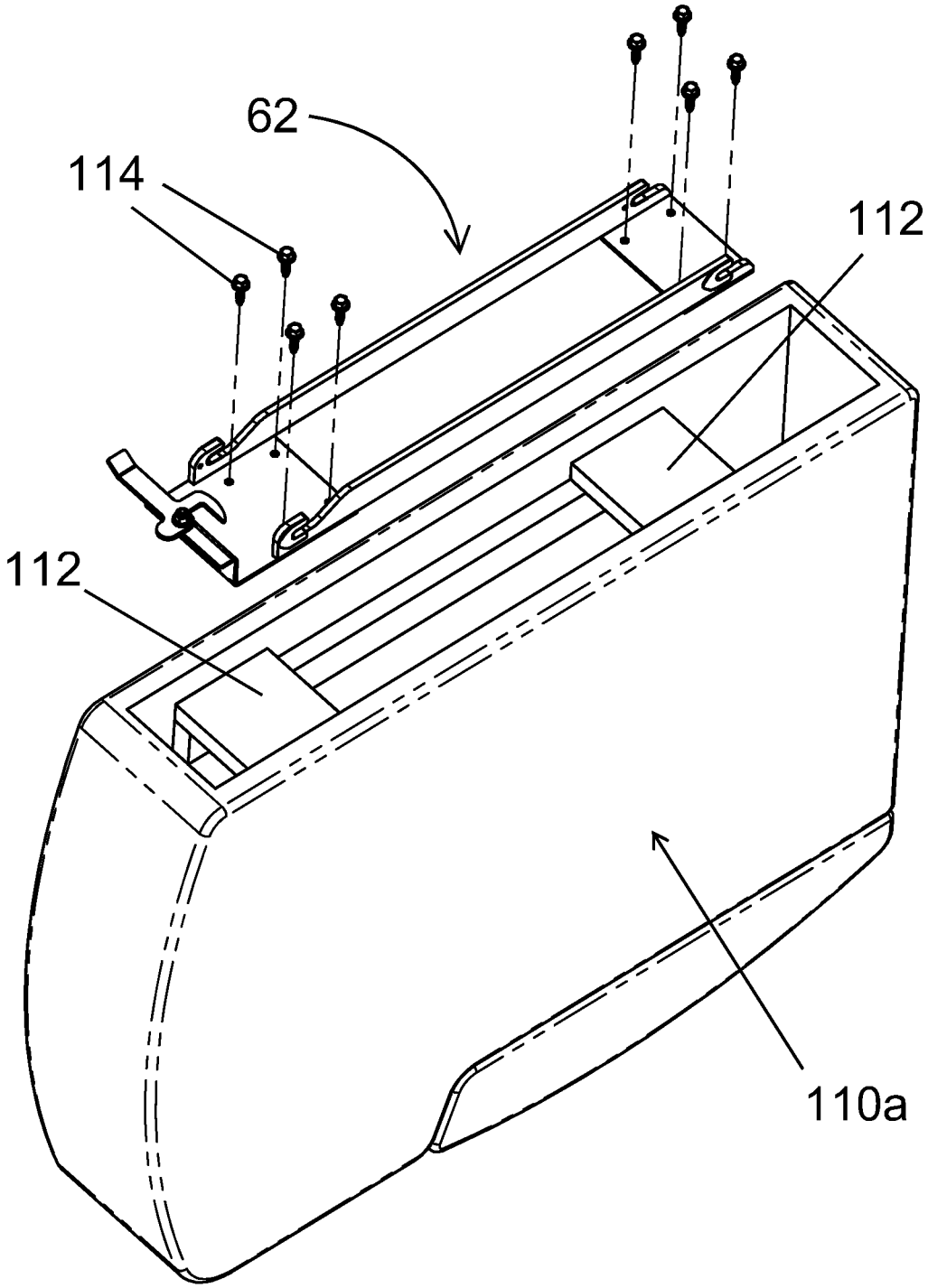
FIG. 29 is an exploded view of the mounting bracket and the supplemental furniture unit of FIG. 28.
Figure 30:
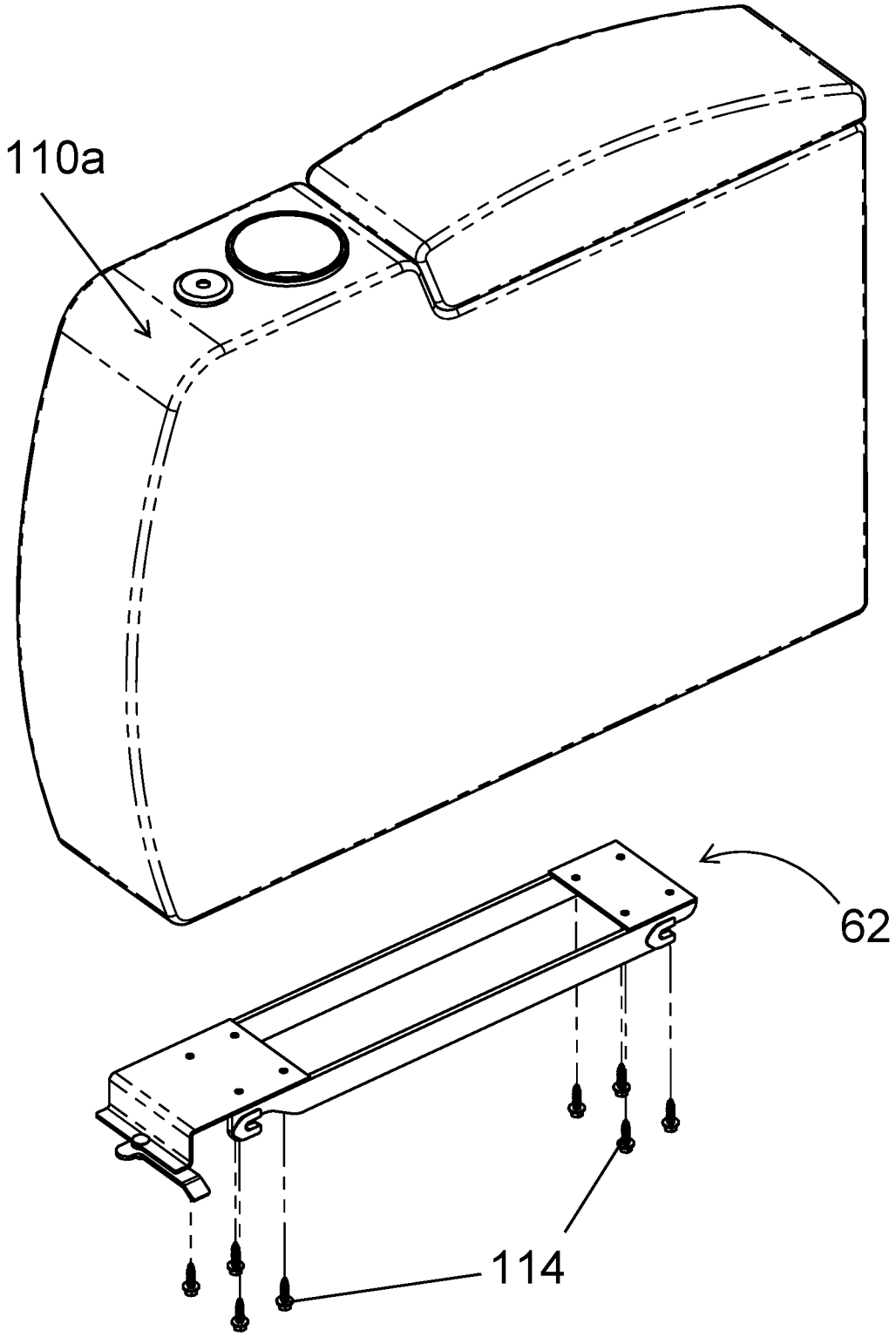
FIG. 30 is a top perspective exploded view of the mounting bracket and the supplemental furniture unit of FIG. 28.
Figure 31:
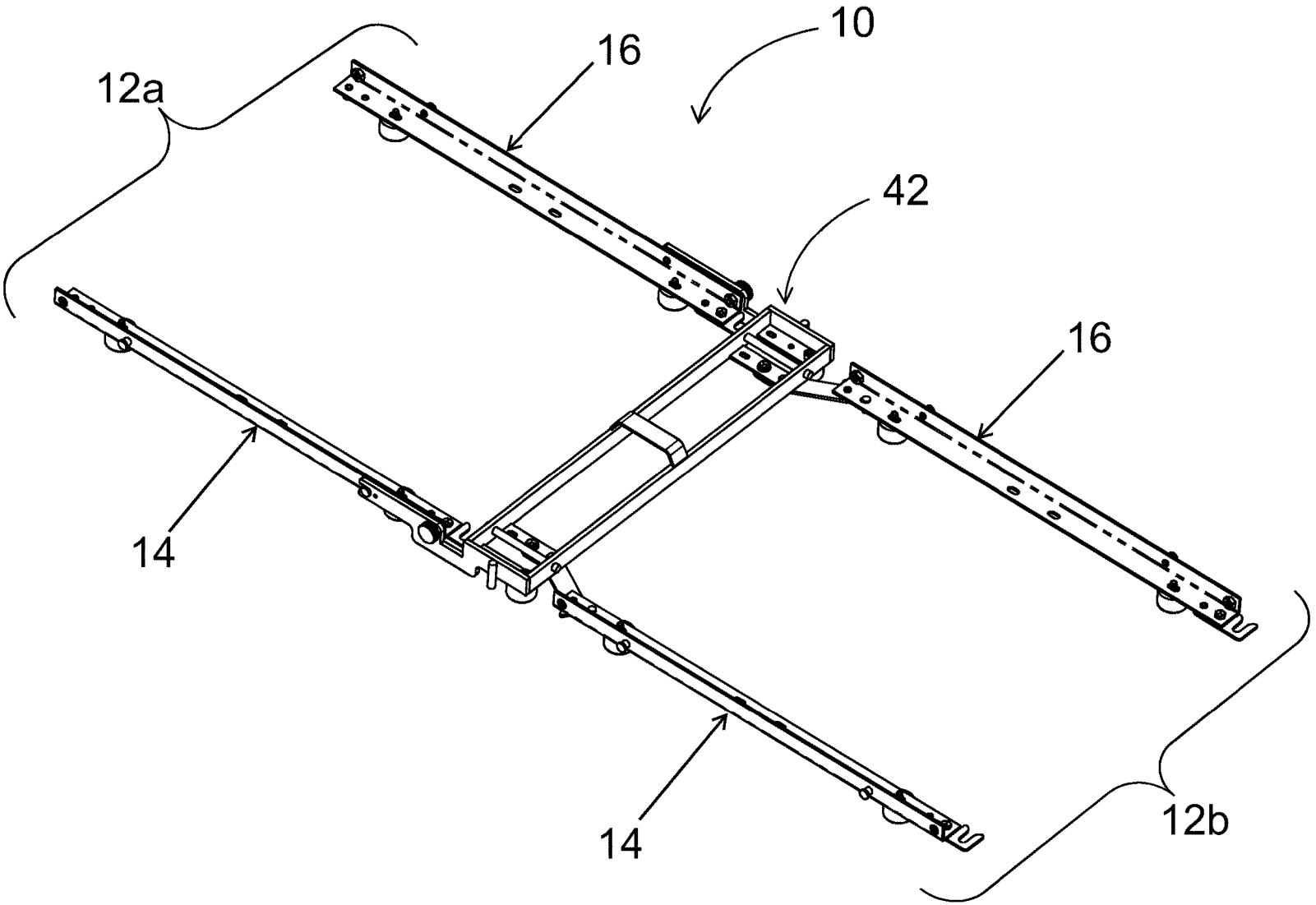
FIG. 31 is a top perspective view of two sets of main brackets of FIG. 1 coupled with the base linkage bracket of FIG. 21 in isolation according to an example embodiment.
Figure 32:
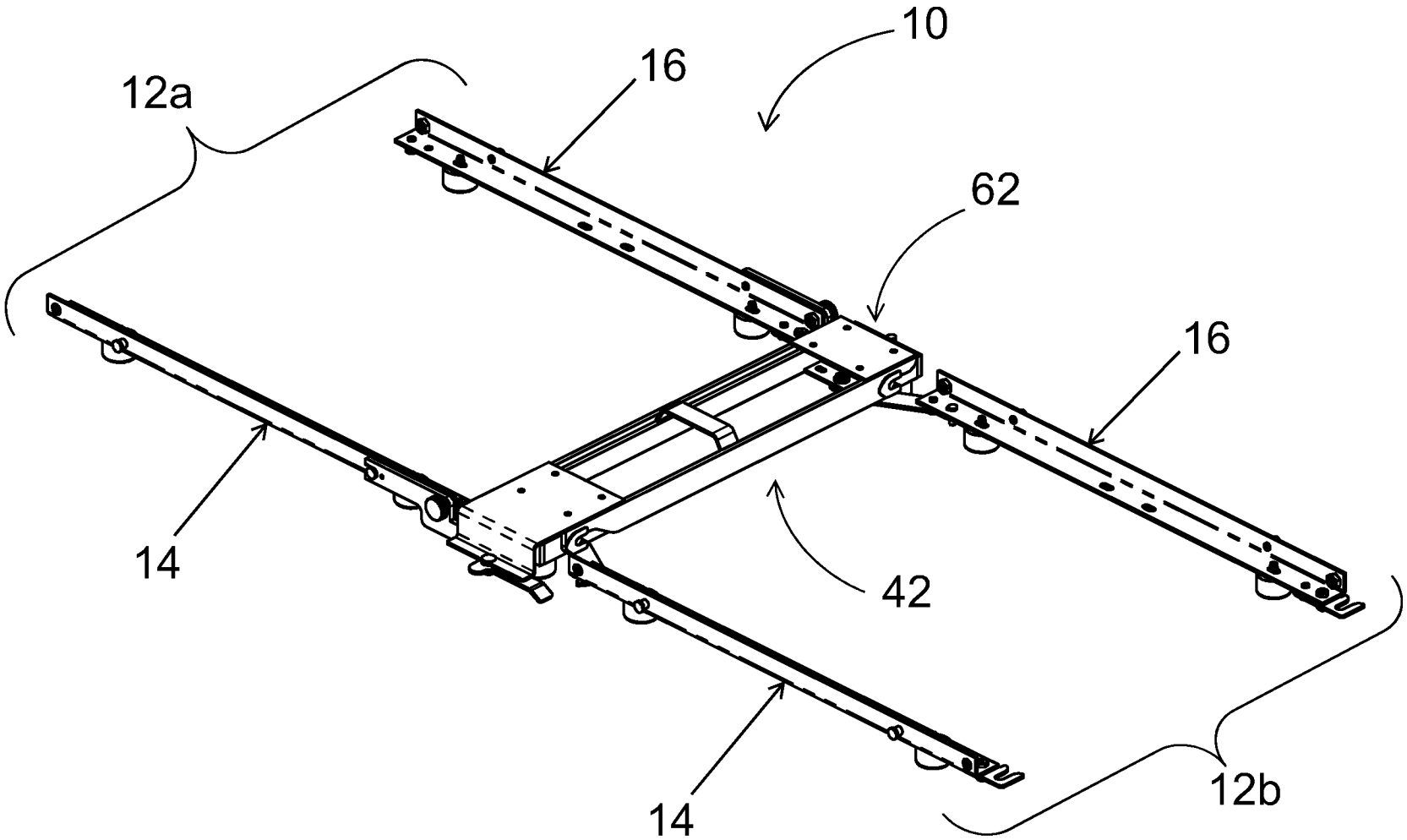
FIG. 32 is a view of the two sets of main brackets and the base linkage bracket of FIG. 31, couple with the mounting bracket of FIG. 26.
Figure 33:
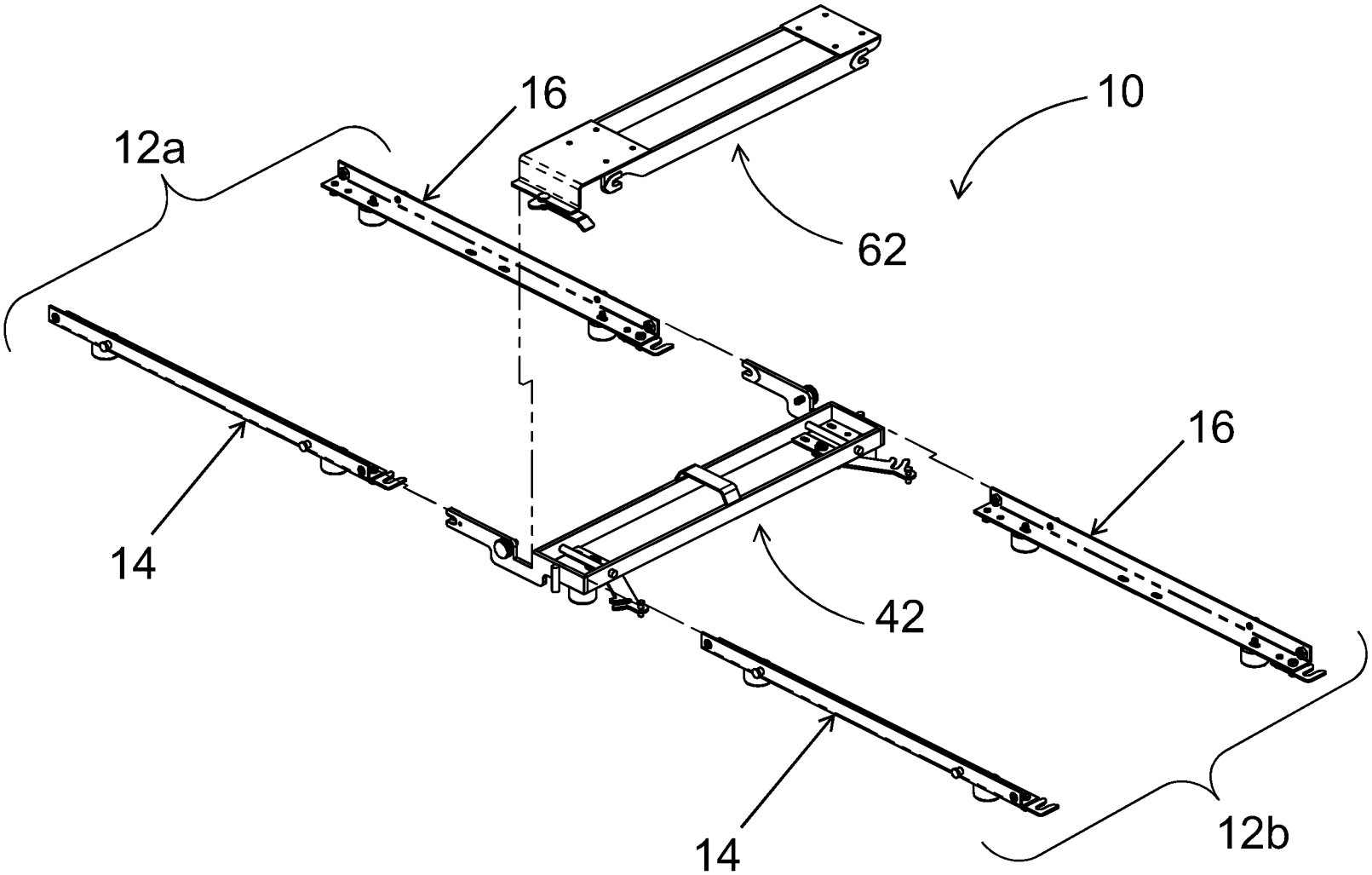
FIG. 33 is an exploded view of the two sets of main brackets, the base linkage bracket, and the mounting bracket of FIG. 32.
Figure 34:
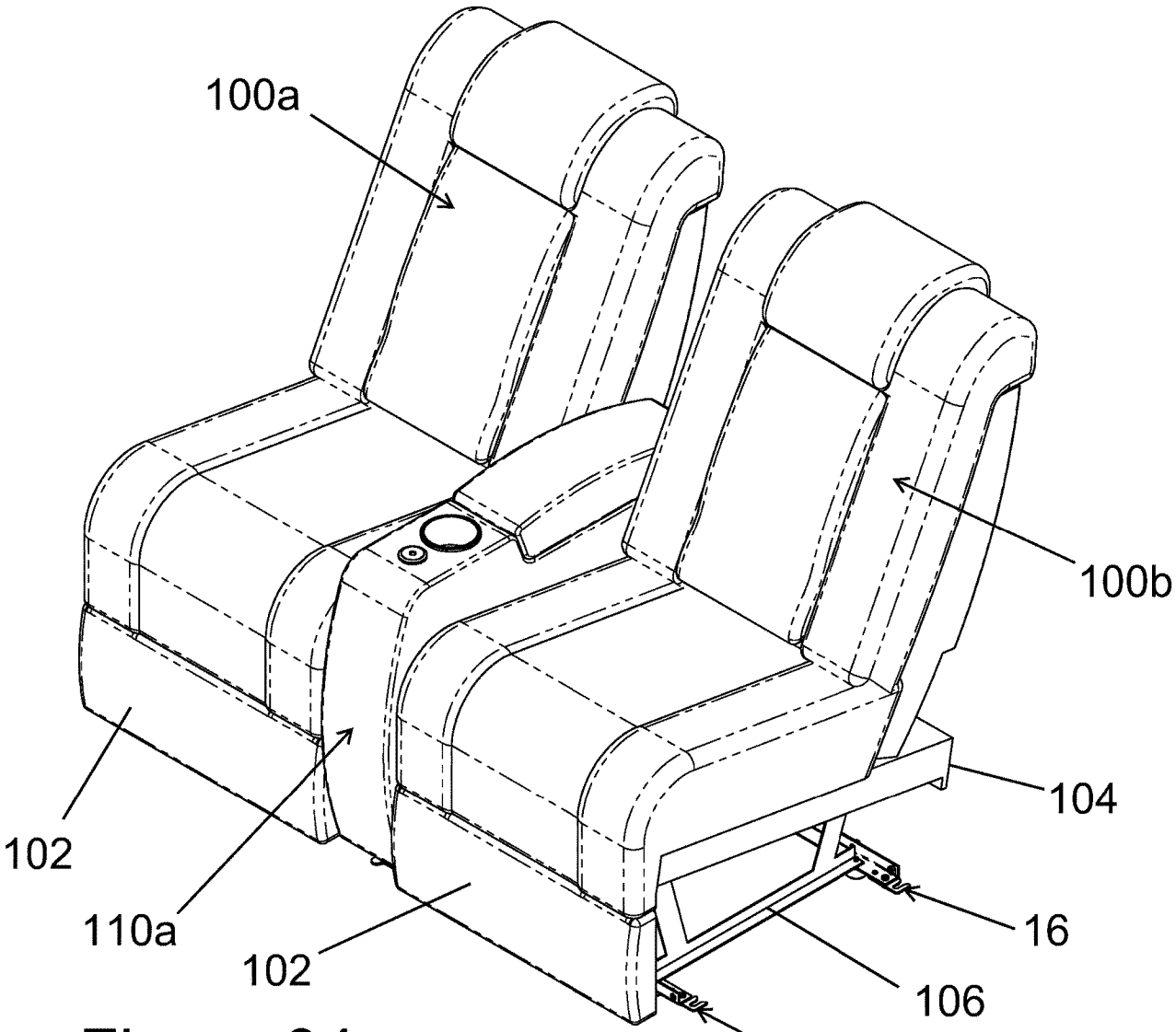
FIG. 34 is a left perspective view of the two sets of main brackets, the base linkage bracket, and the mounting bracket of FIG. 32 secured to two main furniture units and a supplemental furniture unit.
Figure 35:
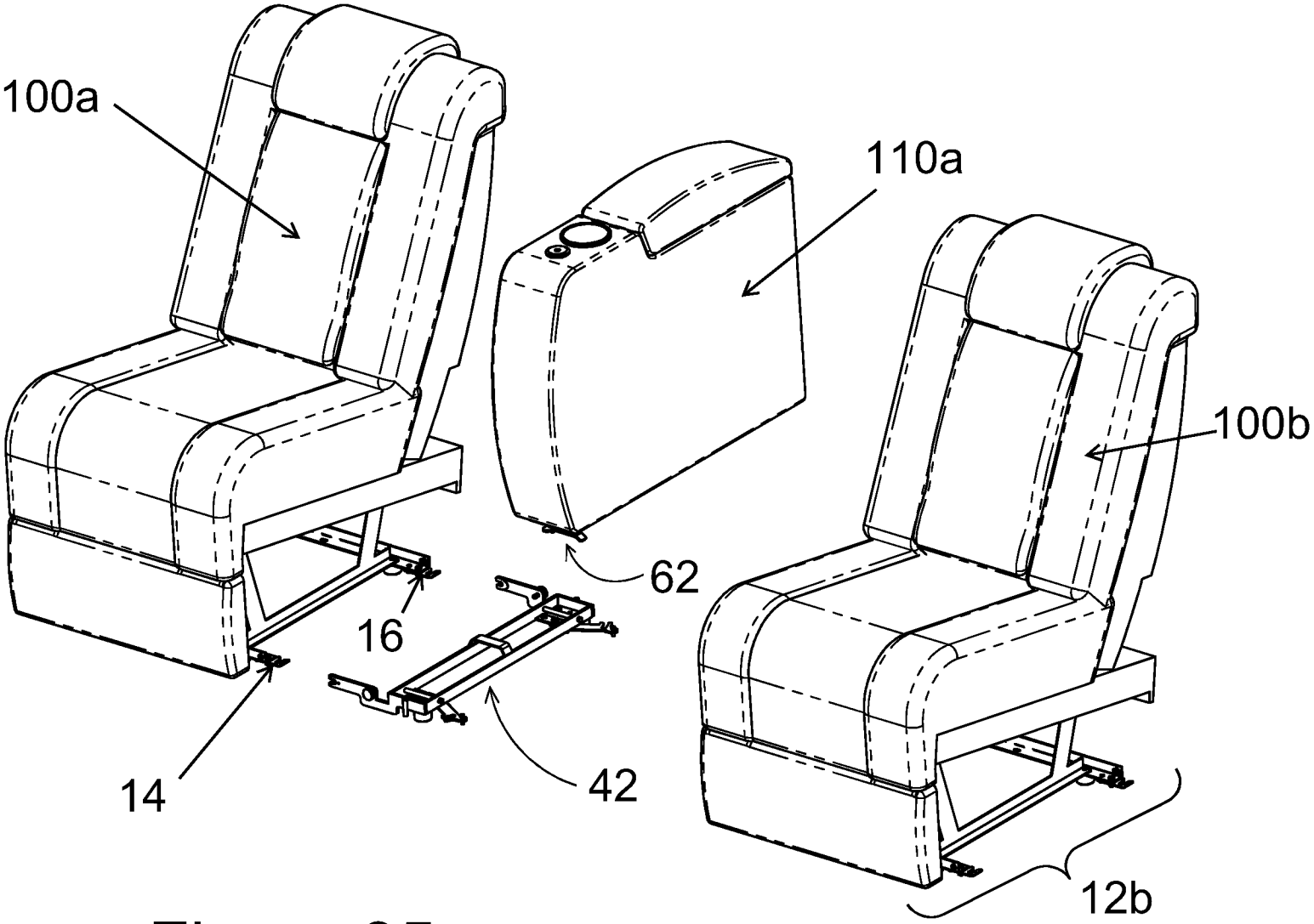
FIG. 35 is a partially exploded view of the components of FIG. 34.
Figure 36:
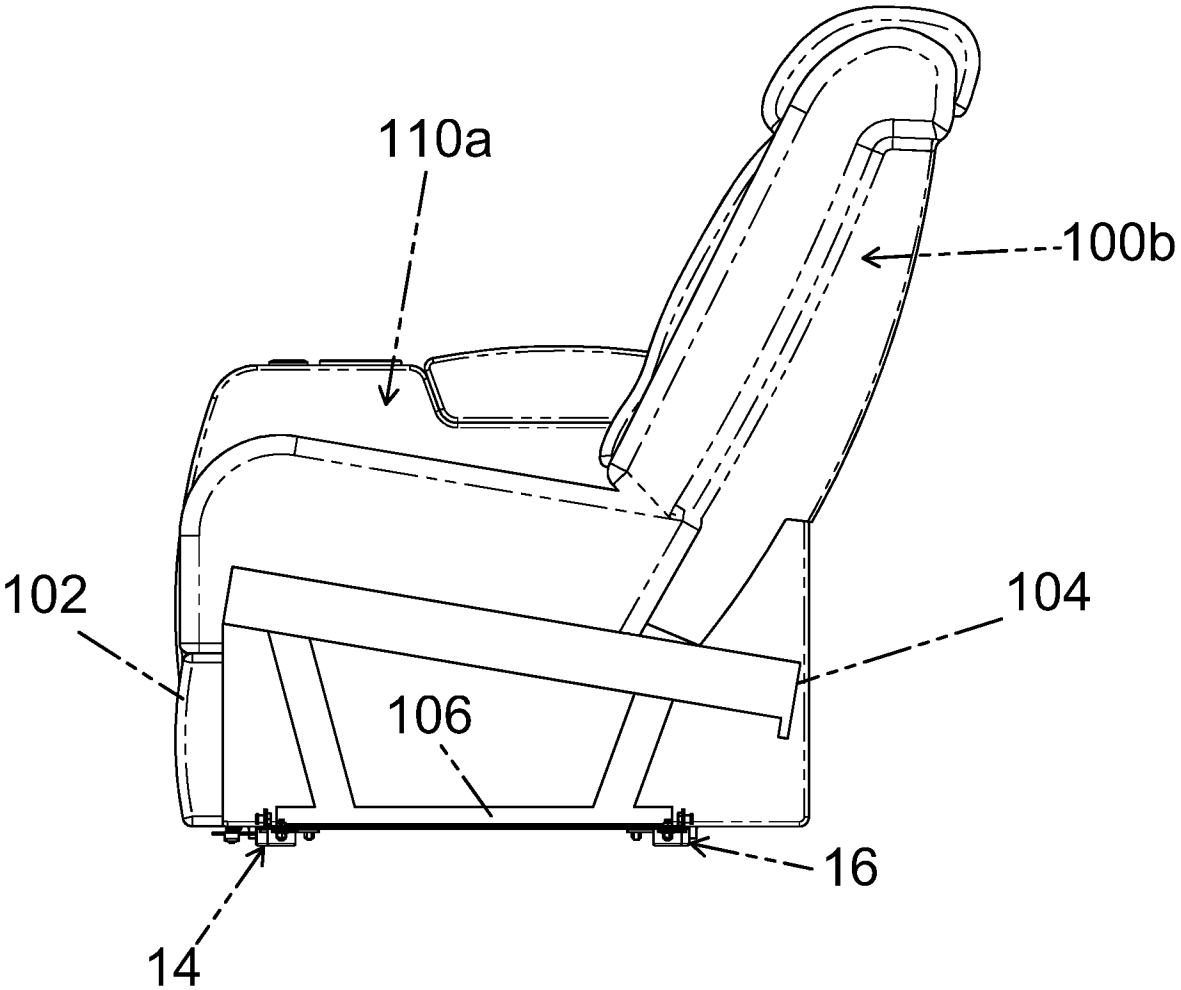
FIG. 36 is a left side view of FIG. 34.
Figure 37:
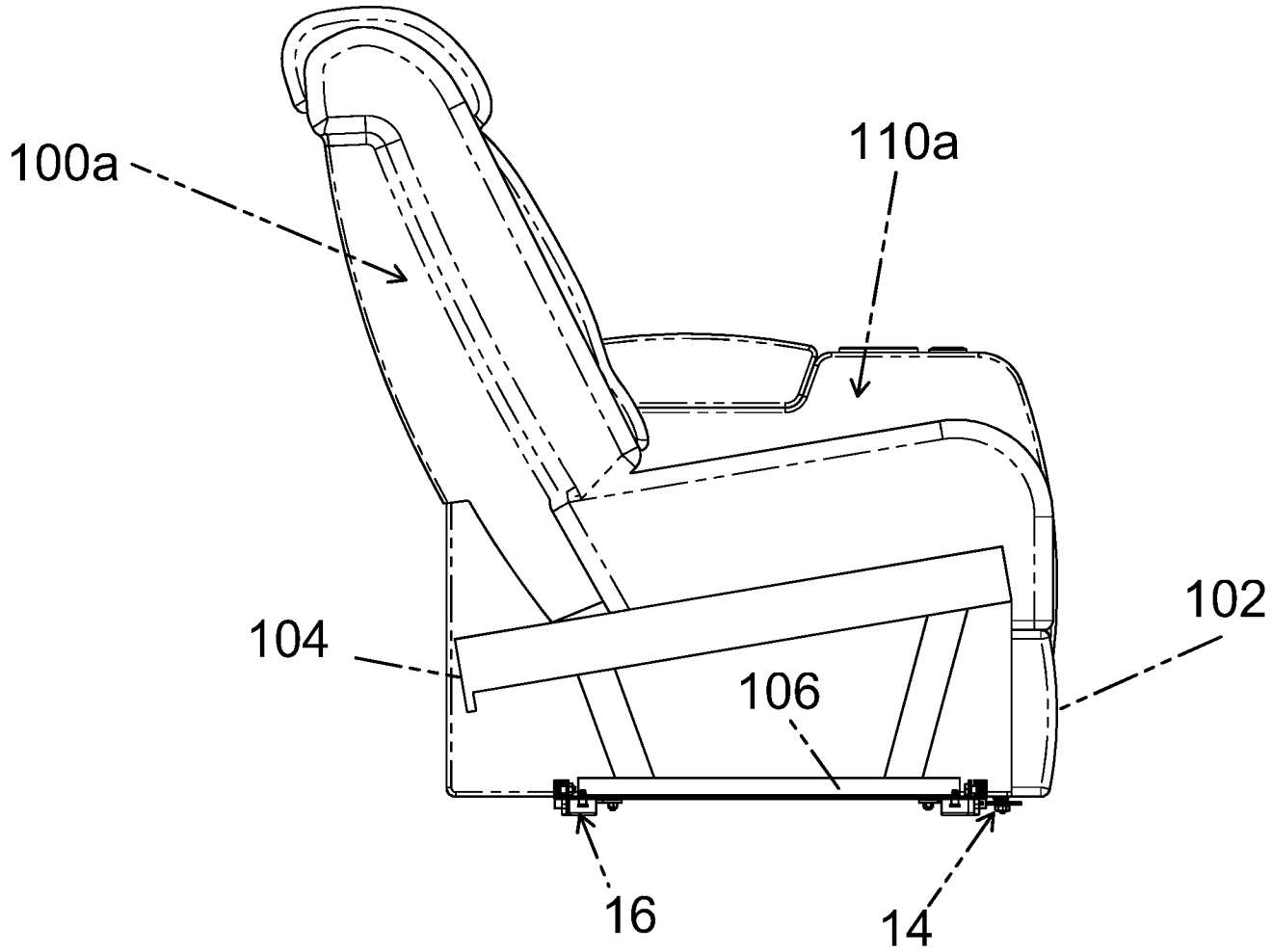
FIG. 37 is a right side view of FIG. 34.
Figure 38:
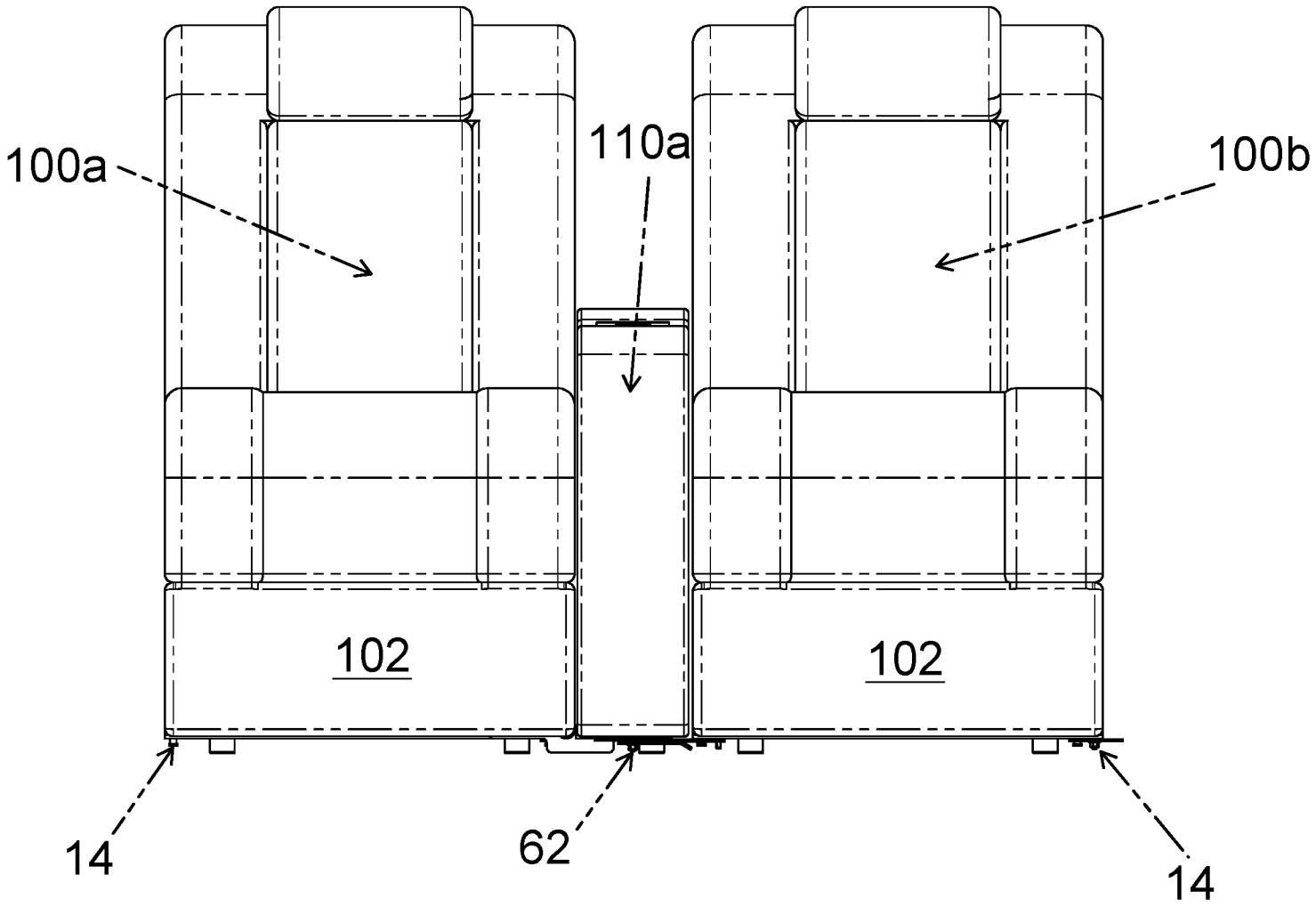
FIG. 38 is a front view of FIG. 34.
Figure 39:
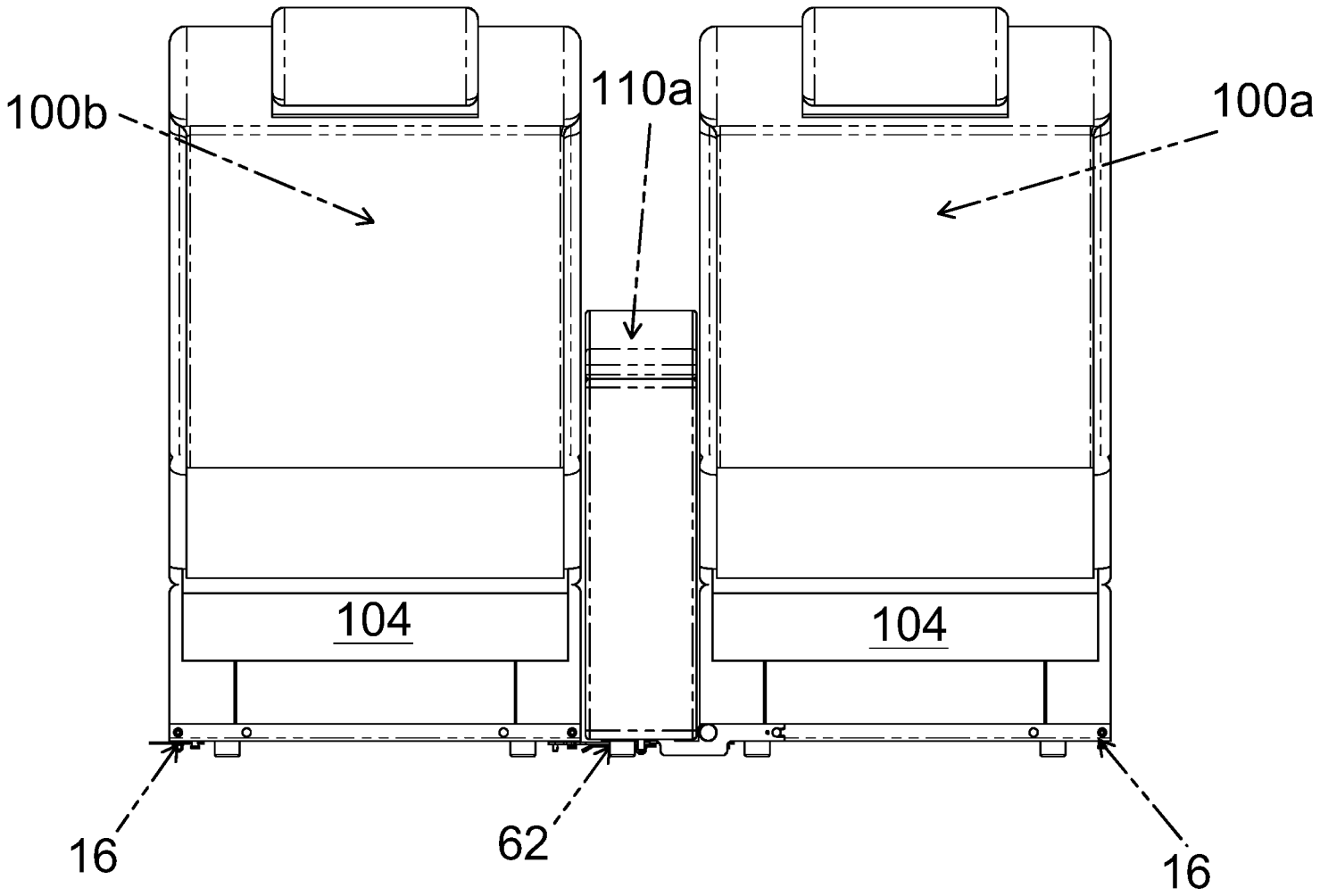
FIG. 39 is a rear view of FIG. 34.
Figure 40:
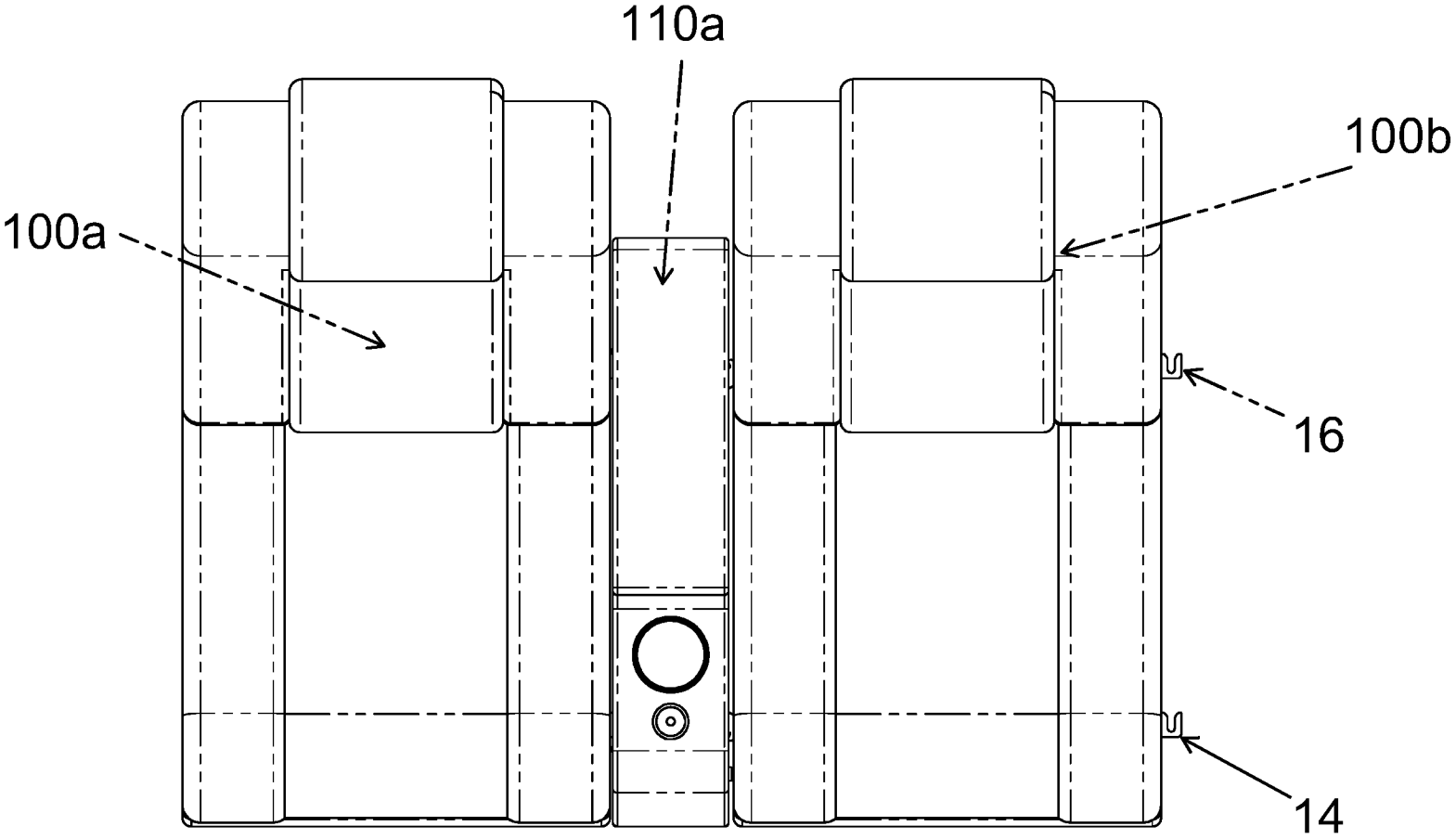
FIG. 40 is a top view of FIG. 34.
Figure 41:
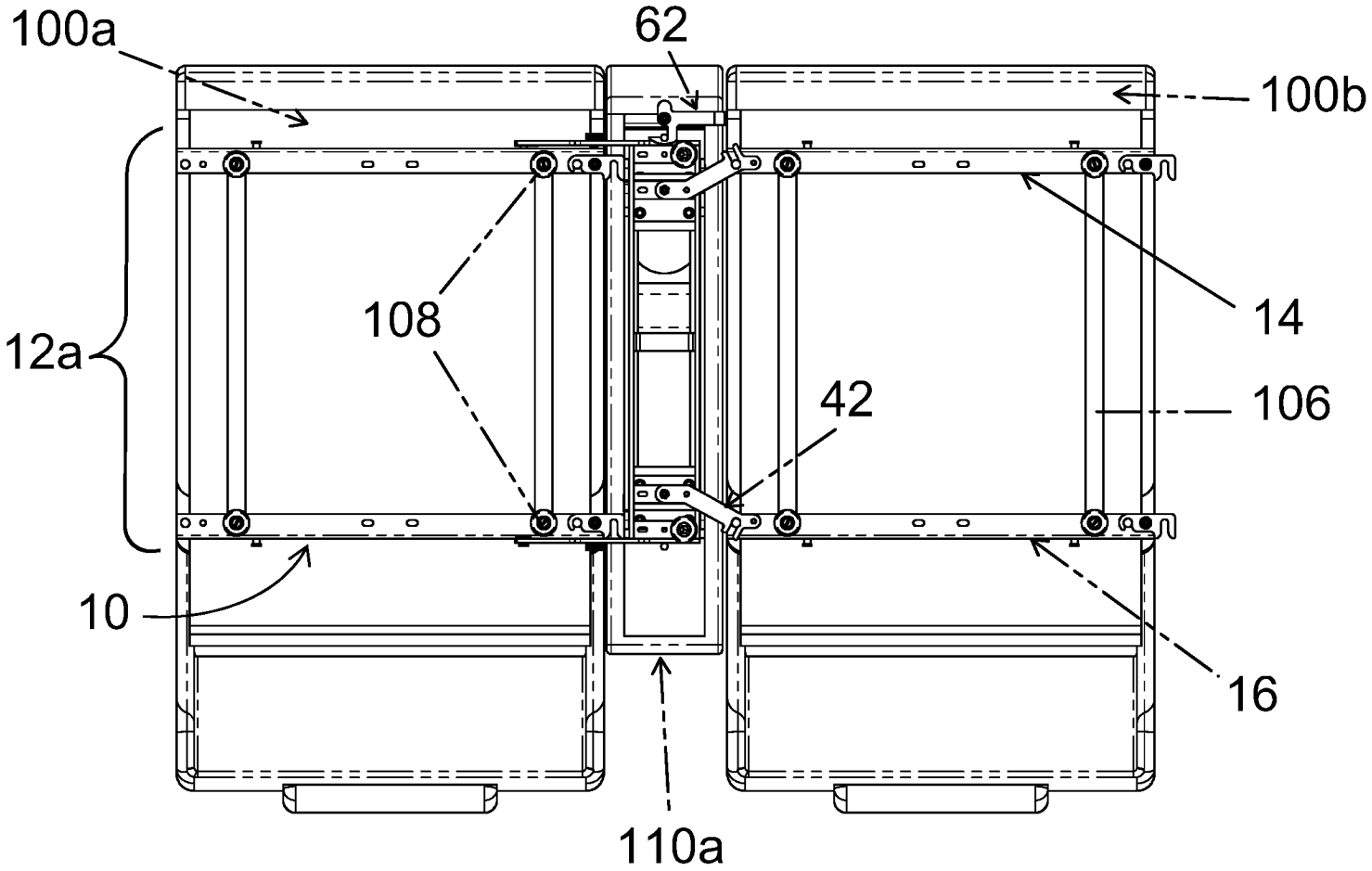
FIG. 41 is a bottom view of FIG. 34.
Figure 42:
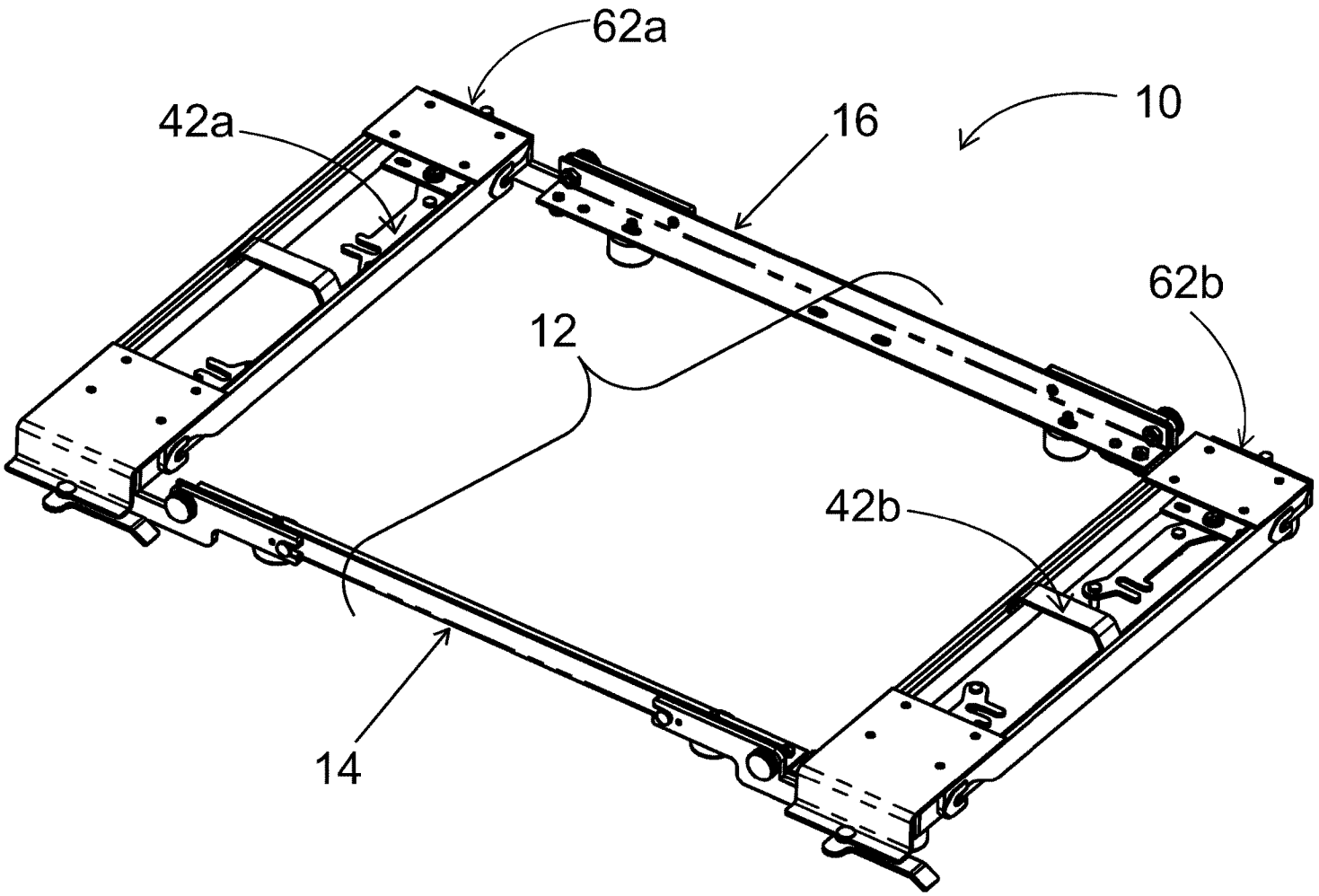
FIG. 42 is a top perspective view of the set of main brackets of FIG. 1 coupled to two base linkage brackets of FIG. 20 and two mounting brackets of FIG. 26 in isolation according to an example embodiment.
Figure 43:
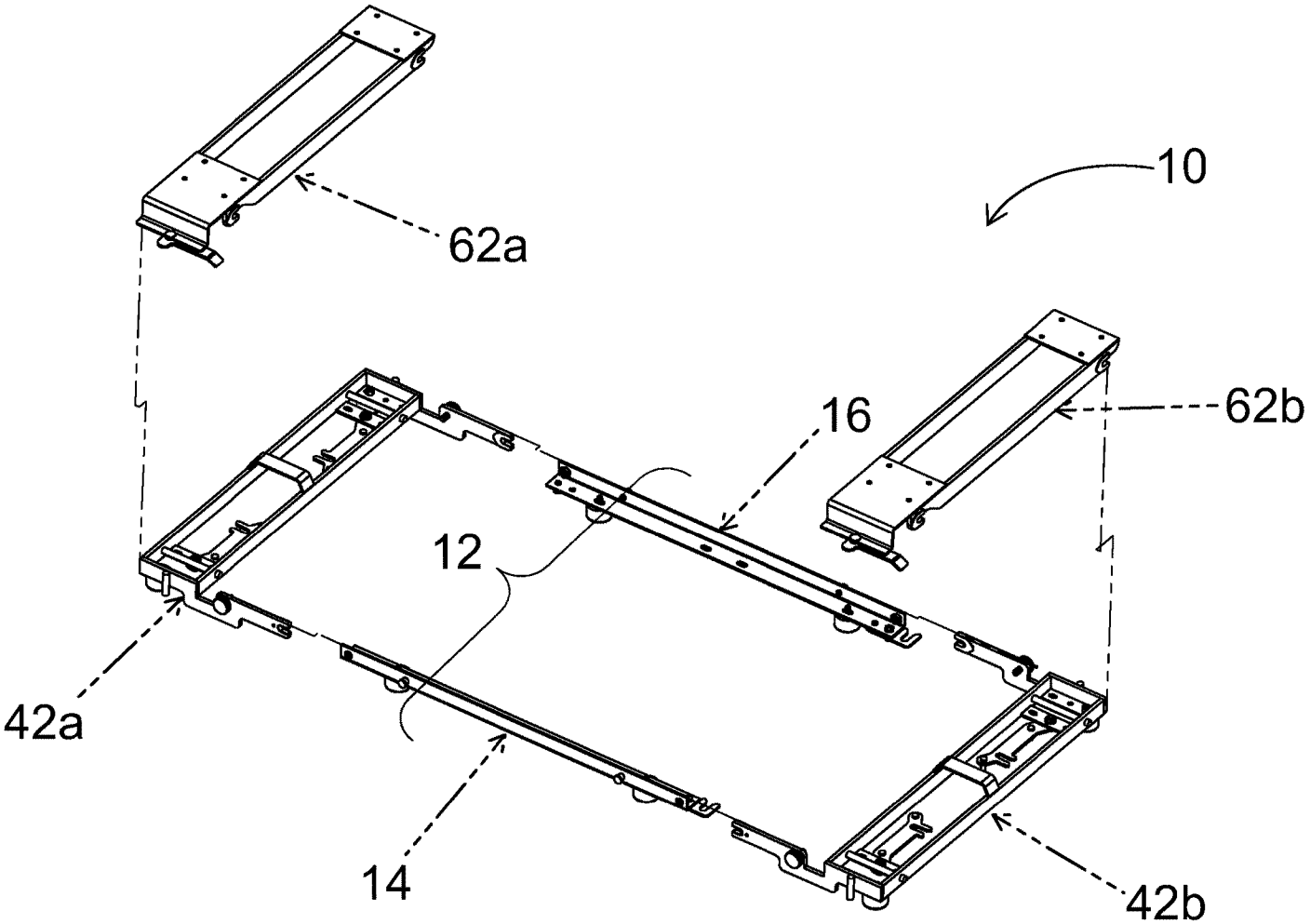
FIG. 43 is an exploded view of the components of FIG. 42.
Figure 44:
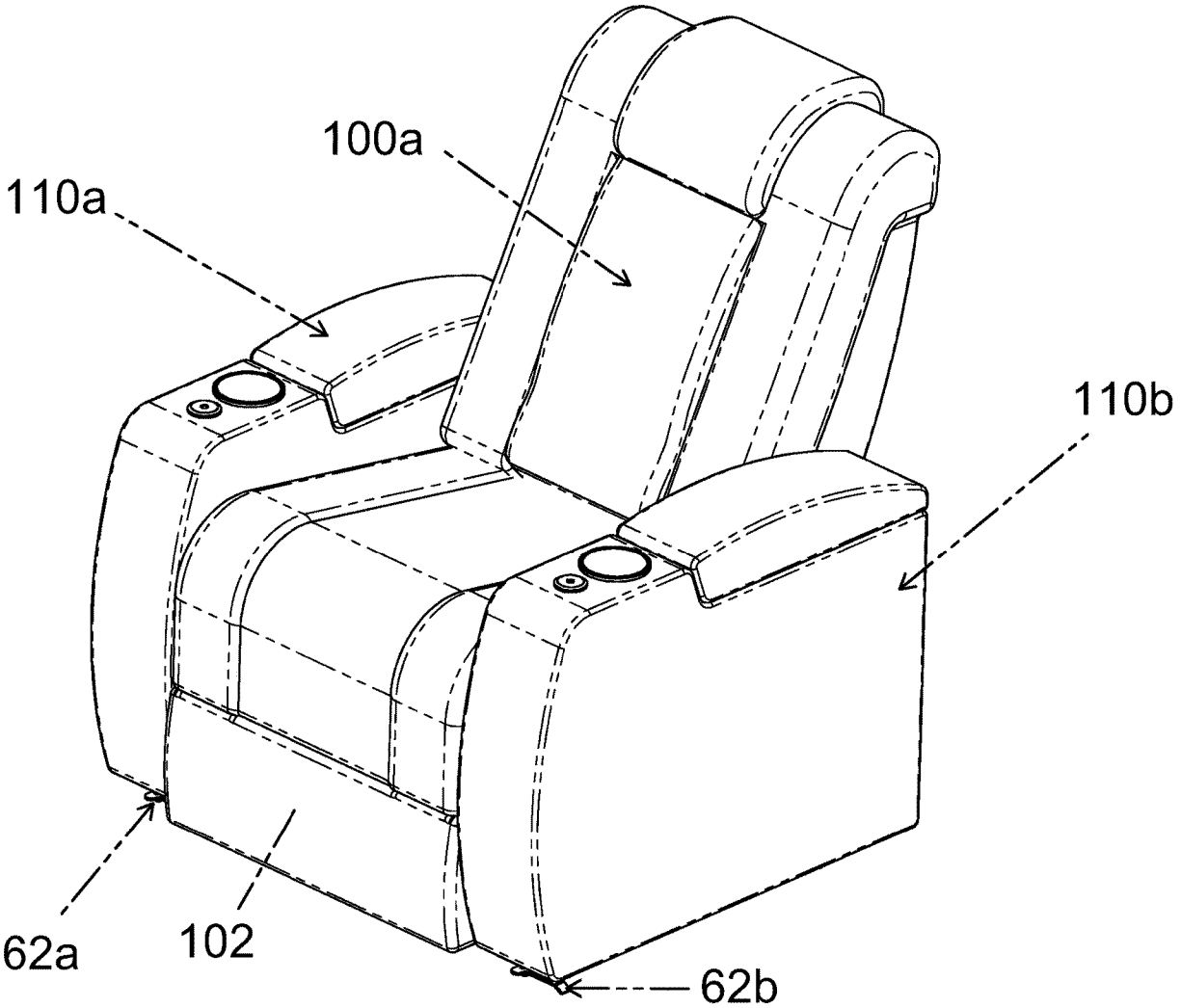
FIG. 44 is a left perspective view of the set of main brackets, the two base linkage brackets, and two mounting brackets of FIG. 42 secured to a main furniture unit and two supplemental furniture units.
Figure 45:
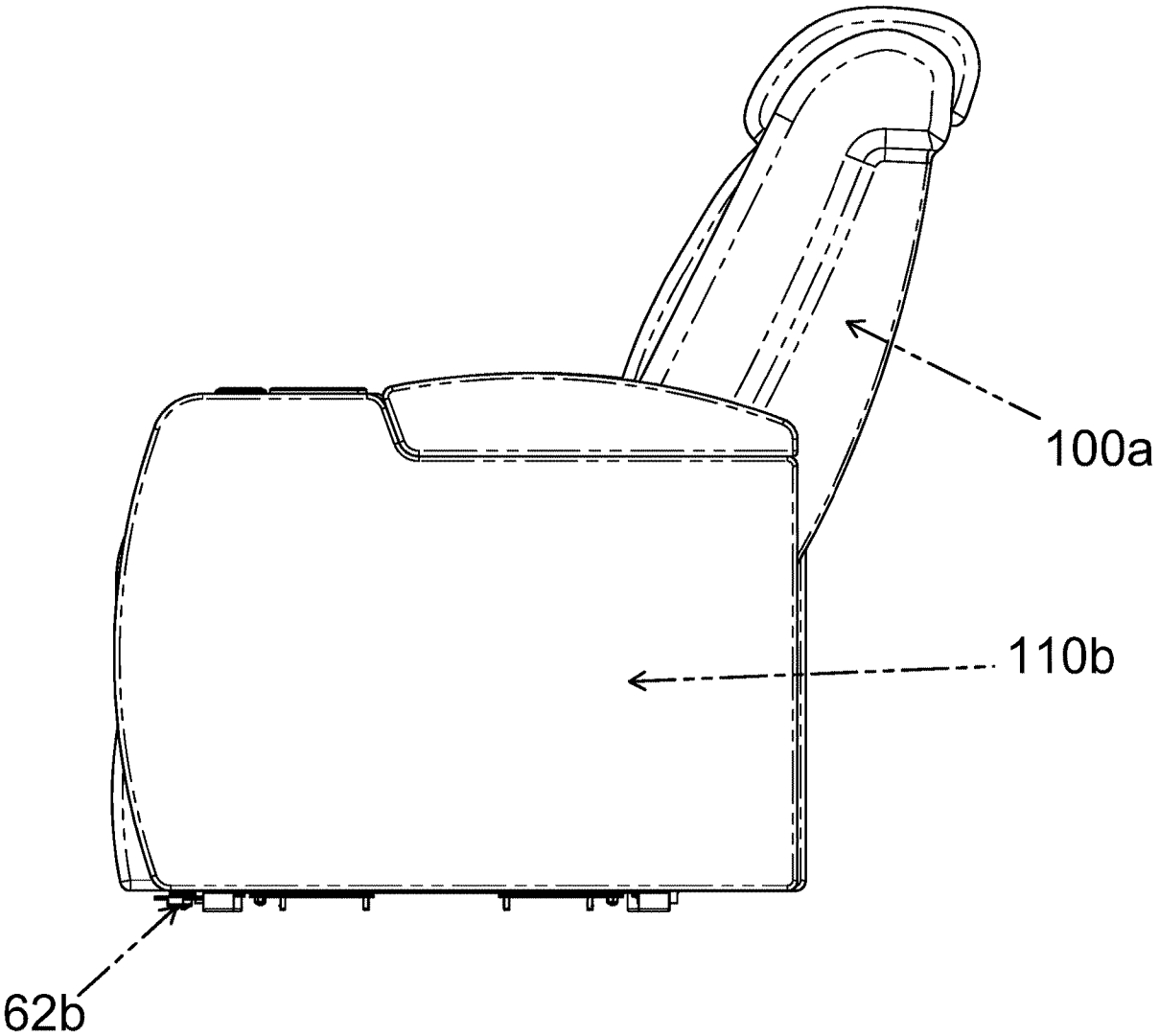
FIG. 45 is a left side view of FIG. 44.
Figure 46:
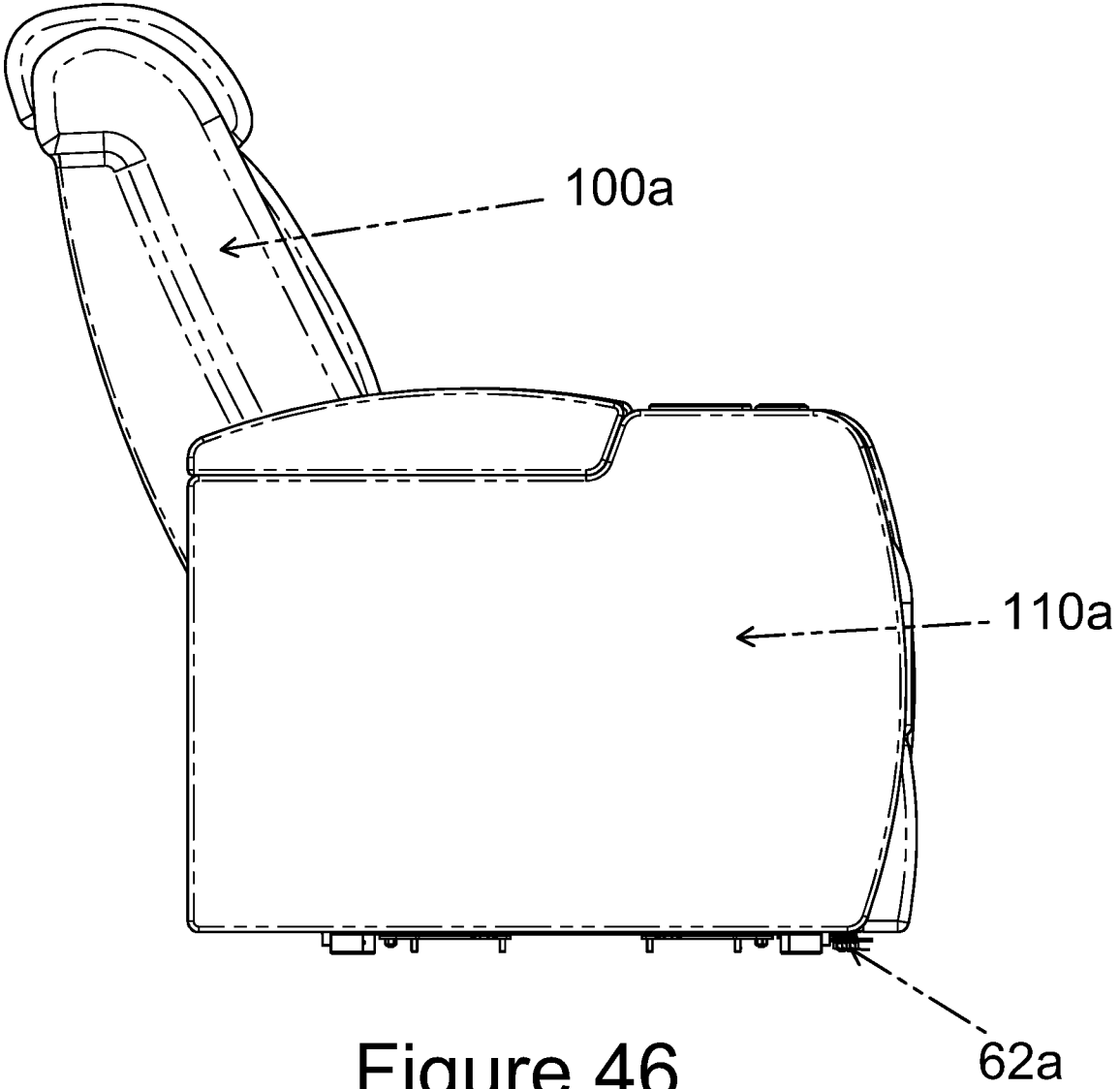
FIG. 46 is a right side view of FIG. 44.
Figure 47:
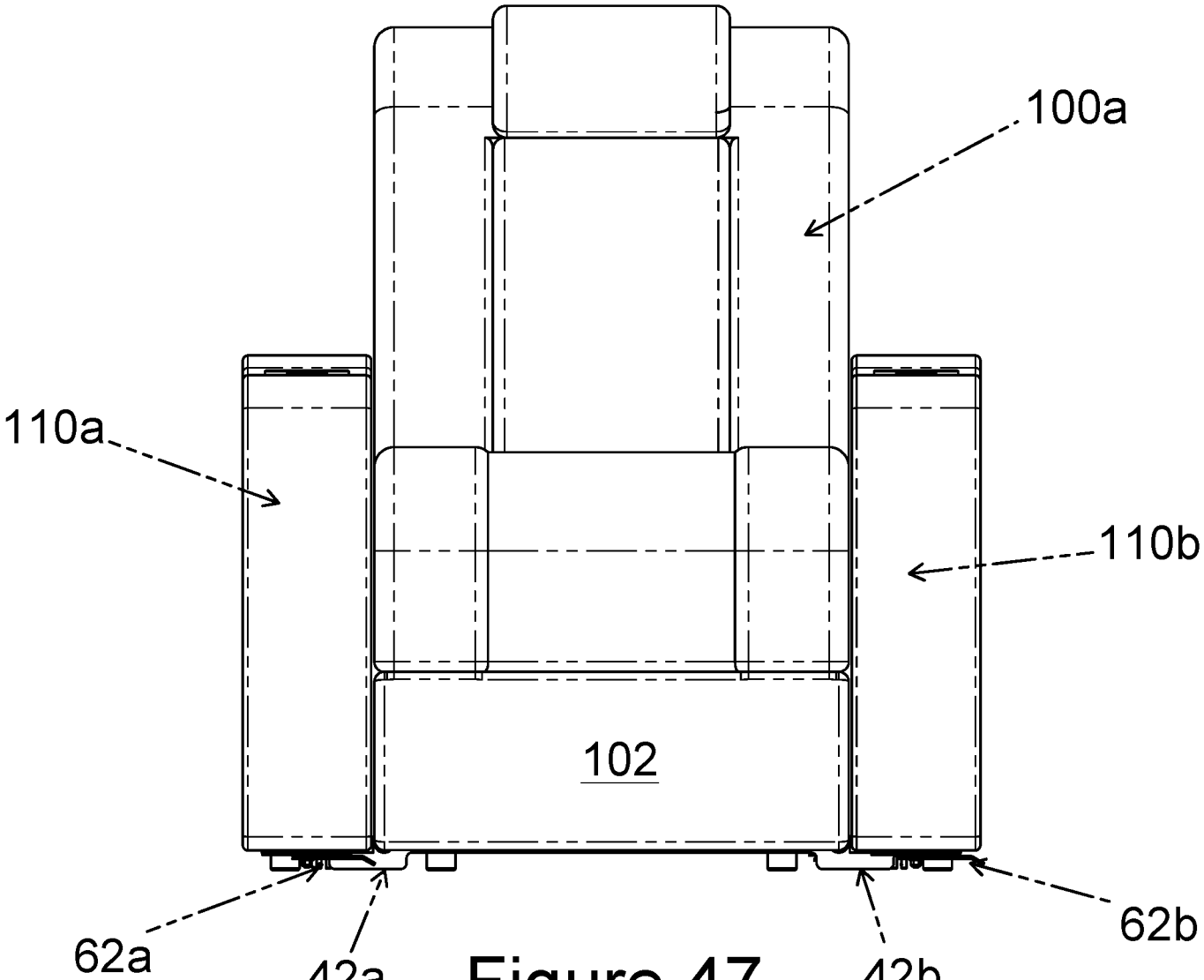
FIG. 47 is a front view of FIG. 44.
Figure 48:
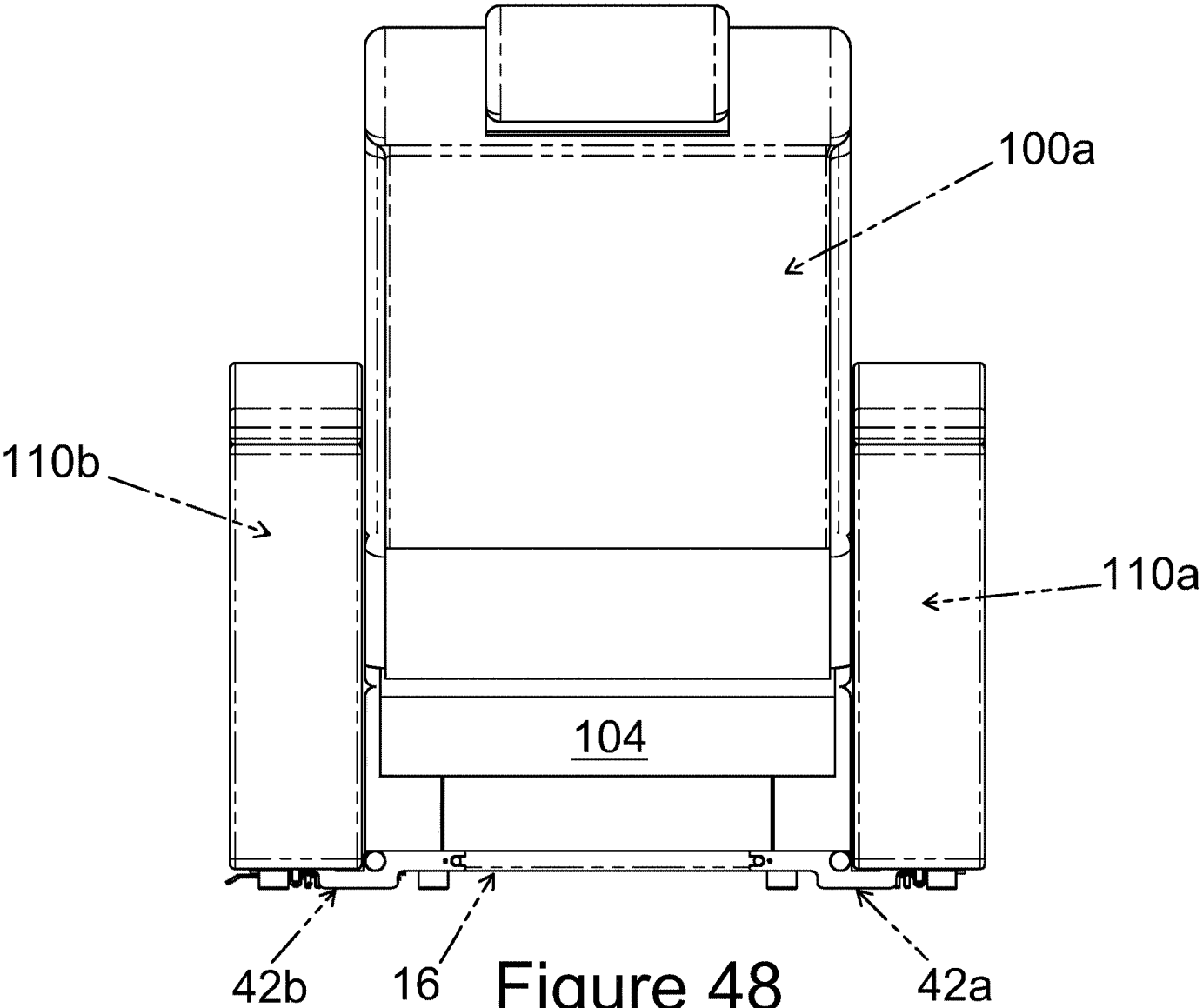
FIG. 48 is a rear view of FIG. 44.
Figure 49:
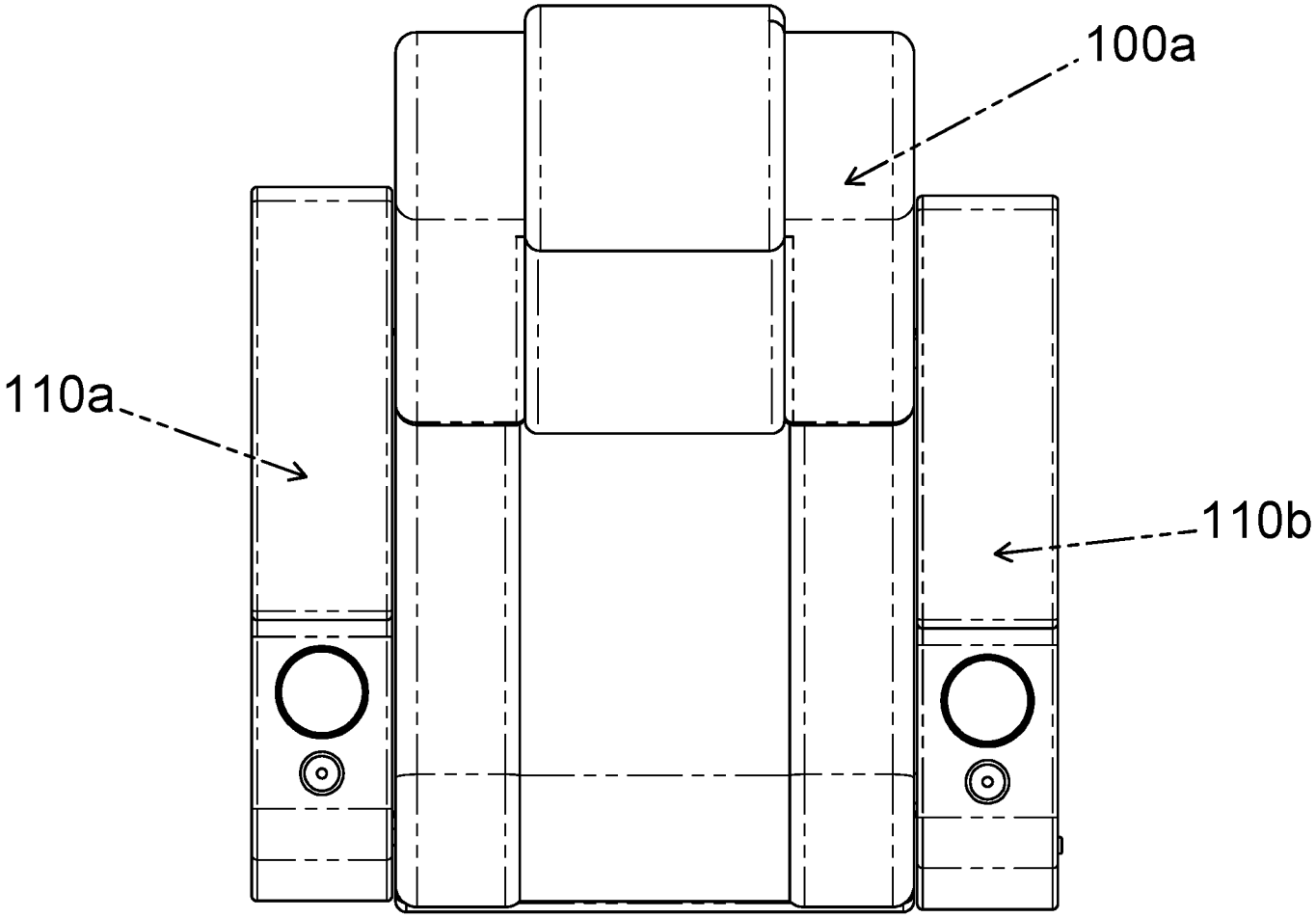
FIG. 49 is a top view of FIG. 44.
Figure 50:
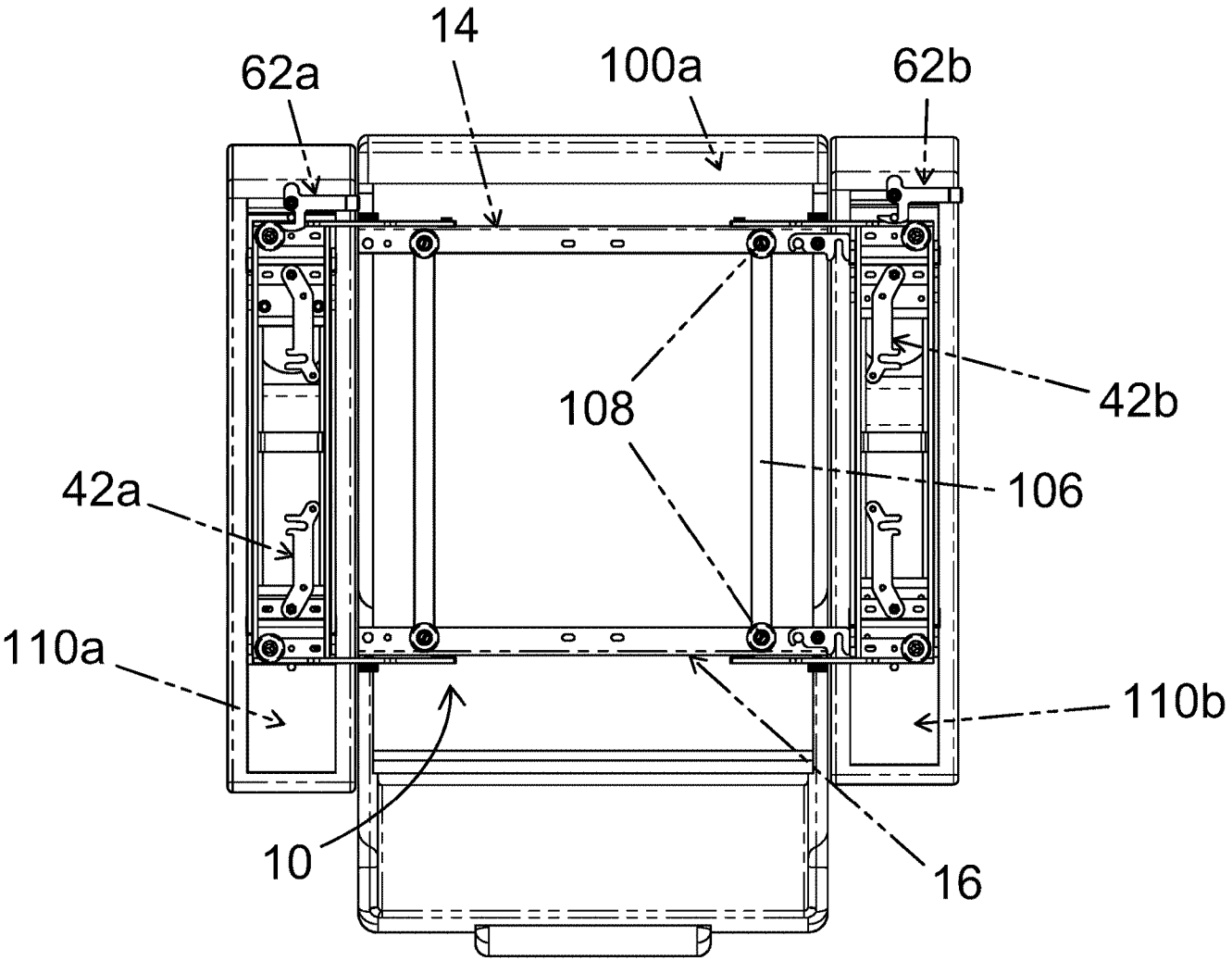
FIG. 50 is a bottom view of FIG. 44.

FIGS. 23 to 25 illustrate an example of the base linkage bracket 42 coupled/in use with a set of main brackets 12 in one example configuration. The rigid pegs 40 on the front and rear frame extension brackets 14, 16 proximate the base linkage bracket 42 may be received within the base slots 58 on the pair of extensions 46 of the base linkage bracket 42. If the rigid pegs 40 extend to a head 41 that is wider than the respective rigid peg 40, the presence of the heads 41 may help to prevent the base slots 58 from sliding along the rigid pegs 40 and to help hold the base slots 58 in place.

When the rigid pegs 40 are received within the base slots 58 on the pair of extensions 46 of the base linkage bracket 42, the base fasteners 60 on the pair of extensions 46 become aligned with the corresponding main bracket aperture 32 on the respective front and rear frame extension brackets 14, 16. Thus, the base fasteners 60 may operatively engage with, such as screw into, the corresponding main bracket apertures 32 on the front and rear frame extension brackets 14, 16 to help more firmly couple the set of main brackets 12 and the base linkage bracket 42 together.

FIGS. 24 and 25 illustrate an example when the bracket system 10 shown in FIG. 23 is secured to the first main furniture unit 100*a*, where the first main furniture unit 100*a* is a theatre seat. If desired, the base linkage bracket 42 may be disengaged from the set of main brackets 12, bare handed, by applying the reverse of the process described above.

As noted above, the base linkage bracket 42 may also be releasably engageable with the other side of the set of main brackets 12. To that end, the pair of base latches 48 may pivot and operatively engage with the rigid posts 28 of the front and rear frame extension brackets 14, 16. This will be discussed in greater detail below.

Turning next to FIGS. 26 to 30, there is shown an example of the mounting bracket 62. The mounting bracket 62 generally includes a mounting frame 64 and a mounting latch 66.

The mounting frame 64 may be dimensioned to correspond and cover the base frame 44 of the base linkage bracket 42. The mounting frame 64 may comprise mounting plates 68 positioned at opposed ends that are secured together with mounting frame sides 70. The mounting plates 68 may be securable to the base structural members of the supplemental unit.

The mounting frame 64 may further comprise at least two mounting slots 72, each positioned and orientated to correspondingly receive therein one of the base posts 50 extending from the first or second base frame sides 56, 57 of the base linkage bracket 42. In some applications, the at least two mounting slots 72 may form part of the mounting frame sides 70, and the mounting bracket 62 may have more than two mounting slots 72. In the embodiment illustrated in FIGS. 26 to 27, for example, the mounting frame 64 has four mounting slots 72. Two mounting slots 72 forming part of one of the mounting frame sides 70, and another two mounting slots 72 forming part of the other mounting frame side 70. Notably, the four mounting slots 72 of the mounting bracket 62 are positioned to align with the four base posts 50 of the base linkage bracket 42 when they are coupled together.

The mounting latch 66 of the mounting bracket 62 may be pivotably coupled to an end of the mounting frame 64. The mounting latch 66 in the illustrated embodiment comprises a handle 74 and a catch 76. Positioned in such a manner, the mounting latch 66 may correspond and operatively engage with one of the stops 52 of the base linkage bracket 42 when the brackets are coupled together.

As noted above, the mounting frame 64 may be securable to the base structural members of a supplemental unit via the mounting plates 68. Similar to the main units described above, the supplemental unit may be a complementary or auxiliary appliance or furniture item with a rigid frame. In example embodiments, the supplemental units may be a first supplemental furniture unit 110*a*, such as a side table, a storage compartment, or an armrest. In the embodiment depicted in FIGS. 28 to 30, the first supplemental furniture unit 110*a* is an armrest with base structural members 112. The mounting bracket 62 is further shown to be secured to the base structural members 112 of the first supplemental furniture unit 110*a* via armrest fasteners 114 extending through the mounting plates 68.

To releasably engage the mounting bracket 62 with the base linkage bracket 42, the mounting frame 64 (of the mounting bracket 62) may be positioned over the base frame 44 (of the base linkage bracket 42) such that the base posts 50 of the base linkage bracket 42 are positioned within the mounting slots 72 of the mounting bracket 62. The mounting latch 66 (of the mounting bracket 62) may then be engaged around the stop 52 (of the base linkage bracket 42) that is proximate the mounting latch 66. For example, the handle 74 of the mounting latch 66 may be pivoted such that the catch 76 engages around the stop 52. In this manner, the base posts 50 may be mechanically held within the mounting slots 72, thereby securely coupling the mounting bracket 62 to the base linkage bracket 42.

If desired, the mounting bracket 62 with the base linkage bracket 42 may be disengaged from one another, bare handed, by applying the reverse of the process described above.

Given the releasable couple-ability between the set of main brackets 12, the base linkage bracket 42, and the mounting bracket 62, the use of the bracket system 10 helps to allow for the assembly and arrangement of multiple rigid frame modular units in numerous potential configurations. The bracket system 10 allows users to continuously convert or upgrade their modular units into different configuration to suit their needs without professional assistance or the use of specialized tools.

In addition to the "seat-seat" configuration described above, FIGS. 31 to 41 illustrate a "seat-armrest-seat" configuration using the bracket system 10. FIGS. 42 to 50 illustrate an "armrest-seat-armrest" configuration using the bracket system 10.

In FIGS. 31 to 41, two sets of main brackets 12*a*, 12*b* (first, second) are shown with the base linkage bracket 42 and the mounting bracket 62. The first and second sets of main brackets 12*a*, 12*b* and the mounting bracket 62 are shown both in isolation and secured, respectively, to the first main furniture unit 100*a*, the second main furniture unit 100*b*, and the first supplemental furniture unit 110*a*.

For the layman to assemble the "seat-armrest-seat" configuration, base linkage bracket 42 may first be aligned with the first set of main brackets 12*a* (secured to the first main furniture unit 100*a*). The rigid pegs 40 on the front and rear frame extension brackets 14, 16 of the first set of main brackets 12*a* proximate the base linkage bracket 42 may be received within the base slots 58 on the pair of extensions 46 of the base linkage bracket 42. If the rigid pegs 40 extend to a head 41 that is wider than the respective rigid peg 40, the presence of the heads 41 may help to prevent the base slots 58 from sliding along the rigid pegs 40 and to help hold the base slots 58 in place.

When the rigid pegs 40 of the first set of main brackets 12*a* are received within the base slots 58 of the base linkage bracket 42, the base fasteners 60 on the pair of extensions 46 become aligned with the corresponding main bracket aperture 32 on the respective front and rear frame extension brackets 14, 16 of the first set of main brackets 12*a*. The base fasteners 60 may then be operatively engaged with, such as screwed into, the corresponding main bracket apertures 32 on the front and rear frame extension brackets 14, 16 of the first set of main brackets 12*a*. This collectively helps to firmly couple the first set of main brackets 12*a* and the base linkage bracket 42 together.

For the second set of main brackets 12*b* (secured to the second main furniture unit 100*b*), the pair of base latches 48 of the base linkage bracket 42 may pivot outwardly and operatively engage with (or slide around) the rigid posts 28 of the front and rear frame extension brackets 14, 16 of the second set of main brackets 12*b*. A user may manually pivot the pair of base latches 48 via the central opening or space in the base frame 44. If the rigid posts 28 extend to heads 29, the presence of the heads 29 may help to prevent the base latches 48 from sliding along the rigid posts 28 and to help hold the base latches 48 in place.

The mounting bracket 62 (secured to the first supplemental furniture unit 110*a*) may then be positioned over the base frame 44 (of the base linkage bracket 42) between the first and second main furniture units 100*a*, 100*b*, such that the base posts 50 of the base linkage bracket 42 slide into the mounting slots 72 of the mounting bracket 62. The mounting latch 66 (of the mounting bracket 62) may then be pivoted around the stop 52 (of the base linkage bracket 42) to mechanically hold the base posts 50 within the mounting slots 72, thereby securely engaging the mounting bracket 62 to the base linkage bracket 42.

When the bracket system 10 is engaged together in such a manner, the first and second main furniture units 100*a*, 100*b*, and the first supplemental furniture unit 110*a* may be releasably coupled together as shown in FIGS. 34 to 41. If desired, the mounting bracket 62, the base linkage bracket 42, and the two sets of main brackets 12*a*, 12*b* may be disengaged from one another, bare handed, by applying the reverse of the process described above. Disengaging the mounting bracket 62, the base linkage bracket 42, and the two sets of main brackets 12*a*, 12*b* would then separate the first and second main furniture units 100*a*, 100*b*, and the first supplemental furniture unit 110*a* from one another.

In FIGS. 42 to 50, one set of main brackets 12 is shown with two base linkage brackets 42*a*, 42*b* (first, second) and two mounting brackets 62*a*, 62*b* (first, second). The set of main brackets 12 and the first and second mounting brackets 62*a*, 62*b* are shown both in isolation and secured, respectively, to the first main furniture unit 100*a*, the first supplemental furniture unit 110*a*, and a second supplemental furniture unit 110*b*.

For the layman to assemble the "armrest-seat-armrest" configuration, the first base linkage bracket 42*a* may rotated 180 degrees such that the extensions 46 face the set of main brackets 12 and are aligned with one side of the set of main brackets 12 (that is secured to the first main furniture unit 100*a*).

Similar to the process described above, the rigid pegs 40 on the front and rear frame extension brackets 14, 16 of the set of main brackets 12 proximate the first base linkage bracket 42*a* may be received within the base slots 58 on the pair of extensions 46 of the first base linkage bracket 42*a*. The base fasteners 60 may then operatively engage with, such as screw into, the corresponding main bracket apertures 32 on the front and rear frame extension brackets 14, 16 of the set of main brackets 12. This collectively helps to firmly engage the set of main brackets 12 and the first base linkage bracket 42*a* together.

The second base linkage bracket 42*b* may also be aligned with the other side of the set of main brackets 12 such that the extensions 46 face the set of main brackets 12. Similar to the process described above, the rigid pegs 40 on the front and rear frame extension brackets 14, 16 of the set of main brackets 12 proximate the second base linkage bracket 42*b* may be received within the base slots 58 on the pair of extensions 46 of the second base linkage bracket 42*b*. The base fasteners 60 may then operatively engage with, such as screw into, the corresponding main bracket apertures 32 on the front and rear frame extension brackets 14, 16 of the set of main brackets 12. This collectively helps to firmly engage the set of main brackets 12 and the second base linkage bracket 42*b* together.

Before or after the second base linkage bracket 42*b* is coupled to the other side of the set of main brackets 12, the first mounting bracket 62*a* (secured to the first supplemental furniture unit 110*a*) may be positioned over the base frame 44 (of the first base linkage bracket 42*a*), such that the base posts 50 of the first base linkage bracket 42*a* slide into the mounting slots 72 of the first mounting bracket 62*a*. The mounting latch 66 (of the mounting bracket 62) may then be pivoted around the stop 52 (of the first base linkage bracket 42*a*) to mechanically hold the base posts 50 within the mounting slots 72, thereby securely coupling the first mounting bracket 62*a* to the first base linkage bracket 42*a*. As noted above, having stops 52 positioned at both of the opposed ends 54 of the base linkage brackets 42 allow the base linkage brackets 42 to be used in more than one configuration with the set of main brackets 12.

After the second base linkage bracket 42*b* is coupled to the other side of the set of main brackets 12, the second mounting bracket 62*b* (secured to the second supplemental furniture unit 110*b*) may be releasably engaged to the second base linkage bracket 42*b* in a similar manner as described above.

When the bracket system 10 is engaged together in such a manner, the first main furniture unit 100*a*, and the first and second supplemental furniture units 110*a*, 110*b* may be releasably coupled together as shown in FIGS. 44 to 50. If desired, the first and second mounting brackets 62*a*, 62*b*, the first and second base linkage brackets 42*a*, 42*b*, and the set of main brackets 12 may be separated from one another, bare handed, by applying the reverse of the processes described above. Disengaging first and second mounting brackets 62*a*, 62*b*, the first and second base linkage brackets 42*a*, 42*b*, and the set of main brackets 12 would then separate the first and second supplemental furniture units 110*a*, 110*b*, and the first main furniture unit 100*a* from one another.

It is evident from the foregoing that the bracket system 10 may comprise one or more sets of main brackets 12 in order to releasably couple one or more main furniture units together. If supplemental furniture units are desired, the bracket system 10 may further comprise one or more base linkage brackets 42, and one or more corresponding mounting brackets 62, depending on how many supplemental furniture units are desired. The various brackets may be coupled together in numerous potential configurations, allowing users to continuously convert or upgrade their modular units into different configuration to suit their needs without professional assistance or the use of specialized tools.

Figure 51:
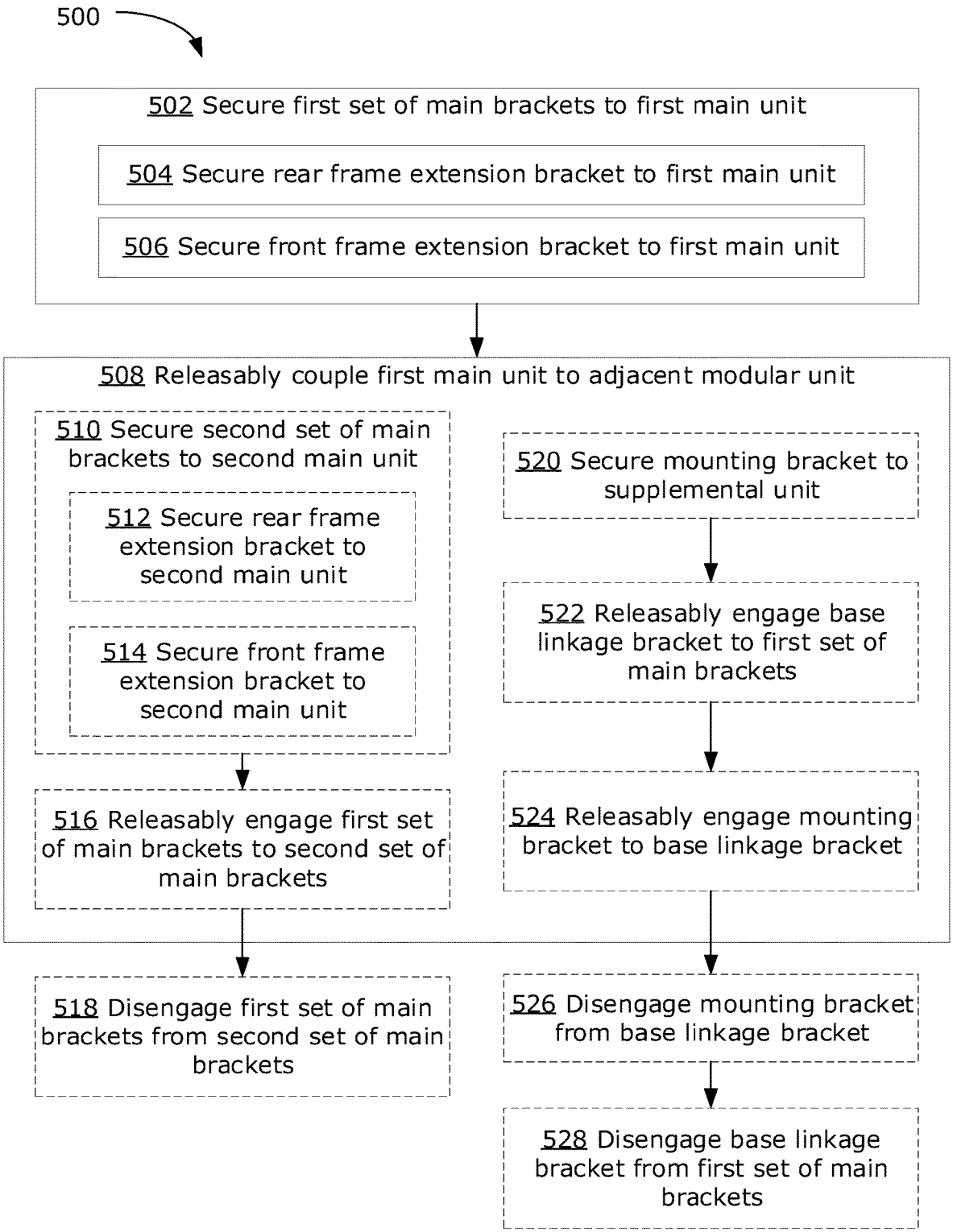
FIG. 51 is a flowchart illustrating is a method of releasably coupling modular units together using a bracket system according to an example embodiment.

Reference is now made to FIG. 51, which is a flowchart illustrating example method 500 for releasably coupling modular units together. The method 500 may be performed using the bracket system 10 as described above, or a different system with similar capabilities.

At step 502, when the bracket system comprises a first set of main brackets and one or more adjacent brackets. The method 500 includes securing the first set of main brackets, which includes a front frame extension bracket and a rear frame extension bracket, to a first main unit. To that end, at step 504, the front frame extension bracket may be secured to base structural members along a front of the first main unit, and at step 506, the rear frame extension bracket may be secured to base structural members along a rear of the first main unit. In some applications, the modular units may be large appliances or furniture items. In example embodiments, the modular units may be modular appliance units or modular furniture units. In cases of modular furniture units, the first main unit may be a first main furniture unit, such as a shelf, sofa, or table etc. In some applications, the first main furniture unit may be a slipper chair, an ottoman, a couch sectional, or a theatre seat.

At step 508, the first main unit is then releasably coupled to an adjacent modular unit, by releasably connecting the first set of main brackets to the one or more adjacent brackets secured the adjacent modular unit.

To that end, if it is desired to releasably couple the first main unit to another/second main unit, the one or more adjacent brackets may comprise a second set of main brackets. Thus, at step 510, the method 500 may further include securing the second set of main brackets to a second main unit. In that regard, at step 512, a front frame extension bracket of the second set of main brackets may be secured to base structural members along a front of the second main unit, and at step 514, a rear frame extension bracket of the second set of main brackets may be secured to base structural members along a rear of the second main unit. Then at step 516, the first set of main brackets may be releasably connected to the second set of main brackets manually, or bare handed, in order to releasably couple the first main unit to the second main unit. In some examples, both of the first and second main units may be theatre seats. In other examples, the first and second main units may be different from one another.

In an alternate example, at step 518, the first set of main brackets may be disconnected from the second set of main brackets manually, or bare handed, in order to separate the first main unit from the second main unit.

If it is desired to releasably couple the first main unit with a supplemental unit, the one or more adjacent brackets may comprise a base linkage bracket and a mounting bracket. Thus, at step 520, the method 500 may further include securing the mounting bracket to base structural members of the supplemental unit. At step 522, the base linkage bracket may be releasably connected to the first set of main brackets manually, or bare handed. Then at step 524, the mounting bracket may be releasably connected to the base linkage bracket manually, or bare handed, in order to releasably couple the supplemental unit to the first main unit. In some examples, the first main unit may be a theatre seat, while the supplemental unit may be an armrest.

In an alternate example, in order to separate the first main unit from the supplemental unit, at step 526, the mounting bracket may be disconnected from the base linkage bracket manually, or bare handed, and at step 528, the base linkage bracket may be disconnected from the first set of main brackets also manually, or bare handed.

It is evident from the foregoing that various embodiments of the method 500 may be used, in combination and/or in sequence, in order to releasably couple one or more main units and/or one or more supplemental units together. The various brackets and main/supplemental units may be coupled together in numerous potential configurations, allowing users to continuously convert or upgrade their modular units into different configuration to suit their needs without professional assistance or the use of specialized tools.

The various example embodiments are merely examples and are in no way meant to limit the scope of the example embodiments. Variations of the innovations described herein will be apparent to persons of ordinary skill in the art, such variations being within the intended scope of the example embodiments. In particular, features from one or more of the example embodiments may be selected to create alternative embodiments comprised of a sub-combination of features which may not be explicitly described. In addition, features from one or more of the described example embodiments may be selected and combined to create alternative example embodiments composed of a combination of features which may not be explicitly described. Features suitable for such combinations and sub-combinations would be readily apparent to persons skilled in the art. The subject matter described herein intends to cover all suitable changes in technology.

The invention claimed is:

1. A bracket system securable to modular units for releasably coupling the modular units together, the bracket system comprising:

a first set of main brackets comprising:

a front frame extension bracket securable to base structural members along a front of a first main unit, and a rear frame extension bracket securable to the base structural members along a rear of the first main unit, each of the front frame extension bracket and the rear frame extension bracket comprising:

a beam comprising a post end and an opposed hook end;

a rigid post secured proximate to the post end of the beam, the rigid post extending away from the beam;

a hook secured to the hook end of the beam, the hook dimensioned to receive the rigid post therein; and a main bracket aperture positioned at each of the post end and the hook end of the beam, each main bracket aperture dimensioned to receive a fastener therethrough;

wherein the hooks and the rigid posts of each of the front frame extension bracket and the rear frame extension bracket are configured to releasably engage, respectively, with corresponding rigid posts and corresponding hooks secured to adjacent modular units, wherein the beam of each of the front frame extension bracket and the rear frame extension bracket is an L-shaped beam comprising a vertical leg and a horizontal leg extending between the post end and the hook end of each of frame extension bracket and the rear frame extension bracket, wherein the bracket system is securable only to the base structural members and is configured to releasably couple the modular units together bare handed, wherein the L-shaped beam of each of the front frame extension bracket and the rear frame extension bracket is dimensioned to extend from one side of the first main unit to an opposed side of the first main unit, wherein the rigid post of each of the front frame extension bracket and the rear frame extension bracket are positioned at the one side of the first main unit, wherein the hook of each of the front frame extension bracket and the rear frame extension bracket are positioned to extend past the opposed side of the first main unit, wherein the rigid post of each of the front frame extension bracket and the rear frame extension bracket is secured to one of the vertical and horizontal legs proximate the post end of the L-shaped beam, wherein the hook of each of the front frame extension bracket and the rear frame extension bracket extends from the one of the vertical and horizontal legs, wherein the main bracket apertures of each of the front frame extension bracket and the rear frame extension bracket are positioned on the other one of the vertical and horizontal legs;

a second set of main brackets securable to base structural members of a second main unit, wherein the hooks of the first set of main brackets releasably engage with the corresponding rigid posts of the second set of main brackets;

a brace piece with a brace aperture, the brace piece dimensioned to extend over a portion of both of the vertical legs of the front frame extension brackets or the rear frame extension brackets when the first and second sets of main brackets are coupled together; and a brace fastener configured to extend through the brace aperture and one of the main bracket apertures positioned on the vertical legs of each of the L-shaped beams, wherein:

(i) the brace piece holds the rear frame extension brackets together when the brace piece is positioned over an outer surface of the vertical legs of the rear frame extension brackets and the brace fastener extends through the brace aperture and the main bracket aperture at the hook end of the rear frame extension bracket of the first set of main brackets; or (ii) the brace piece holds the front frame extension brackets together when the brace piece is positioned over an outer surface of the vertical legs of the front frame extension brackets and the brace fastener extends through the brace aperture and the main bracket aperture at the post end of the front frame extension bracket of the second set of main brackets.

2. The bracket system of claim 1, wherein the modular units are modular furniture units, the first main unit is a first main furniture unit, the first main furniture unit is a theatre seat, and the first set of main brackets is secured to the first main furniture unit.

3. The bracket system of claim 1, wherein each of the front frame extension bracket and the rear frame extension bracket comprises:

a pair of rigid pegs positioned on the vertical leg extending away from the corresponding horizontal leg, each rigid peg being positioned proximate to and equidistant from one of the main bracket apertures.

4. The bracket system of claim 3, wherein each of the rigid posts and the rigid pegs extends to a head that is wider than the respective rigid post or rigid peg.

5. The bracket system of claim 3, further comprising:

a first base linkage bracket comprising:

a base frame dimensioned to correspond with base structural members of a first supplemental unit, the base frame comprising opposed ends and first and second base frame sides extending between the opposed ends;

a pair of extensions extending from the opposed ends of the base frame, the pair of extensions extending in parallel to each other from the first base frame side, each extension comprising:

a base slot at a distal end of the extension, each base slot dimensioned and orientated to receive therein one of the rigid pegs on the front or rear frame extension bracket; and a base fastener positioned between the base frame and the base slot, the base fastener positioned to align and operatively engage with the respective main bracket aperture on the front or rear frame extension bracket when the base slot engages with one of the rigid pegs;

a pair of base latches, each pivotably coupled proximate to one of the opposed ends of the base frame, each base latch configured to pivotably extend from the second base frame side and operatively engage with one of the rigid posts of the front or rear frame extension bracket;

a base post extending from the first base frame side positioned proximate one of the opposed ends of the base frame, and another base post extending from the second base frame side positioned proximate the other one of the opposed ends; and a stop secured to one of the opposed ends of the base frame, the stop extending past a horizontal plane of the base frame.

6. The bracket system of claim 5, further comprising another stop secured to the other one of the opposed ends of the base frame, the other stop extending past the horizontal plane of the base frame.

7. The bracket system of claim 6, wherein each base fastener is a thumbscrew.

8. The bracket system of claim 6, wherein the first base linkage bracket is releasably securable to either side of the first set of main brackets by:

the rigid pegs on the front frame extension bracket and the rear frame extension bracket proximate the first base linkage bracket are received within the base slots on the pair of extensions of the first base linkage bracket, and the corresponding base fasteners operatively engage with the corresponding main bracket apertures on the front frame extension bracket and the rear frame extension bracket, or the pair of base latches pivot and operatively engage with the rigid posts of the front frame extension bracket and the rear frame extension bracket.

9. The bracket system of claim 8, further comprising:

a first mounting bracket comprising:

a mounting frame dimensioned to correspond and cover the base frame of the first base linkage bracket, the mounting frame comprising:

mounting plates securable to the base structural members of the first supplemental unit;

at least two mounting slots, each positioned and orientated to correspondingly receive therein the base post or the other base post extending from the first and second base frame sides of the first base linkage bracket;

a mounting latch pivotably coupled to an end of the mounting frame, the mounting latch positioned to correspond and operatively engage with one of the stops of the first base linkage bracket;

wherein engaging the mounting latch around one of the stops of the first base linkage bracket when the base post and the other base post of the first base linkage bracket are positioned within the at least two mounting slots, releasably couples the first base linkage bracket with the first mounting bracket.

10. The bracket system of claim 9, wherein the mounting plates are positioned at opposed ends of the mounting frame and the mounting frame further comprises mounting frame sides extending between the mounting plates, wherein the at least two mounting slots are secured to the mounting frame sides.

11. The bracket system of claim 10, wherein:

the modular units are modular furniture units;

the first main unit is a first main furniture unit, the first main furniture unit is a theatre seat, and the first set of main brackets is secured to the first main furniture unit; and the first supplemental unit is a first supplemental furniture unit, the first supplemental furniture unit is an armrest, and the first mounting bracket is secured to the first supplemental furniture unit.

12. The bracket system of claim 10, further comprising:

a second set of main brackets securable to base structural members of a second main unit, wherein the pair of extensions of the first base linkage bracket releasably engages with corresponding rigid pegs and main bracket apertures on one side of the front frame extension bracket and the rear frame extension bracket of the first set of main brackets, and wherein the pair of base latches of the first base linkage bracket releasably engages with corresponding rigid posts on one side of the front frame extension bracket and the rear frame extension bracket of the second set of main brackets.

13. The bracket system of claim 10, further comprising:

a second base linkage bracket; and a second mounting bracket securable to base structural members of a second supplemental unit;

wherein the pair of extensions of the first base linkage bracket releasably engages with corresponding rigid pegs and main bracket apertures on one side of the front frame extension bracket and the rear frame extension bracket of the first set of main brackets, and wherein the pair of extensions of the second base linkage bracket releasably engages with corresponding rigid pegs and main bracket apertures on another side of the front and rear frame extension brackets of the first set of main brackets.

14. The bracket system of claim 1, wherein:

the rigid post of each of the front frame extension bracket and the rear frame extension bracket is secured to the respective horizontal leg extending away from the corresponding vertical leg, the hook of each of the front frame extension bracket and the rear frame extension bracket extends from the respective horizontal leg, the hook of the front frame extension bracket facing away from the corresponding vertical leg, and the hook of the rear frame extension bracket facing the corresponding vertical leg, and the main bracket apertures are positioned on the vertical legs at each of the post ends and the hook ends of each of the L-shaped beams.

* * * * *